US006736186B2

(12) United States Patent
Anderson et al.

(10) Patent No.: US 6,736,186 B2
(45) Date of Patent: May 18, 2004

(54) HEADRAIL AND CONTROL SYSTEM FOR POWERED COVERINGS FOR ARCHITECTURAL OPENINGS

(75) Inventors: Richard N. Anderson, Whiteville, KY (US); Donald E. Fraser, St. Petersburg, FL (US); Everett S. Coleman, Owensboro, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/206,700

(22) Filed: Jul. 25, 2002

(65) Prior Publication Data

US 2002/0189768 A1 Dec. 19, 2002

Related U.S. Application Data

(63) Continuation of application No. 09/481,307, filed on Jan. 11, 2000, now Pat. No. 6,446,693.

(60) Provisional application No. 60/115,393, filed on Jan. 11, 1999, provisional application No. 60/126,104, filed on Mar. 25, 1999, and provisional application No. 60/138,743, filed on Jun. 11, 1999.

(51) Int. Cl.[7] ..... E06B 9/30

(52) U.S. Cl. ..... 160/168.18 P; 160/176.1 P

(58) Field of Search ..... 160/168.1 P, 176.1 P, 160/84.02, 310, 188, 178.1 R, 178.1 V; 429/99, 100

(56) References Cited

U.S. PATENT DOCUMENTS

| | | | | |
|---|---|---|---|---|
| 3,289,739 A | | 12/1966 | Hensel | 160/178 |
| 3,775,736 A | * | 11/1973 | Koomey | 367/133 |
| 4,096,903 A | | 6/1978 | Ringle, III | 160/178 |
| 4,532,194 A | * | 7/1985 | Liautaud et al. | 429/99 |
| 4,623,012 A | | 11/1986 | Rude et al. | 160/178 |

(List continued on next page.)

FOREIGN PATENT DOCUMENTS

| | | |
|---|---|---|
| AU | 76262/91 | 11/1991 |
| CA | 2162443 | 5/1996 |
| DE | 1509540 | 9/1969 |
| DE | 1659977 | 7/1970 |
| DE | 82239134 | 1/1983 |
| DE | 29508479 | 9/1995 |
| EP | 0273719 | 7/1988 |

(List continued on next page.)

*Primary Examiner*—Blair M. Johnson
(74) *Attorney, Agent, or Firm*—Dorsey & Whitney LLP

(57) ABSTRACT

A headrail designed for powered coverings for architectural openings comprises a housing defining an interior that conveniently hides a battery holder, a signal-receiving system, and an electric motor used to adjust the configuration of the covering. The headrail also hides improved hardware for mounting the motor and, in the case of coverings comprising tiltable elements, improved hardware for mounting a tilt rod. Additionally, in the case of coverings comprising tiltable elements, the headrail hides improved hardware for adjustably attaching the tiltable elements to the tilt rod in a manner that prevents over-rotation of the tiltable elements. The battery holder may comprise a battery magazine or a battery carrier removably mounted in the headrail housing. The batteries may be inserted into or extracted from the battery holder through an opening in a bottom wall of the headrail housing. A swingably mounted trap door may selectively cover or uncover the opening. The battery carrier slidingly engages, through the opening in the bottom of the headrail housing, a battery carrier housing that is mounted within the headrail housing. The signal-receiving system includes an exposed signal receiver for receipt of remote-control signals. The present invention also provides a tilt control system with an inexpensive and effective clutch to prevent over-winding of cords onto a control shaft (e.g., a tilt rod) used to control tiltable elements of the covering. The preferred tilt control system also minimizes torque on the motor or other mechanism used to drive the control shaft.

11 Claims, 28 Drawing Sheets

U.S. PATENT DOCUMENTS

| | | | | | |
|---|---|---|---|---|---|
| 4,951,730 | A | * | 8/1990 | Hsu | 160/310 |
| 5,228,491 | A | | 7/1993 | Rude et al. | 160/178 |
| 5,398,156 | A | * | 3/1995 | Steffes et al. | 361/683 |
| 5,415,955 | A | * | 5/1995 | Kobayashi et al. | 429/97 |
| 5,495,153 | A | | 2/1996 | Domel et al. | 160/178 |
| 5,662,154 | A | | 9/1997 | Drake, III | 160/178 |
| 6,060,852 | A | * | 5/2000 | Domel et al. | 318/480 |
| 6,201,364 | B1 | * | 3/2001 | Will et al. | 318/466 |
| 6,371,192 | B1 | * | 4/2002 | Anderson et al. | 160/178.1 R |
| 6,382,294 | B1 | * | 5/2002 | Anderson et al. | 160/168.1 P |
| 6,410,908 | B1 | * | 6/2002 | Anderson et al. | 250/227.11 |
| 6,446,693 | B1 | * | 9/2002 | Anderson et al. | 160/168.1 P |
| 6,516,858 | B1 | * | 2/2003 | Anderson et al. | 160/168.1 P |

FOREIGN PATENT DOCUMENTS

| | | |
|---|---|---|
| EP | 0838574 | 4/1998 |
| EP | 0843068 | 5/1998 |
| GB | 1187214 | 4/1970 |
| GB | 2076454 | 9/1983 |
| NZ | 161962 | 2/1972 |
| WO | WO /91/14848 | 10/1981 |
| WO | WO /88/06671 | 9/1988 |

* cited by examiner 176
164
178
168
186
182
174
146
158
160
168
162
184
170
166
172
148
154
156
56
70
34'
150
152
38
194
190
196
192
144
198
22
194
190
192

22''
24
31
31

280
290'
282
284
290'
300

222''
304
302
56''
22''
282
298
300
294
288'
284
276'
288'
300
296
293
294
222''
304
302
292'
14'
58''
292'
38''
284
282

276'
286'
282
290'
290'
14'
288'
296
22''
24

HEADRAIL AND CONTROL SYSTEM FOR POWERED COVERINGS FOR ARCHITECTURAL OPENINGS

CROSS-REFERENCE TO RELATED APPLICATIONS

This application is a continuation of U.S. application Ser. No. 09/481,307, filed Jan. 11, 2000, now U.S. Pat. No. 6,446,693, which is related and claims priority to U.S. Provisional Application No. 60/115,393, filed Jan. 11, 1999, and entitled "Window Blind with Motorized Tilt Control"; Ser. No. 60/126,104, filed Mar. 25, 1999, and entitled "Motorized Blind"; and Ser. No. 60/138,743, filed Jun. 11, 1999, and entitled "Headrail Including a Detachable Battery Holder for Powered Coverings for Architectural Openings." The present application is also related to U.S. application Ser. No. 09/481,237, filed Jan. 11, 2000, and entitled "Headrail Including a Detachable Battery Holder for Powered Coverings for Architectural Openings"; 09/480,913, filed Jan. 11, 2000, and entitled "Headrail Including a Trap Door for Accessing Batteries for Powered Coverings for Architectural Openings"; Ser. No. 09/480,912, filed Jan. 11, 2000, and entitled "System for Holding Batteries in a Headrail for Powered Coverings for Architectural Openings"; and Ser. No. 09/481,746, filed Jan. 11, 2000, and entitled "Fiber Optic Cable, Signal-Receiving System." Each of these related applications (namely, the '307, '393, '104, '743, '237, '913, '912, and '746 applications) is hereby incorporated by reference as though fully set forth herein.

BACKGROUND OF THE INVENTION a. Field of the Invention

The instant invention is directed toward a headrail and control system for powered coverings for architectural openings. More specifically, it relates to a headrail and control system for a motorized adjustable covering for an architectural opening.

b. Background Art

It is well known to use adjustable coverings over architectural openings. Such adjustable coverings include cellular panels, Venetian blinds, and many other mechanisms for controlling the passage of light, vision, or air through the architectural openings. For example, cellular panels and Venetian blinds may be adjusted by retracting or extending them, and Venetian blinds may be adjusted by tilting the slats comprising part of the blind. Depending upon the specific type of mechanism, other adjustments are possible.

It is also known in the art to power these adjustable coverings. For example, electric motors may be used in connection with the adjustable coverings to facilitate retracting the coverings or otherwise adjusting the coverings to control the amount of light, vision, or air that may pass through the coverings. It is also known in the art to use battery-powered electric motors, particularly in applications where access to an electrical outlet or other electrical wiring may not exist. When an adjustable covering is battery powered, it is challenging to design an aesthetically pleasing system wherein the battery or batteries are convenient to the electric actuators they power. To design an attractive battery-powered adjustable covering, it is preferable that the battery or batteries are located within the headrail and thereby hidden from view. Placing the battery or batteries within the headrail, however, can make it difficult to change the batteries as they become depleted.

In applications where access to the architectural covering may be limited, remote controls have been successfully used to operate the electric motors that allow a user to selectively configure the covering. For example, when adjustable coverings are used in connection with elevated architectural openings, it may be quite inconvenient to manually change the configuration of the coverings. Heretofore systems used to receive electromagnetic remote-control signals, e.g., infrared or visible signals, have been obtrusive and at times unreliable. Thus, there remains a need for a more reliable, compact, and unobtrusive system for receiving signals transmitted from a remote-control device.

In addition, known tilt control systems are often ill-suited for use in a motorized adjustable covering. Generally, a covering is adjusted by the connection of control cords to a drum that is rotatably fixed to a control shaft. For example, the slats of a Venetian blind are usually tilted via connection to a tilt roll (or drum) onto which the ladder laces of the Venetian blind are wound as the tilt rod is rotated. The ladder laces are wound onto the tilt drum, which has a significantly larger diameter than the tilt rod. That large diameter creates a relatively long moment arm and increased torque on the mechanism used to drive the rotation of the tilt rod. The increased torque requires a more powerful motor to turn the tilt rod.

Moreover, these known control systems are often difficult to assemble and/or manufacture. For example, the tilt drum generally fits tightly onto the tilt rod so that it rotates in unison with the tilt rod. As such, the tilt rod and tilt drum must be manufactured to relatively tight tolerances. Otherwise, the tilt drum can be too tight to slide easily onto the tilt rod or too loose to operate properly. Moreover, the connections of the ladder laces to the tilt drum are often tedious and time-consuming.

Finally, known tilt control systems require separate clutching mechanisms to prevent the over-winding of the control cord onto the tilt drum. For example, a motorized tilt control system for a Venetian blind must include some mechanism to prevent the tilt rod from further winding and unwinding the ladder cords after the slats are fully tilted. Otherwise, the winding of the ladder cords will actually lift the entire covering towards the headrail and can cause damage to the covering, the headrail, and the motor used to drive the tilt rod. Known clutching systems are often expensive and require separate mechanisms apart from those used to accomplish the tilting of the slats. Thus, there remains a need for a control system that can be advantageously used with a motorized adjustable covering, facilitates easy installation and manufacture, and does not require a separate clutching mechanism.

SUMMARY OF THE INVENTION

The headrail of the present invention has been designed such that a battery or batteries are conveniently held within a headrail housing along with a signal receiver and a battery-powered motor or other actuator used to adjust the configuration of a covering for an architectural opening. The present headrail also includes improved hardware for mounting the motor and, in the case of coverings comprising tiltable elements, improved hardware for mounting a tilt rod. Additionally, in the case of coverings comprising tiltable elements, the invention includes improved hardware for adjustably attaching the tiltable elements to the tilt rod in a manner that prevents over rotation of the elements.

In one form of the present invention, the headrail has been designed such that the battery or batteries for are conveniently hidden within the headrail and accessible for removal and replacement. A battery magazine is attached, preferably removably, within the interior of the housing. A pair of magazine end caps are attached to the ends of the battery magazine. These end caps may have tabs extending from their bottom edges. The tabs are inserted into corresponding tab slots formed in the housing. Further, each magazine end cap may comprise a first attachment ear and a second attachment ear. Attachment screws pass through though these attachment ears and screw into battery magazine screw channels to attach the end caps to the battery magazine.

In another form of the invention, the battery magazine comprises a front leg and a rear leg. These front and rear legs of the battery magazine are supported on a bottom wall of the housing. In yet another form of the invention, the housing comprises a front wall, a rear wall, and a portion extending into the interior of the housing from either the front wall or the rear wall. This extending portion interacts with a placement tang that comprises part of the battery magazine thereby helping to hold the battery magazine in position within the housing.

In yet another form of the invention, the bottom wall of housing has an opening in it through which one or more batteries may be loaded into or extracted from the battery magazine.

To conduct electricity from the batteries held by the battery magazine to the motor, the headrail further comprises conductive terminals attached to the magazine end caps by fasteners. A spring may be attached within the battery magazine to enhance electrical contact between the batteries and the conductive terminals. Finally, an electrical connector is connected between the conductive terminals and the actuator.

In still another form of the present invention, the battery magazine is attached within the interior of the housing such that at least a portion of the battery magazine is positioned above the opening in the bottom wall. A trap door is swingably associated with the bottom wall of the housing to selectably cover the opening for convenient access to the batteries in the battery magazine. The trap door may be swingably attached to the magazine by a battery bracket that includes at least one door mount. The at least one door mount engages a bracket retention channel comprising part of the trap door.

In another form of the invention, the battery bracket further includes at least one rail slidably connected to the battery magazine or the housing. In a preferred form, the battery bracket has two rails that are joined on one of their ends by a cross-over section and are slidably engaged in corresponding rail guide channels formed in the battery magazine. The other ends of the rails jog inwardly, forming a pair of door mounts. These door mounts engage the bracket retention channel comprising part of the trap door.

In yet another form, the trap door itself further comprises a first longitudinal end and a second longitudinal end. The bracket retention channel is adjacent the first longitudinal end. At least one protrusion extends from the second longitudinal end of the trap door. This protrusion interacts with the bottom wall of the housing to hold the trap door closed after it has been pivoted against the bottom wall of the housing to selectively cover the opening. The protrusion may include a sloped surface that helps it snap into the opening in the bottom wall of the housing. It is also beneficial for the trap door to include a handle adjacent the protrusion.

In still another form, the present invention has been designed such that the battery or batteries for the powered adjustable covering for the architectural opening are conveniently hidden within the headrail housing and accessible for removal and replacement. The invention preferably comprises a battery carrier and a battery carrier housing. The battery carrier and the battery carrier housing cooperate through an elongated opening in a bottom wall of the headrail housing. Once the batteries are placed in the battery carrier, the battery carrier is slid through the elongated opening, and the battery carrier is then retained by the battery carrier housing mounted above the elongated opening.

In another form of present invention, the system for holding the plurality of batteries in the headrail housing includes an elongated opening through a bottom wall of the headrail housing, a battery carrier housing, and a battery carrier. The battery carrier housing is mounted to the headrail housing, above the elongated opening. The battery carrier is thus substantially or fully contained within the headrail housing. The battery carrier includes a plurality of battery ports, one for each battery, into which the batteries are loaded. After the batteries are loaded, the battery carrier is then slidably mounted in the battery carrier housing. In a preferred form of the present invention, the battery carrier housing is removably mounted to the headrail housing, and the battery carrier is removably mounted to the battery carrier housing.

In yet another form of the invention, the system for holding the plurality of batteries in the headrail housing further includes a flange extending from a bottom edge of the front wall. A ledge extends rearwardly from the flange. The battery carrier has a lower edge with a discontinuous or continuous retention foot along it. When the battery carrier is fully installed in the battery carrier housing, the retention foot rides on the ledge.

The headrail of the present invention may also include a signal-receiving system adapted to be removably connected to the headrail housing. The signal-receiving system includes receiver electronics, a receiver holder that supports the receiver electronics and that is adapted to be removably affixed within the headrail housing, and a signal receiver operatively connected to the receiver electronics. The present invention has been designed such that the large components of the system may be hidden within the headrail housing while a small, unobtrusive signal receiver for actually receiving the remote-control signal and directing it toward the hidden large components projects from an edge of the headrail housing, valance, or over treatment for the motorized covering.

In a first preferred form, the signal receiver comprises a signal refractor that bends the remote-control signals toward a collector hidden within the headrail housing. In an alternative preferred form, the signal receiver comprises a remote eye that positions the collector for direct receipt of the remote-control signals. Fiber optic cable is operatively associated with the collector in both preferred forms. Also, the signal refractor or the remote eye preferably is mounted adjacent to a lowest edge of a headrail, valance, or over treatment for the window covering. The remote-control transmitting device thus generates signals that impinge upon the signal refractor or upon the collector of the remote eye, and which are subsequently transmitted via fiber optic cable to receiver electronics hidden within the headrail housing for further processing and interpretation. The signal-receiving system of the present invention thus permits the bulk of the system components to be hidden from view. The relatively small signal receiver of the system is the only clearly visible component from exteriorly of the headrail.

In a preferred form, the receiver holder, which may include a receiver holder base and a receiver holder cover, comprises at least one brace adapted to position the receiver holder within the headrail housing. In particular, the headrail housing may have a rear wall with a distal edge, and the brace may comprise a free end adapted to interact with the distal edge of the rear wall to snappingly position the receiver holder within the headrail housing. The receiver holder base and cover each has longitudinal ends. A pair of cover anchors may extend from the longitudinal ends of the receiver holder base, and a corresponding pair of catches may extend downwardly from the longitudinal ends of the receiver holder cover such that when the receiver holder cover is pressed into position on the receiver holder base, the catches snap past the cover anchors to removably secure the receiver holder cover to the receiver holder base. The receiver holder base may further comprise a bottom surface having a scoop extending therefrom.

When the signal receiver comprises a signal refractor, the signal refractor may have a first surface at its lower end. In a preferred form, when the signal refractor is in an operational position, the first surface is sloped relative to the horizontal. Preferably, the first surface forms an angle of approximately 45° with the horizontal when the signal refractor is in the operational position. The signal refractor may also have a front surface that may be sloped relative to the vertical when the signal refractor is in the operational position. In yet another preferred form, the signal refractor includes a substantially horizontal channel into which an inwardly directed substantially horizontal ledge extending from the lowest edge of the front wall of the headrail housing is disengageably received.

When the signal receiver comprises a remote eye, it may be removably affixed to the valance or over-treatment designed to substantially concealing the headrail housing. In a preferred form, the remote eye comprises a housing with a collector positioned therein. In particular, the housing may comprise an upper half and a lower half, and the collector may extend outwardly through an opening in the lower half of the housing. There may be a rib formed on the exterior of the remote eye housing that cooperates with a generally U-shaped clamp or clip to removably attach the remote eye to a mounting surface (e.g., to a valance or over-treatment). For example, the clip may include an inner surface having a plurality of gripping ridges formed thereon to removably hold the remote eye to an over-treatment. A retention nub and flexible brace may comprise part of the clip to help releasably support the remote eye.

The headrail of the present invention may also include a system for mounting the motor within the headrail housing. The motor-mounting system may include a motor mount having a first leg, a second leg, a cross-over section joining the first leg and the second leg, and at least one indented shoulder associated with at least on of the first and second legs. In a first form of the motor mount, the cross-over section is substantially horizontal and has first and second longitudinal ends, the first leg is substantially vertical and extends downwardly from the first longitudinal end of the cross-over section, and the second leg is substantially vertical and extends downwardly from the second longitudinal end of the cross-over section. In this first form, the at least one indented shoulder comprises a first indented shoulder formed at a point where the first leg joins the first longitudinal end of the cross-over section, and a second indented shoulder formed at a point where the second leg joins the second longitudinal end of the cross-over section.

In a second form of the motor mount, the cross-over section is substantially vertical and has upper and lower lateral edges. The first leg is substantially horizontal and extends from the upper lateral edge of the cross-over section, and the second leg is substantially horizontal and extends from the lower lateral edge of the cross-over section. In this second form, the at least one indented shoulder comprises a first indented shoulder formed at a first lateral edge of the first leg, and a second indented shoulder formed at a second lateral edge of the first leg.

The motor-mounting system comprising part of the headrail of the present invention may also include a rigid motor mount at least partially surrounding the motor mount. This rigid motor mount may further comprise a substantially horizontal deck having first and second lateral edges; a first substantially vertical inner wall integrally joined with the first lateral edge of the deck; a second substantially vertical inner wall integrally joined with the second lateral edge of the deck; a first sloped outer wall integrally joined with the first substantially vertical inner wall, and extending outwardly and upwardly therefrom; and a second sloped outer wall integrally joined with the second substantially vertical inner wall, and extending outwardly and upwardly therefrom. A substantially-horizontal shelf may be formed at a distal end of each of the first and second sloped outer walls. A longitudinally-extending and inwardly-directed retention ledge may also be formed along a top edge of each of the fist and second substantially vertical inner wall to help hold the motor mount within the rigid motor mount.

The present invention also includes an apparatus, system, and method to permit easy assembly of a control system for the adjustable covering that is particularly well-suited for use with a motorized tilt control system. In its preferred embodiment, the present invention provides an inexpensive and effective clutch to prevent over-winding of the control cords onto a control shaft while minimizing torque on the motor or other mechanism used to drive the control shaft.

In one embodiment, the present invention comprises a control disk for use in conjunction with a rotatable control shaft of an adjustable covering for an architectural opening. The adjustable covering is controlled by at least a first cord, and at least some of the first cord winds onto the control shaft when the control shaft is rotated in a first direction, and unwinds from the control shaft as the control shaft rotates in a second direction. The control disk comprises (1) a disk body adapted to be mounted on the control shaft having a diameter substantially in excess of the shaft, and (2) at least a first cord connector, mounted on the disk body, for anchoring an end of the first cord to the disk body. In a preferred embodiment, the disk body is not rotatably fixed to the control shaft and operates as an elegant, inexpensive clutch to prevent the over-winding of the first cord onto the control shaft.

In another embodiment, the present invention comprises a control system for an adjustable covering for an architectural opening. The system comprises: (1) a control shaft rotatable about a longitudinal axis of rotation; (2) at least a first cord, connected to the adjustable covering and adapted to control the adjustable covering by wrapping onto, and unwrapping from, the control shaft as the control shaft rotates; and (3) at least a first control disk. The control disk preferably includes a disk body mounted on the control shaft and having a diameter substantially in excess of the control shaft and at least a first cord connector adapted to anchor the first cord to the disk body. Moreover, in a preferred embodiment, the disk body is not rotatably fixed to the control shaft.

In still another embodiment, the present invention comprises a method for assembling a control system for an architectural opening. Preferably, the adjustable covering (once assembled) is controlled by at least a first cord, at least some of the first cord winding onto a control shaft when the control shaft is rotated in a first direction and unwinding from the control shaft as the control shaft rotates in a second direction. The method comprising the steps of: (1) mounting a control disk onto a control shaft; (2) anchoring an end of the fist cord to the control disk; and (3) rotating the control disk relative to the control shaft to wrap the first cord at least partially around the control shaft.

Other aspects, features, and details of the present invention will be apparent from reading the following description and claims, and from reviewing the accompanying drawings.

DESCRIPTION OF THE PREFERRED EMBODIMENTS

Figure 1:
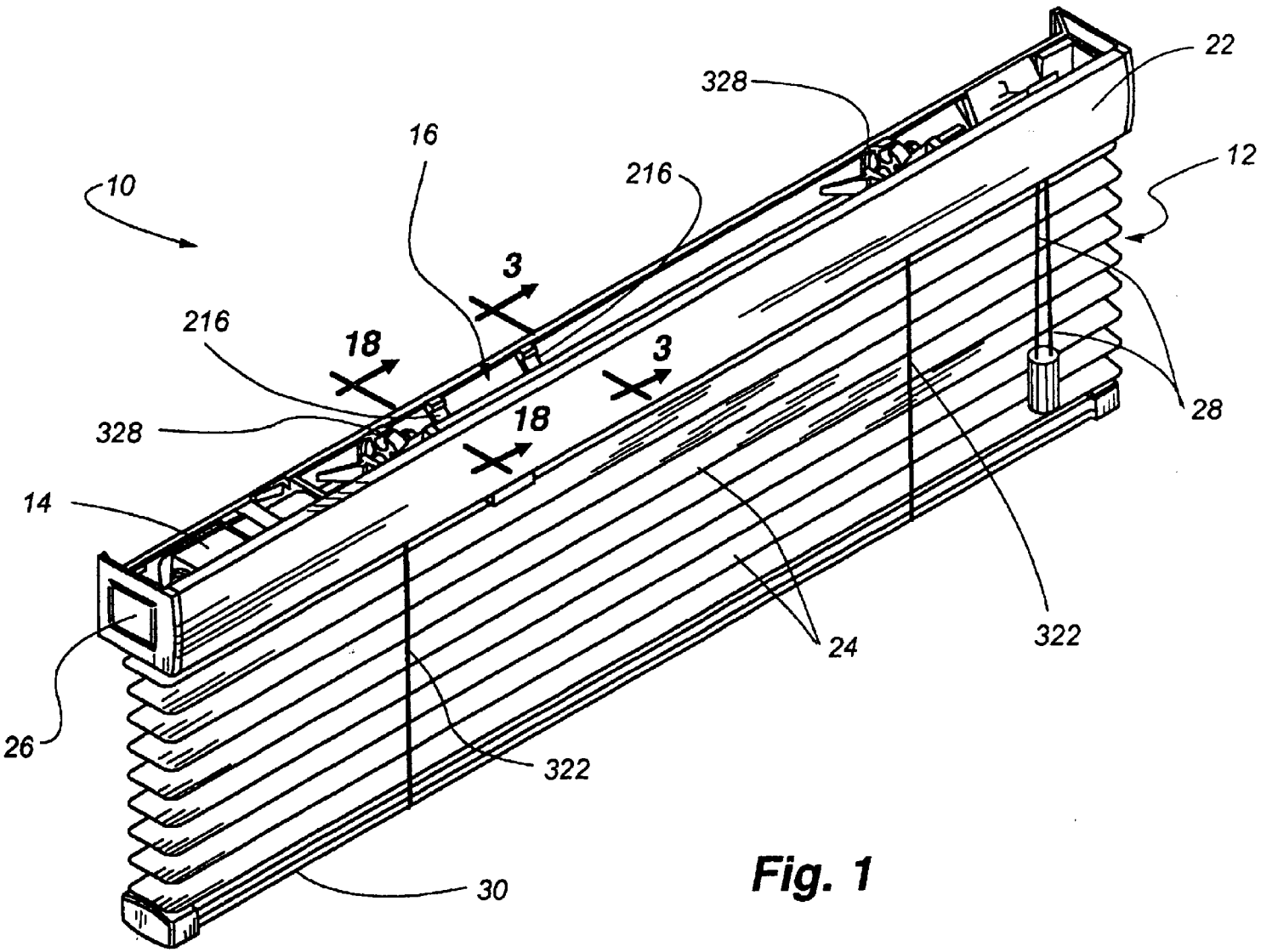
FIG. 1 is an isometric view showing the front, top, and left end of a headrail having an extruded housing, an adjustable covering, and a bottom rail for an architectural opening.

The present invention concerns a headrail 10 for a battery-powered adjustable covering 12 for an architectural opening (not shown). An advantage of the instant invention over the prior art is that an electric motor 14, a signal-receiving system 16, a battery holder 18, hardware for pivotally mounting a tilt rod 20, and additional hardware for interconnecting these elements are all mounted within a headrail housing 22. Although these elements are mounted within the headrail housing 22 and thereby hidden from view, they remain easily accessible without completely disassembling the headrail 10. Depending upon the configuration of the headrail housing 22 desired for a particular application (for example, a low-profile housing or a larger-profile housing) and the size of the covering 12, an appropriate combination of elements is selected. As described in further detail below, several of these elements conveniently and removably snap into position within the selected headrail housing 22 to facilitate transfer of electrical energy from one or more batteries to one or more electrical devices for adjusting the configuration of the covering 12.

Figure 2:
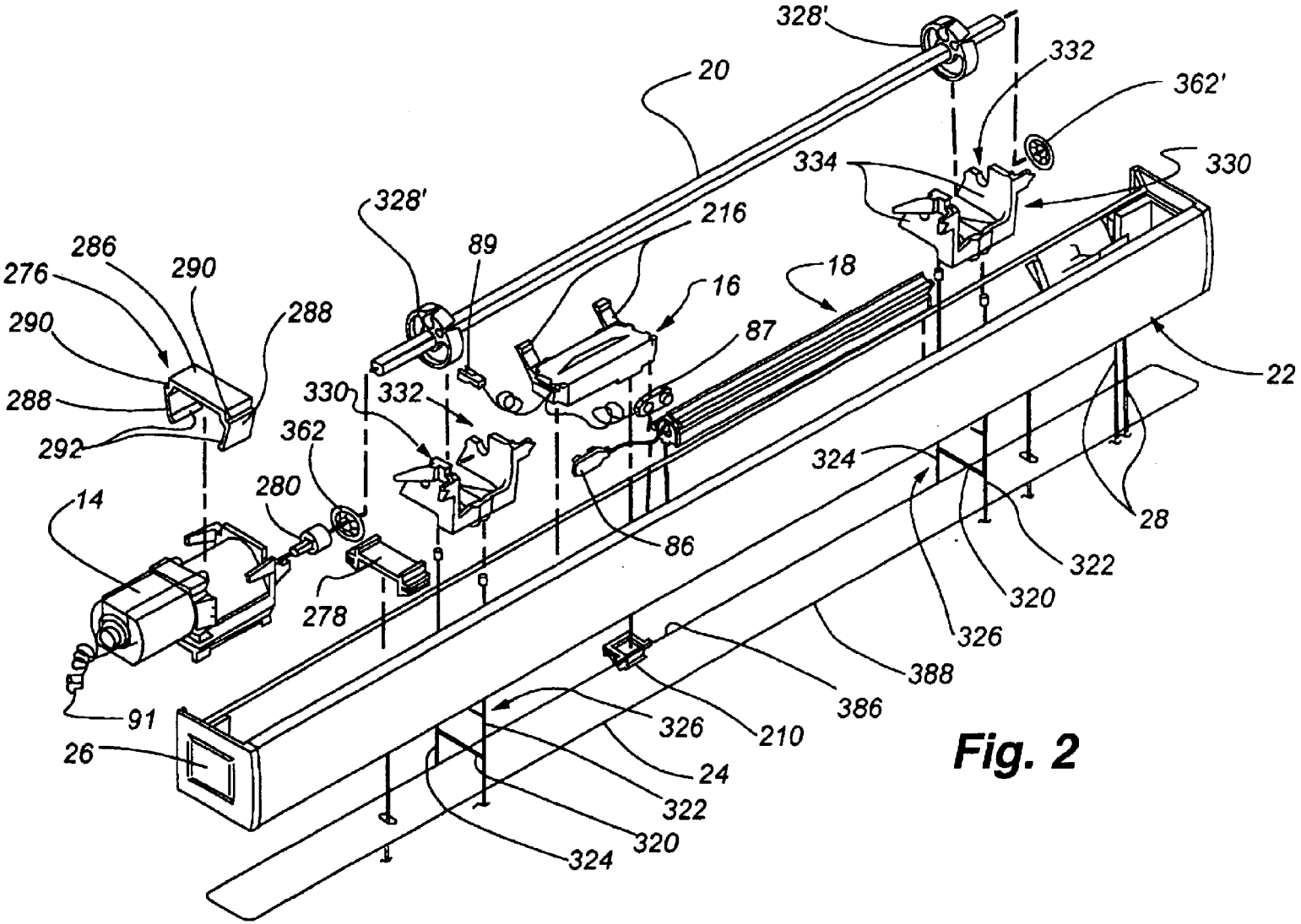
FIG. 2 is a fragmentary, exploded view of the headrail and adjustable covering depicted in FIG. 1.

Referring first to FIGS. 1 and 2, isometric views of the front, top, and left end of a headrail 10 and an adjustable covering 12 for an architectural opening are shown. Although the adjustable covering 12 depicted in FIGS. 1 and 2 is a Venetian blind comprising a plurality of slats 24, for purposes of the instant invention, the covering 12 need not be a Venetian Blind. FIGS. 1 and 2, therefore, provides a context for describing the present invention. In the Venetian blind covering 12, a battery-powered motor 14 within the headrail 10 may be used, for example, to regulate the passage of air, light, or vision through the substantially horizontal slats 24 of the covering 12 by tilting or rotating the slats 24 about their longitudinal axes a desired amount. In Venetian and other types of coverings 12, the battery-powered motor 14 may retract or extend the covering 12. As depicted, the headrail 10 has a left end cap 26 attached thereto. Also shown in FIGS. 1 and 2 are cords 28 for manually operating the adjustable covering 12, and a bottom rail 30 attached at the bottom of the covering 12.

Battery Holders

FIGS. 3–7 related to a first type of battery holder 18 that may be used in conjunction with the headrail 10 of the present invention. As discussed further below, in this first type of battery holder 18, a battery magazine 32 is mounted within the headrail housing 22, and batteries 34 (FIGS. 5–7) are inserted into and removed from the magazine 32 through a battery-shaped opening 36 (FIG. 4) in a bottom wall 38 of the headrail housing 22. U.S. application Ser. No. 09/481,237, filed Jan. 11, 2000, the disclosure of which has been incorporated herein by reference, discloses additional battery holders of this first type.

Figures 3, 4, 5, 6:
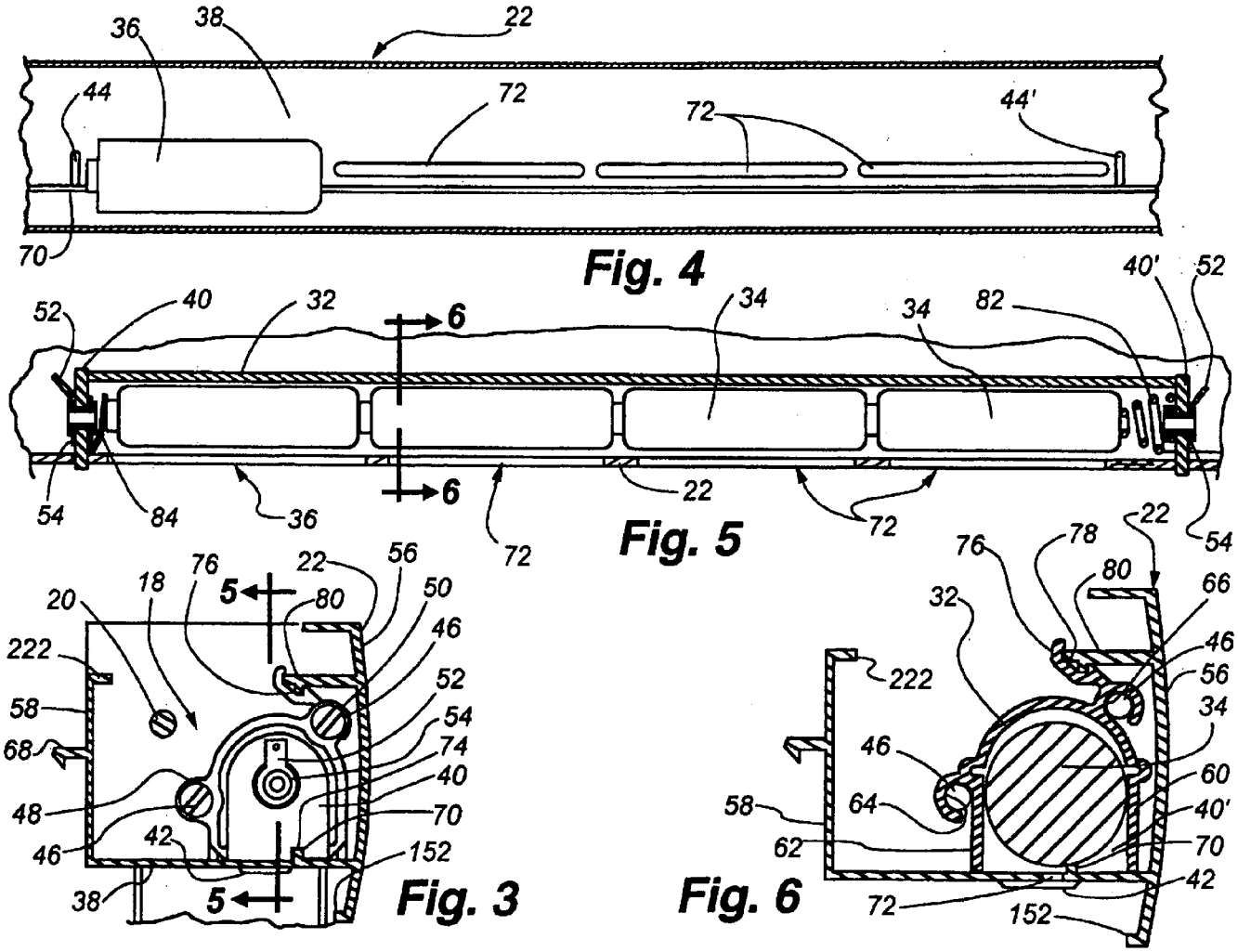
FIG. 3 is a cross-sectional view along line 3—3 of FIG. 1, depicting a preferred embodiment of the headrail according to the present invention, adjacent to an end of one possible type of battery holder that may be positioned within the headrail.
FIG. 4 is a fragmentary cross-sectional top plan view depicting the inside of the housing, in the region below the batteries, according to the preferred embodiment depicted in FIG. 3.
FIG. 5 is a fragmentary cross-sectional view along line 5—5 of FIG. 3, depicting the batteries in place in a fully installed battery magazine according to one preferred embodiment.
FIG. 6 is a cross-sectional view of the headrail along line 6—6 of FIG. 5, depicting the battery magazine securing batteries in position within the headrail housing.

FIG. 3 is a cross-sectional view along line 3–3 of FIG. 1, taken adjacent to and just outside of an end of the battery holder 18 (FIG. 2) shown mounted in a first preferred embodiment of the headrail housing 22. The tilt rod 20 (FIG. 2), which would be used to adjust the configuration of the covering 12, is shown schematically in FIG. 3. It is possible to see a first magazine end cap 40, which, as described more fully below, has a tab 42. This tab 42 snaps into a first tab slot 44 (see, e.g., FIG. 4, which clearly shows the first tab slot 44) to position and hold the battery magazine 32 (depicted to good advantage in, for example, FIG. 7) within the headrail 10. Also depicted in FIG. 3 are two screws 46, which attach the first magazine end cap 40 to the magazine 32 via a first attachment ear 48 and a second attachment ear 50. The attachment ears 48, 50 are shown to good advantage in FIG. 7. In the preferred embodiment, both of these attachment ears 48, 50 are integrally formed as part of the first magazine end cap 40. Also depicted in FIG. 2 is an electrical terminal 52, which is connected to the first magazine end cap 40 by a fastener 54 (e.g., a rivet). Further details concerning these features are described further below.

The headrail housing 22 comprises a front wall 56, a rear wall 58, and a bottom wall 38. The front wall 56 of the housing 22 and possibly the bottom wall 38 of the housing 22 are visible when the adjustable covering 12 is installed and operational. Thus, the front wall 56 of the housing 22 may have a decorative shape. Similarly, since the bottom wall 38 may be visible, it too may have a decorative shape.

Figure 7:
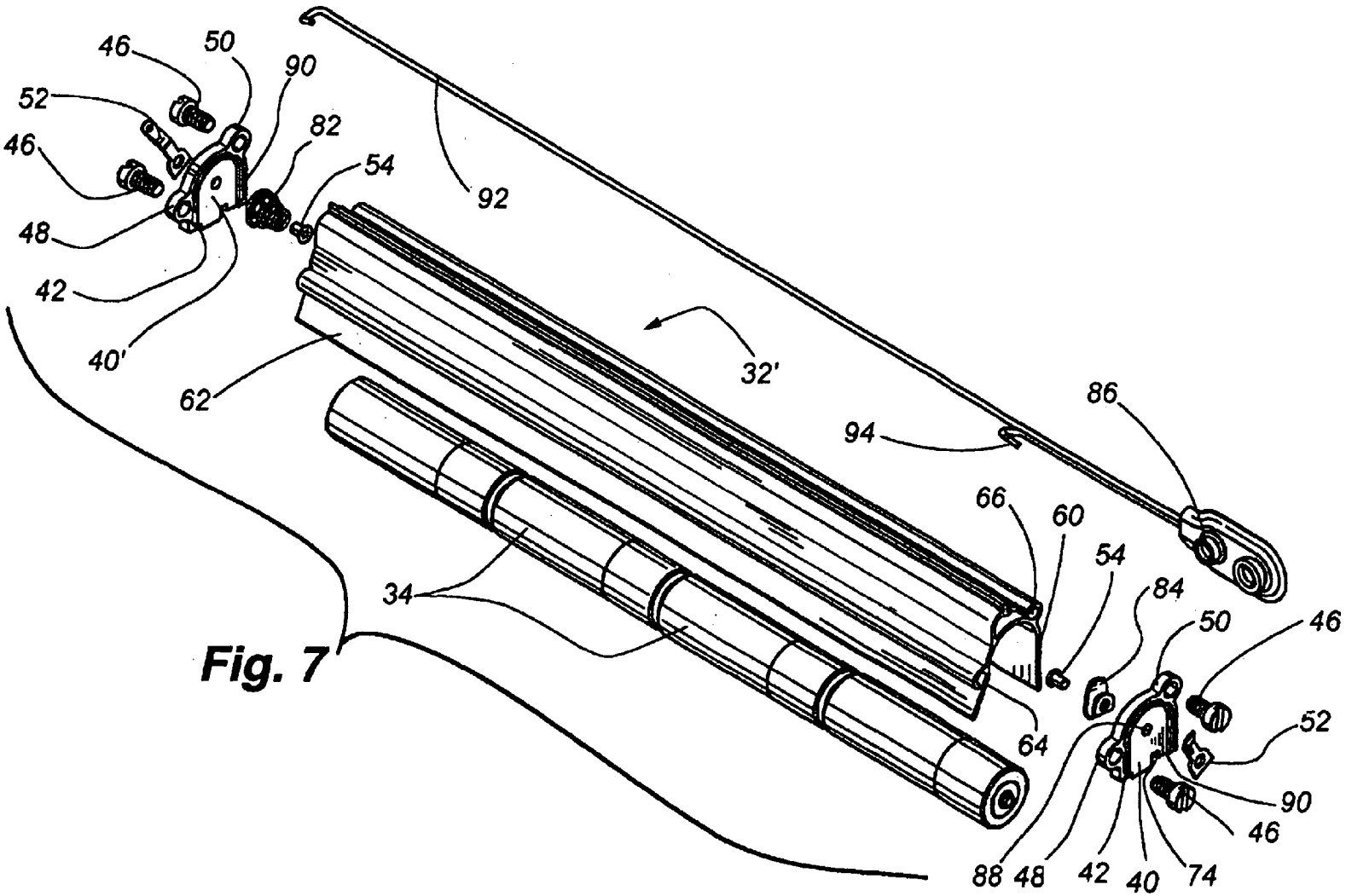
FIG. 7 is an exploded isometric view of a preferred embodiment of the battery magazine and various components used to facilitate transfer of electrical energy from the batteries to a connector.

Referring now to FIGS. 6 and 7, further details of the magazine 32 are next described. The magazine 32 comprises a front leg 60 and a rear leg 62. A first screw channel 64 is integrally formed as part of the rear leg 62 of the magazine 32. The screw channel 64 may be clearly seen in FIG. 7. A similar second screw channel 66 is integrally formed in the magazine 32 at an upper portion of the front leg 60. Again, this screw channel 66 is visible in, for example, FIG. 7. These screw channels 64, 66 are molded so that their inside diameter is slightly smaller than the outside diameter of the screws 46 which hold the magazine end caps 40, 40' in position. Thus, when the screws 46 are inserted through the magazine end caps 40, 40' and threaded into the screw channels 64, 66, the threads on the screws 46 are able to bind in the interior surface of the screw channels 64, 66 and thus hold the magazine end caps 40, 40' in position. As discussed further below, in the preferred embodiment shown, the magazine end caps 40, 40' are interchangeable.

In FIG. 3, the tilt rod 20 is shown schematically for context. Also clearly visible in FIG. 3 is the first magazine end cap 40 with its tab 42 in position in the tab slot 44 (see FIG. 4 to view this tab slot 44) of the housing 22. The first magazine end cap 40 is held in position by a pair of screws 46, which are clearly visible in FIG. 3. The terminal 52 attached to the first magazine end cap 40 by the fastener 54 is also shown in FIG. 3.

As shown to the best advantage in FIG. 3, the front wall 56 of the housing 22 in this preferred embodiment is arcuate. The rear wall 58 of the housing 22 according to this preferred embodiment has a projection 68 extending therefrom. The bottom wall 38 of the housing 22 has a longitudinally extending rib 70 integrally formed as part thereof. This rib 70 may be clearly seen, for example, in FIG. 4. In FIG. 4, the rib 70 is shown as extending from left to right across the figure. Also clearly visible in FIG. 4 are the tab slots 44, 44', the battery-shaped opening 36, and three elongated openings 72. The battery-shaped opening 36 and the elongated openings 72 are discussed further below.

As most clearly shown in FIGS. 3 and 7, the magazine end caps 40, 40' include a notch 74. When the housing 22 is formed according to the depicted preferred embodiment of the instant invention, the notch 74 in the magazine end caps 40, 40' rides on the rib 70 comprising part of the housing 22. Thus, when the magazine end caps 40, 40' are in position, and the magazine 32 is in position within the housing 22, the tabs 42 on the magazine end caps 40, 40' lock into the tab slots 44, 44' in the bottom wall 38 of the housing 22, and the rib 70 comprising part of the bottom wall 38 of the housing 22 is retained by the notch 74 in the magazine end caps 40, 40'. The tabs 42 interacting with the tab slots 44, 44' and the rib 70 interacting with the notches 74 on the magazine end caps 40, 40' both help to hold the magazine 32 in position within the housing 22.

As shown in FIG. 6, a placement tang 76 comprises a portion of the magazine 32. This placement tang 76 is an integrally formed portion of the magazine 32 and extends from the material forming the upper screw channel 66. When the magazine 32 is in position within the housing 22, a free end 78 of a portion 80 of the housing 22 engages the placement tang 76 as shown to the best advantage in FIGS. 3 and 6. This interaction between the placement tang 76 and the portion 80 of the housing 22 extending from the front wall 56 also helps to hold the magazine 32 in position within the housing 22.

The specific cross-sectional shape of the magazine 32 may vary somewhat from the preferred embodiment shown and described above. An important feature in this invention is the interaction between the housing 22 and the magazine 32 whereby the magazine 32 is removably held in position within the housing 22. In the preferred embodiments, tabs 42 projecting from the magazine end caps 40, 40' snap into tab slots 44, 44' in the housing 22. Also, a portion 80 of the housing 22 interacts with a placement tang 76 on the magazine 32 to help hold the magazine 32 in position within the housing 22. Although the referenced portion 80 of the housing 22 projects from the front wall 56 of the housing 22 in each of the preferred embodiments, it could also project from any other wall of the housing 22 without departing from the present invention.

The elongated openings 72 (FIGS. 4 and 5), which are formed in the bottom wall 38 of the housing 22 in the preferred embodiment, are positioned approximately below all but one of the batteries 34 and are useful for several purposes. For example, heat may be dissipated through these elongated openings 72 if the temperature within the headrail 10 increases during operation. Further, since it is possible to view the outside surface of the bottom wall 38 of the housing 22 when the adjustable window covering 12 is mounted for operation, these elongated openings 72 permit a quick check that the required batteries 34 are in position within the headrail 10 since a portion of each battery 34 will be visible through an elongated opening 72. Finally, the elongated openings 72 facilitate battery extraction as described next.

The battery-shaped opening 36 in the bottom wall 38 of the housing 22 permits one or more batteries 34 to be inserted into or extracted from the chamber formed between the battery magazine 32 and the bottom wall 38. In the preferred embodiments, the battery-shaped opening 36 is slightly wider than the diameter of a AA battery and slightly shorter than a AA battery so that AA batteries 34 can be inserted into the battery magazine 32 through the battery-shaped opening 36 at an angle and can then be pushed lengthwise into the magazine 32. Since the battery-shaped opening 36 is shorter than a battery 34, and since the spring 82 (FIGS. 5 and 7) exerts a longitudinal force on the batteries 34, the endmost battery will not fall out of the battery-shaped opening 36 accidentally. When it is time to extract the batteries 34 from the battery magazine 32, a person may use a thin screwdriver to extract the first battery from the battery magazine 32 through the battery-shaped opening 36. Then, the person can insert the screwdriver into the respective elongated openings 72 to push the batteries 34 toward the battery-shaped opening 36, where they may be readily removed.

FIG. 5 is a partial cross-sectional view along line 5—5 of FIG. 3, and depicts four batteries 34 in position in the magazine 32. Both magazine end caps 40, 40' are in place and the magazine 32 is not only fully assembled, but also clipped into position in the housing 22 of the headrail 10. Also clearly visible in FIG. 5 is a flexible contact strip 84, which is connected to the interior surface of the first magazine end cap 40 by the fastener 54. Thus, the fastener 54 secures both the terminal 52 to the exterior surface of the first magazine end cap 40, and the contact strip 84 to the interior surface of the first magazine end cap 40 to form a conductive path from the batteries 34 to the terminal 52. FIG. 6 is a cross-sectional view along line 6—6 of FIG. 5. Clearly visible in FIG. 6 is a battery 34 being held in position by the magazine 32. Visible in both FIGS. 5 and 6 are the elongated openings 72 positioned approximately below each battery 34 in the magazine 32. Visible in FIG. 5 is the battery-shaped opening 36.

FIG. 7 shows a magazine 32' that is slightly different from the magazine 32 shown in, for example, FIGS. 3 and 6. As fully described in the above-referenced U.S. application Ser. No. 09/481,237, filed Jan. 11, 2000, this embodiment of the magazine 32' works best in the roll-formed headrail housing 22' shown in FIGS. 18 and 20, which is different from the extruded headrail housing 22 shown in, for example, FIGS. 3 and 6. Assembly of either magazine 32, 32' design with the various depicted components attached thereto does not, however, vary substantially. Thus, referring now to FIG. 7, assembly of the battery magazine 32' with the various components that facilitate transfer of electrical energy from the batteries 34 to a connector 86 is next described.

FIG. 7 is taken from the back side (once it is installed in the headrail 10) of the magazine 32'. The magazine 32' is preferably formed from a single piece of material. The length of the magazine 32' is easily adjusted by cutting an appropriate section of magazine material to accommodate a desired number of batteries 34. To assemble the magazine 32', the selected length of magazine material is first cut—the example shown in FIG. 7, the magazine length selected accommodates four AA batteries. Once the desired length of magazine material has been obtained, the remaining components that facilitate transfer of electrical energy from the batteries 34 to the connector 86 are assembled.

Referring first to the right-hand portion of FIG. 7, the fastener 54 (e.g., a rivet) is used to attach both the conductive terminal 52 and the flexible contact strip 84 to the first magazine end cap 40, which has a hole 88 therethrough for that purpose. Once the terminal 52 and the flexible contact strip 84 have been fastened to the first magazine end cap 40, the first magazine end cap 40 may be attached to the magazine 32'. As clearly shown in FIG. 7, in this preferred embodiment, the first magazine end cap 40 includes an alignment ridge 90 on each of its interior and exterior surfaces. There is an alignment ridge 90 on each side of the magazine end caps 40, 40' so that one design for the magazine end caps 40, 40' will work at either end of the magazine 32'. Thus, in the preferred embodiments, the first and second magazine end caps 40, 40' are interchangeable. The alignment ridge 90 fits along the inner surface of the magazine 32'. Once the alignment ridge 90 is thus placed along the inner surface of the magazine 32', the first and second attachment ears 48, 50, respectively, comprising part of the first magazine end cap 40 are properly positioned over the two screw channels 64, 66 integrally formed into the magazine 32'. The attachment screws 46 pass through the attachment ears 48, 50 of the magazine end cap 40 and are threaded into the screw channels 64, 66 of the magazine 32'. The flexible contact strip 84 and the fastener 54 conduct electricity to the terminal 52, where it may be further conducted via the connector 86 to a device requiring electrical power.

An alternative type of magazine end cap is discussed in the above-noted related U.S. application Ser. No. 09/480,913, filed Jan. 11, 2000 and below in connection with FIG. 13. These alternative magazine end caps 41, 41' (FIG. 13) do not include attachment ears 48, 50, and they do not have alignment ridges 90. Rather, the alternative magazine end caps 41, 41' just have holes 122 (FIG. 13) through them to accommodate the attachment screws 46, and, rather than alignment ridges 90, the magazine end caps 41, 41' have a plurality of alignment pins 124 on each side. These alternative magazine end caps 41, 41' are interchangeable with the end caps 40, 40'.

Referring now to the left-hand end of FIG. 7, which is the right-hand end of the magazine 32' as installed in the headrail 10 when viewed from the front of the headrail 10, assembly of the components attached to this end of the magazine 32' are described next. A fastener 54 (e.g., a rivet) is used to attach the spring 82 to an interior surface of the second magazine end cap 40' while simultaneously connecting a second terminal 52 to the exterior surface of the second magazine end cap 40'. This spring 82 will make electrical contact with the batteries 34 positioned by the magazine 32' and will thereby conduct electricity through the fastener 54 to the terminal 52 on the exterior surface of the second magazine end cap 40'.

Once the spring 82 and terminal 52 have been thus attached to the second magazine end cap 40' with an appropriate fastener 54, the second magazine end cap 40' is ready for attachment to the magazine 32'. As was the case with the opposite end of the magazine 32', one of the alignment ridges 90 (there is one on each side of the second magazine end cap 40' as there were on each side of the first magazine end cap 40) is aligned with the inner surface of the magazine 32' to appropriately position the magazine end cap 40' relative to the magazine 32'. Once the second magazine end cap 40' is appropriately positioned, the first attachment ear 48 and the second attachment ear 50 are aligned with appropriate screw channels 64, 66, respectively, comprising part of the magazine 32'. Once thus positioned, screws 46 are inserted through the attachment ears 48, 50 and threaded into the screw channels 64, 66 to secure the second magazine end cap 40' to the magazine 32'.

Figures 17, 18:
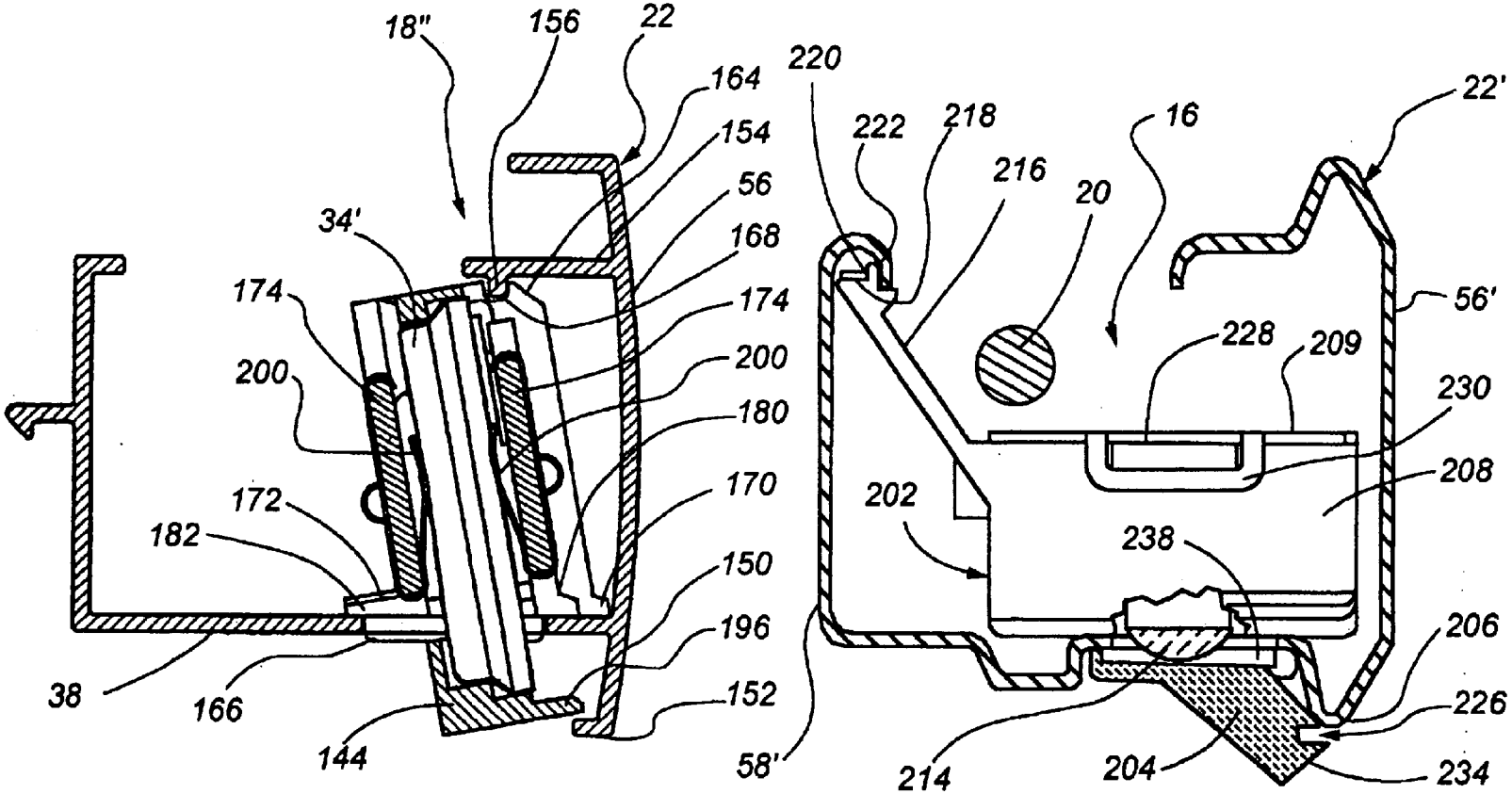
FIG. 17 is a cross-sectional view along line 17—17 of FIG. 14, depicting a battery in the battery carrier, and the battery carrier in position in the battery carrier housing.
FIG. 18 is a fragmentary, cross-sectional view depicting a signal receiving system according to the present invention mounted to a roll-formed headrail housing, with a portion of the receiver holder base broken away, and it is taken from the approximate position of line 18—18 of FIG. 1.
Figure 20:
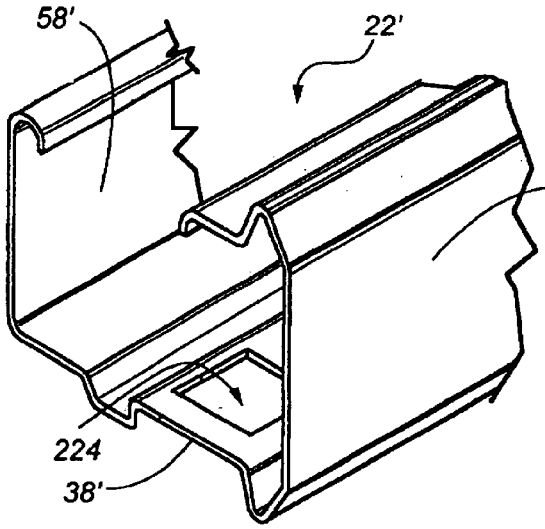
FIG. 20 is a fragmentary isometric view of a portion of the headrail housing also depicted in FIG. 18, revealing a port through a bottom wall of the headrail housing.

Next, the batteries 34 are optionally placed into the magazine 32', and the fully assembled magazine 32' is then inserted into the housing 22' (e.g., FIGS. 18 and 20). Although it would make it less convenient to replace expired batteries, it is possible to form the headrail housing without the battery-shaped opening 36 if desired. Without the battery-shaped opening 36, it would be necessary to place the batteries 34 in the magazine 32' before inserting it into the housing 22, since the batteries 34 could not otherwise be inserted into the magazine 32'. The magazine 32' is held in position within the housing 22 as described above. Then, the electrical connector 86 depicted in FIG. 7 would be connected to the terminals 52 (one on each end of the magazine 32') in a known manner. Additionally, any type of connector that is appropriate for the device that needs electricity could be attached to the negative lead 92 and positive lead 94 of the connector 86. Referring to FIG. 2, once the battery holder 18 is mounted in the headrail housing, the connector 86 is attached to a corresponding connector 87 to power receiver electronics 232 (FIG. 19) discussed further below. An additional connector 89 operatively connected to the receiver electronics 232 transfers control signals and power to the motor 14 via a cooperating connector 91 wired to the motor 14.

FIGS. 8–13 related to a second type of battery holder 18' that may be used in conjunction with the headrail 10 of the present invention. As discussed further below, in this second type of battery holder 18', the battery magazine 32 is again mounted within the headrail 10, but batteries 34 are inserted into and removed from the magazine 32 through a trap door 96 that selectively covers a large opening 98 in the bottom wall 38 of the headrail housing 22. The trap door 96 works in combination with a battery bracket 100 to permit easy removal and installation of batteries 34 from and into the headrail 10. U.S. application Ser. No. 09/480,913, filed Jan. 11, 2000, the disclosure of which has been incorporated herein by reference, discloses additional details about battery holders 18' of this second type.

Figure 8:
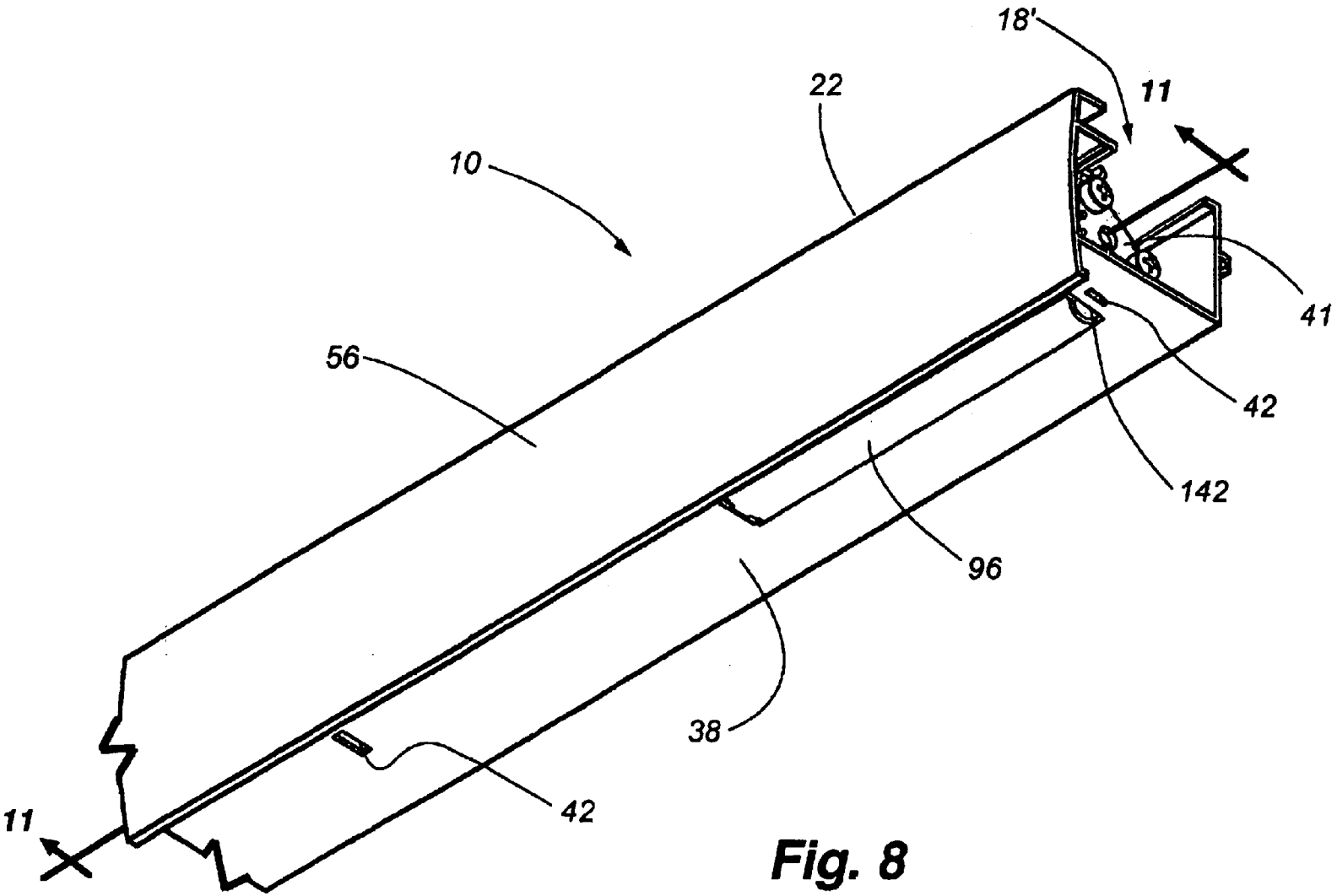
FIG. 8 is a fragmentary isometric view of the front, bottom, and right end of the headrail housing having a second type of battery holder mounted therein.
Figure 9:
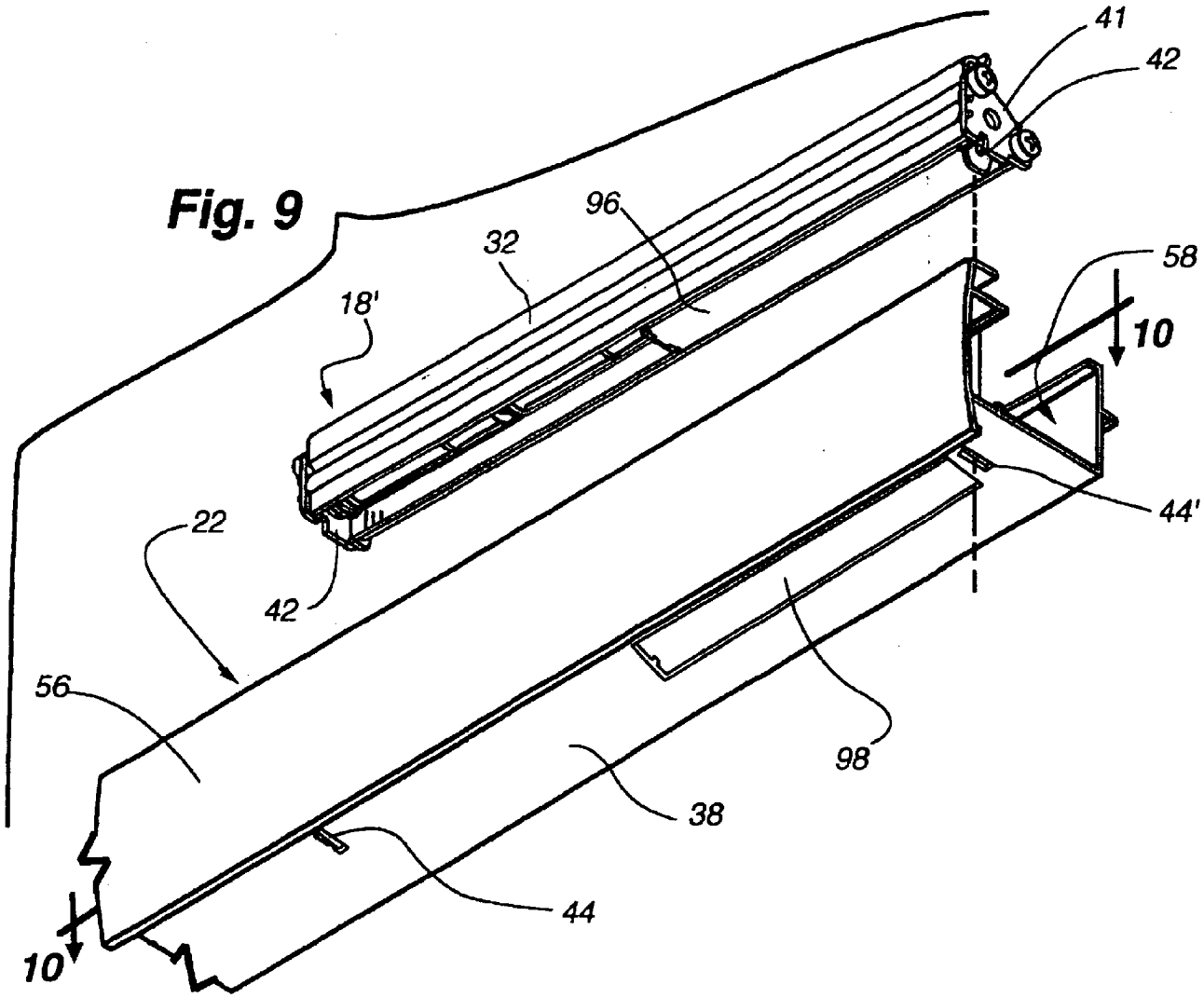
FIG. 9 is an exploded fragmentary isometric view of the housing and battery holder depicted in FIG. 8.
Figures 10, 11, 12:
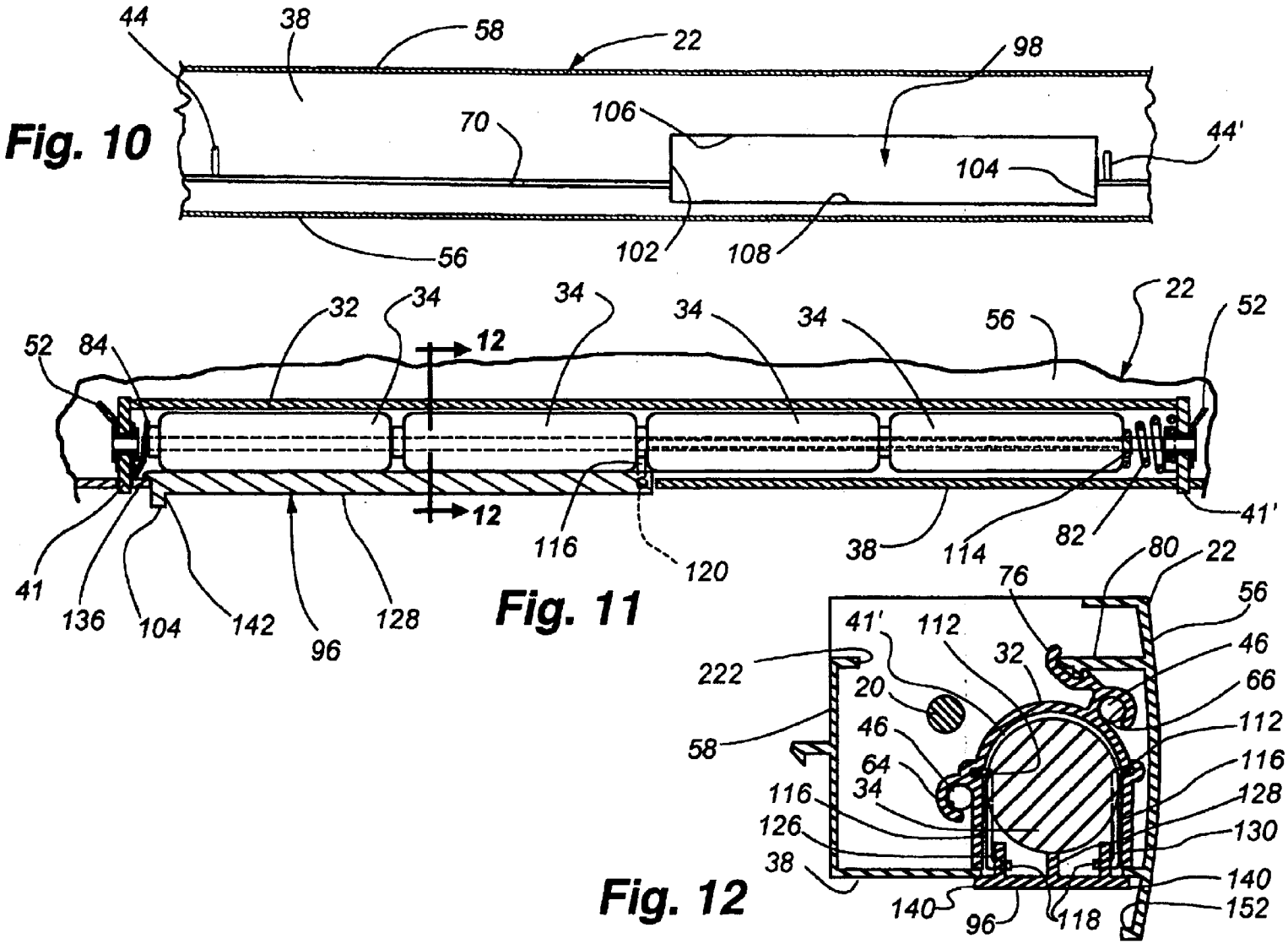
FIG. 10 is a fragmentary cross-sectional top plan view similar to FIG. 4, but taken along line 10—10 of FIG. 9.
FIG. 11 is a fragmentary cross-sectional view taken along line 11—11 of FIG. 8, depicting the battery magazine mounted in the housing.
FIG. 12 is a cross-sectional view along line 12—12 of FIG. 11.

FIG. 8 is a fragmentary isometric view of the bottom, front, and right end of a portion of the headrail 10 near the battery holder 18'. In particular, FIG. 8 depicts a fully assembled battery magazine (i.e., the battery magazine 32 (FIG. 9) having several other components attached thereto as described below) snapped into position within the headrail housing 22. FIG. 9 is similar to FIG. 8, but the fully assembled battery magazine is exploded from the headrail housing 22. Referring to these two figures, it is clear that the housing 22 comprises a front wall 56, a rear wall 58, and a bottom wall 38 connecting the front wall 56 and rear wall 58. The design of the housing may vary widely depending upon the desired application. For example, the front wall 56' depicted in FIGS. 18 and 20 is slightly different from the front wall 56 depicted in FIGS. 3, 6, 8, 9, and 12. The design of the rear wall 58 is generally less critical since the rear wall 58 is typically not visible when the headrail 10 is installed adjacent to an architectural opening (not shown). Nevertheless, the rear wall 58' depicted in FIGS. 18 and 20 is slightly different from the rear wall 58 depicted in FIGS. 3, 6, 8, 9, and 12. The important features of the housing 22 for purposes of the second type of battery holder 18' comprise the cutouts in the bottom wall 38. Referring most particularly to FIGS. 9 and 10, in this preferred embodiment, the bottom wall 38 includes tab slots 44, 44' and a relatively larger opening 98. The first and second tab slots 44, 44', respectively, accommodate the tabs 42 projecting from each magazine end cap 41, 41'. The tabs 42 are clearly visible in FIG. 13. The large opening 98 in the bottom wall 38 of the housing 22, includes a left edge 102, a right edge 104, a rear edge 106, and a front edge 108. Details concerning the several components attached to the magazine 32 are described more fully below in connection with FIG. 13.

Figure 13:
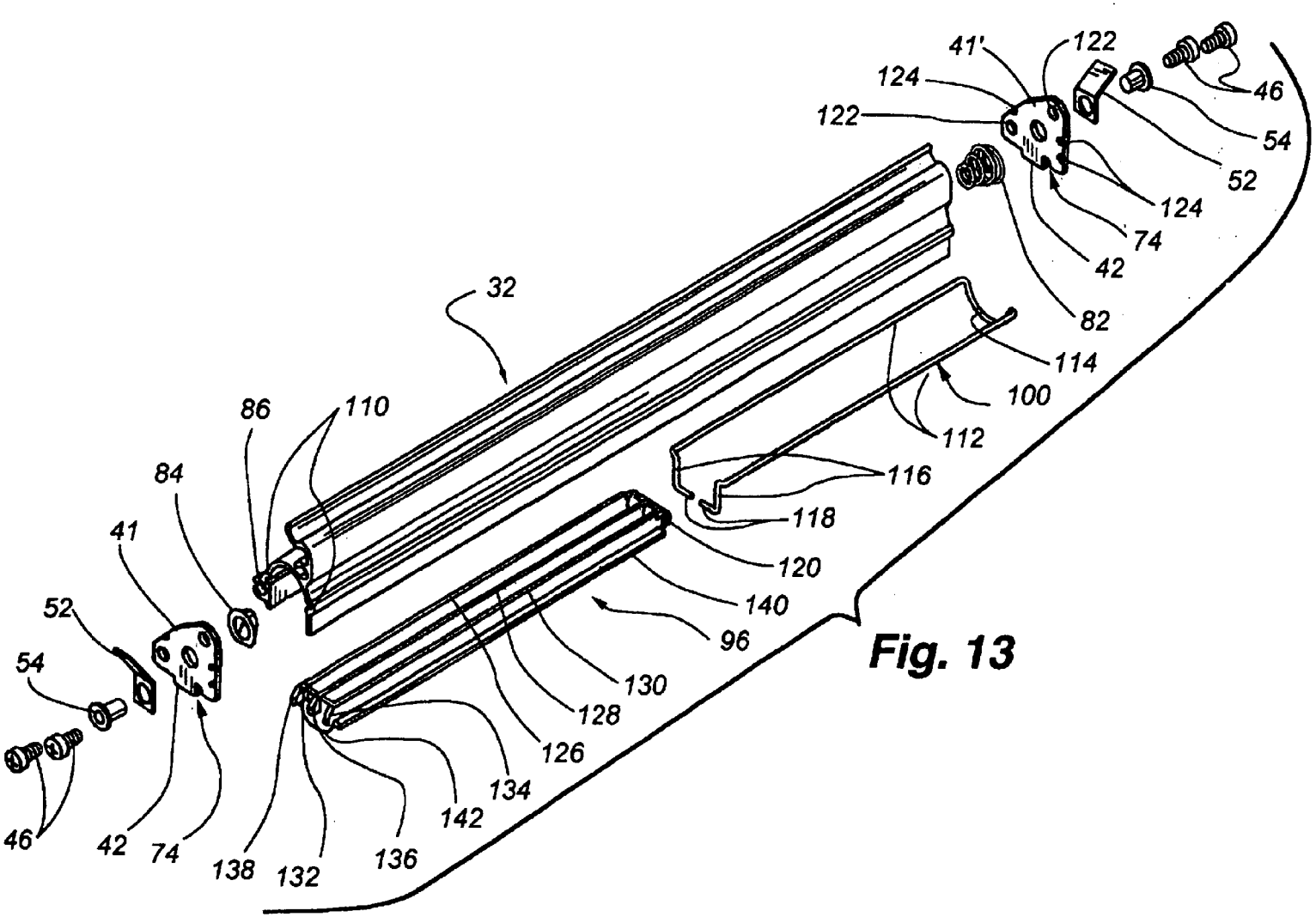
FIG. 13 is an exploded isometric view of the second type of battery holder, including the battery magazine and various components attached thereto.

FIG. 11 is a fragmentary cross-sectional view along line 11—11 of FIG. 8. This figure shows the magazine 32 containing batteries 34 snapped into position within the housing 22, the front wall 56 of which is partly visible in FIG. 11. FIG. 12 is a cross-sectional view along line 12—12 of FIG. 11. FIG. 13 is an exploded isometric view of the battery magazine 32 and all of the various components that are attached to it to make up the fully-assembled battery magazine depicted in, for example, FIG. 9. Referring to FIGS. 11–13, the various components that are attached to the magazine 32 are described next.

As previously discussed, the magazine 32 itself comprises a section of material having a cross-section that varies depending upon the selected configuration of the housing 22. FIG. 12 depicts the particular cross-sectional shape of the magazine 32 and housing 22 used in a preferred embodiment of the present invention. The particular cross-sectional shape of the magazine 32 and housing 22 are not critical to the present invention, and any one of the configurations depicted in the above-mentioned related U.S. application Ser. No. 09/481,237, filed Jan. 11, 2000 could be used, among others.

To assemble the magazine, a battery bracket 100 (FIG. 13) is slid into a pair of rail guide channels 110 integrally formed as part of the inner surface of the magazine 32. The battery bracket 100 comprises two substantially horizontal rails 112 that are spaced an appropriate distance (i.e., just greater than the diameter of a battery 34) from each other. These rails 112 easily slip into the rail guide channels 110. Two ends of the battery bracket rails 112 of the preferred embodiment are connected by an arcuate cross-over section 114. The opposite ends of the rails jog inwardly slightly (i.e., at least enough to get out of the rail guide channels 110) before turning downwardly to form risers 116. At the lowest ends of the risers 116, the battery bracket 100 is bent inwardly to form door catches or mounts 118. To connect the battery bracket 100 to the trap door 96, the battery bracket rails 112 are spread slightly until the door catches 118 can be inserted into a bracket-retention channel 120 forming part of the trap door 96.

As shown in FIG. 12, the inside walls of the magazine 32 prevent the risers 116 from moving apart once the battery bracket 100 is installed in the magazine 32 (i.e., once the rails 112 are slid into the rail guide channels 110). Thus, once the battery bracket 100 is attached to the trap door 96 and the battery bracket 100 is slid into the rail guide channels 110, the door catches 118 swingably retain the trap door 96 on the bottom side of the magazine 32. As shown to best advantage in FIG. 11, the arcuate cross-over section 114 of the battery bracket 100 is shallow enough that it impinges upon an end of one of the batteries 34 installed in the magazine 32. Also, when the rails 112 jog inwardly before extending downwardly to form the risers 116, the distance that the rails 112 jog toward each other may be far enough that each of the risers 116 also impinges upon an opposite end of a different battery 34 during battery extraction. This configuration is shown by the dashed lines in the preferred embodiment of FIG. 12. In the alternative, however, the rails 112 may jog inwardly just enough to get out of the rail guide channels 110, but not so much that they impinge upon an end of a battery 34. In this case, the risers 116 would ride near the inner walls of the magazine 32 and not impact the end of a battery 34.

Once the battery bracket 100 and trap door 96 have been positioned on the magazine 32, the remaining components associated with the magazine 32 may be assembled. Referring to the right hand end of FIG. 13, a fastener 54 (e.g., a rivet) is again used to connect a conductive terminal 52 to the outer surface of the first magazine end cap 41' while simultaneously attaching the spring 82 to an inside surface of the first magazine end cap 41'. In this manner, electrical energy may be conducted from one terminal of the battery 34 through the spring 82 to the conductive terminal 52 when the battery 34 is installed in the assembled battery magazine as depicted in FIG. 11. After the conductive terminal 52 and spring 82 have been connected to the first magazine end cap 41', the first magazine end cap 41' is attached to the magazine 32. The first magazine end cap 41' has a pair of attachment holes 122 through it and multiple alignment pins 124 associated with it. After the end cap 41' is properly aligned with an end of the magazine 32, with the alignment pins 124 riding adjacent to the inner surface of the magazine 32, the screws 46 are passed through the attachment holes 122 and are screwed into the screw channels 64, 66 (FIG. 12) integrally formed as part of the magazine 32. Clearly, different types of magazine end caps could be used. For example, the magazine end caps 40, 40' previously described and shown in, for example, FIG. 7 would work. These alternative magazine end caps 40, 40' have attachment ears 48, 50 with attachment holes in them, and they have alignment ridges 90 rather than alignment pins 124.

Referring now to the left end of FIGS. 11 and 13, assembly of the components attached to a second magazine end cap 41 is described next. In the preferred embodiment, the second magazine end cap 41 is interchangeable with the first magazine end cap 41'. A fastener 54 is used to connect a conductive terminal 52 to the outer surface of the second magazine end cap 41 while simultaneously fastening a flexible conductor or contact strip 84 to an inside surface of the second magazine end cap 41. The assembled second magazine end cap 41 is best seen in FIG. 11. After the flexible conductor 84 and the conductive terminal 52 have been fastened to the second magazine end cap 41, the second magazine end cap 41 is attached to the magazine 32 using a pair of screws 46 in the same manner as the first magazine end cap 41' was attached to the opposite end of the magazine 32.

After the magazine has been assembled as just described, it is snapped into position in the housing 22 as shown in FIGS. 8 and 9. In this preferred embodiment, the assembled magazine is held in position in the housing by the tabs 42 integrally formed as part of the first and second magazine end caps 41', 41. Also, the rib 70 (FIG. 10) integrally formed along the inner surface of the bottom wall 38 of the housing 22 in the preferred embodiment is captured by notches 74 (FIG. 13) formed in the bottom of each magazine end cap 41', 41. Also, the magazine is held in position by the interaction between the portion 80 (FIG. 12) of the housing 22 that extends rearwardly from the front wall 56 of the housing 22 and the placement tang 76 comprising part of the magazine 32. This interaction between the portion 80 of the housing 22 and the placement tang 76 is shown to good advantage in FIG. 12.

FIGS. 9 and 11–13 depict various views of the trap door 96. As shown to best advantage in FIG. 13, the upper or inside wall of the trap door 96 comprises a rear rib 126, a center rib 128, and a front rib 130. As best seen in FIG. 12, the center rib 128 is slightly shorter than the front rib 130 and the rear rib 126, thereby creating a cradle that supports the batteries 34 within the magazine 32. Each of the ribs 126, 128, 130 terminates at one end adjacent to the bracket-retention channel 120 of the trap door 96. The opposite ends of the three ribs 126, 128, 130 terminate at a wall 132 (FIG. 13) that is substantially perpendicular to the longitudinal axis of the trap door 96. A front protrusion 134, a center protrusion 136, and a rear protrusion 138 are formed on the opposite side of the wall 132 and correspond with the front rib 130, the center rib 128, and the rear rib 126, respectively. The trap door 96 further comprises a pair of protruding strips 140, one of which is visible in FIG. 13, and both of which are visible in cross-section in FIG. 12. As shown to best advantage in FIG. 12, when the trap door 96 is in its closed position, the protruding strips 140 slightly overlap the bottom wall 38 of the housing 22 to thereby conceal the large opening 98. In contrast, the front and rear ribs 130, 126, respectively, are positioned closely enough to each other that they may pass through the large opening 98 in the bottom wall 38 of the housing 22. In particular, the front rib 130 passes inside of the front edge 108 (FIG. 10) of the large opening 98, and the rear rib 126 passes inside of the rear edge 106 of the large opening 98, when the trap door 96 is closed.

The trap door 96 is retained in its closed condition by the protrusions 134, 136, 138. As seen to good advantage in FIG. 11, in which only the center protrusion 128 is visible, when the trap door 96 is closed, the protrusions 134, 136, 138 snap past the right edge 104 of the large opening 98 and the undersides of the protrusions 134, 136, 138 rest on the inside of the bottom wall 38 of the housing 22. As most clearly visible in FIG. 13, the upper surface of each protrusion 134, 136, 138 is sloped to facilitate snapping the trap door 96 closed. As the trap door 96 is forced closed, the sloped upper surfaces of the protrusions 134, 136, 138 impact on the outside of the bottom wall 38 of the housing 22, causing the trap door 96 and housing 22 to flex slightly until the protrusions 134, 136, 138 snap inside of the housing 22 to hold the trap door 96 closed. To open the trap door 96, a handle 142 (FIGS. 11 and 13) is integrally formed on the bottom surface of the trap door 96. To open the trap door 96, downward force is applied to the handle 142 until the protrusions 134, 136, 138 snap past the bottom wall 38 of the housing 22, and the trap door 96 swings open on the door catches 118 comprising part of the battery bracket 100.

The second type of battery holder 18' could be electrically connected to the receiver electronics 232 (FIG. 19) and motor 14 as shown in FIG. 2 and as previously discussed.

FIGS. 14–17 relate to a third type of battery holder 18" (FIG. 17) that may be used in conjunction with the headrail 10 of the present invention. As discussed further below, in this third type of battery holder 18", the battery magazine 32 (e.g., FIGS. 7 and 13) is replaced with a battery carrier 144 and carrier housing 146 that mounts within the headrail 10. Batteries 34' are inserted into and removed from the battery carrier 144, which is then slid into the carrier housing 146 through an elongated opening 148 (FIG. 16) in the bottom wall 38 of the headrail housing 22. U.S. application Ser. No. 09/480,912, filed Jan. 11, 2000, the disclosure of which has been incorporated herein by reference, discloses additional details about battery holders of this third type.

Figure 14:
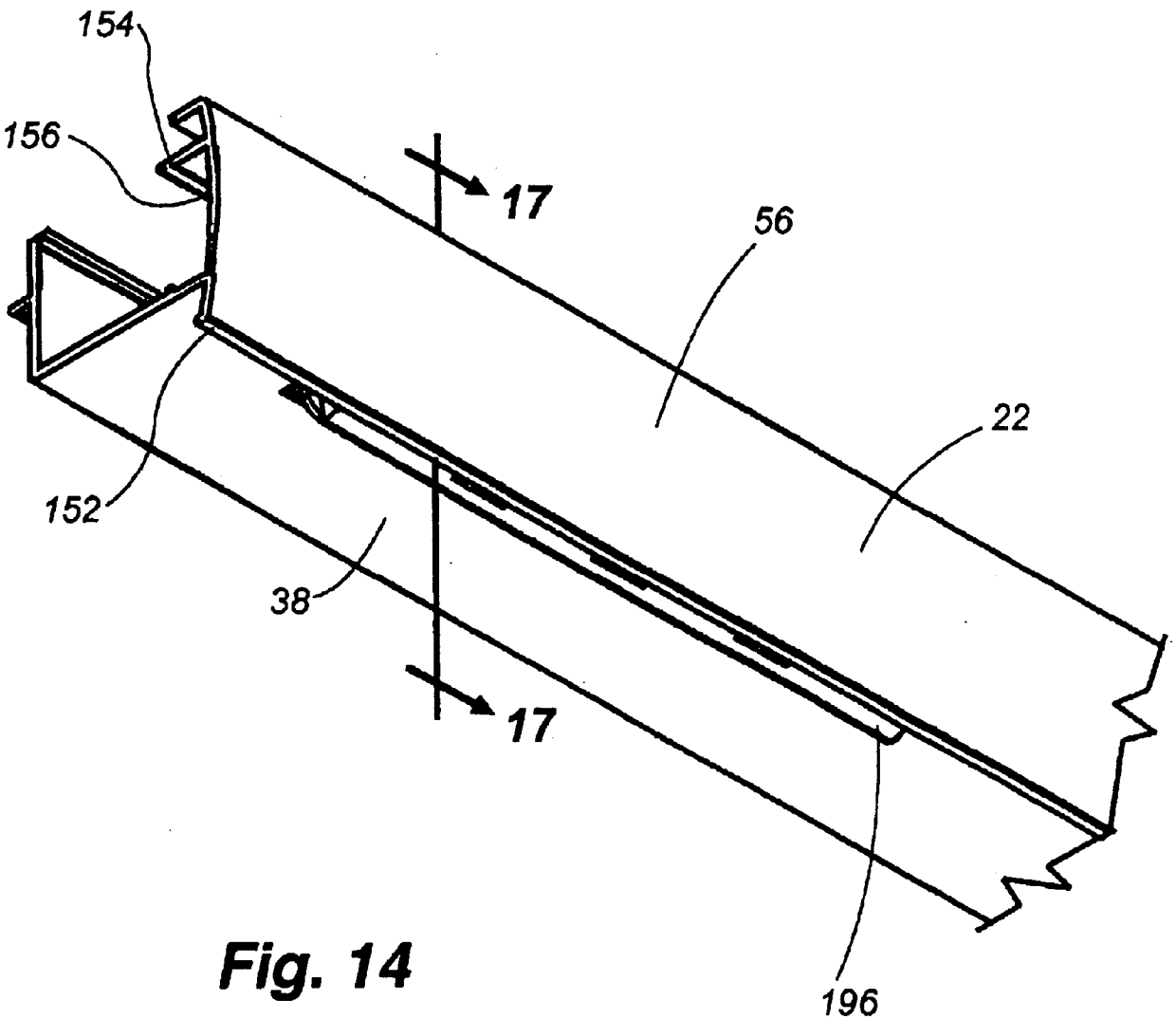
FIG. 14 is a fragmentary isometric view showing the front, bottom, and left end of the headrail housing and a third system for holding batteries according to the present invention.
Figure 15:
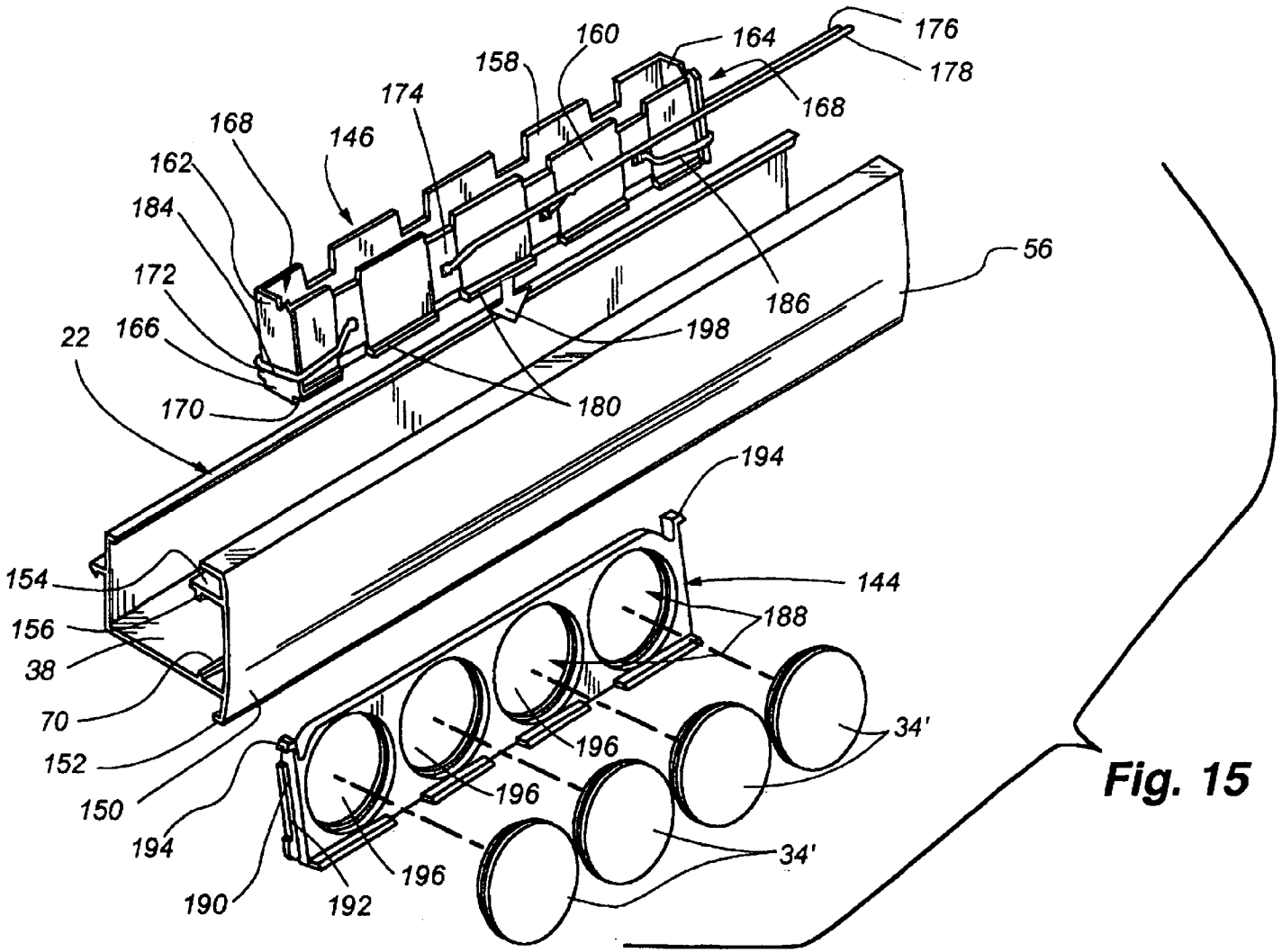
FIG. 15 is an exploded, fragmentary isometric view of the front, top, and left end of the headrail housing and the system for holding batteries also depicted in FIG. 14.
Figure 16:
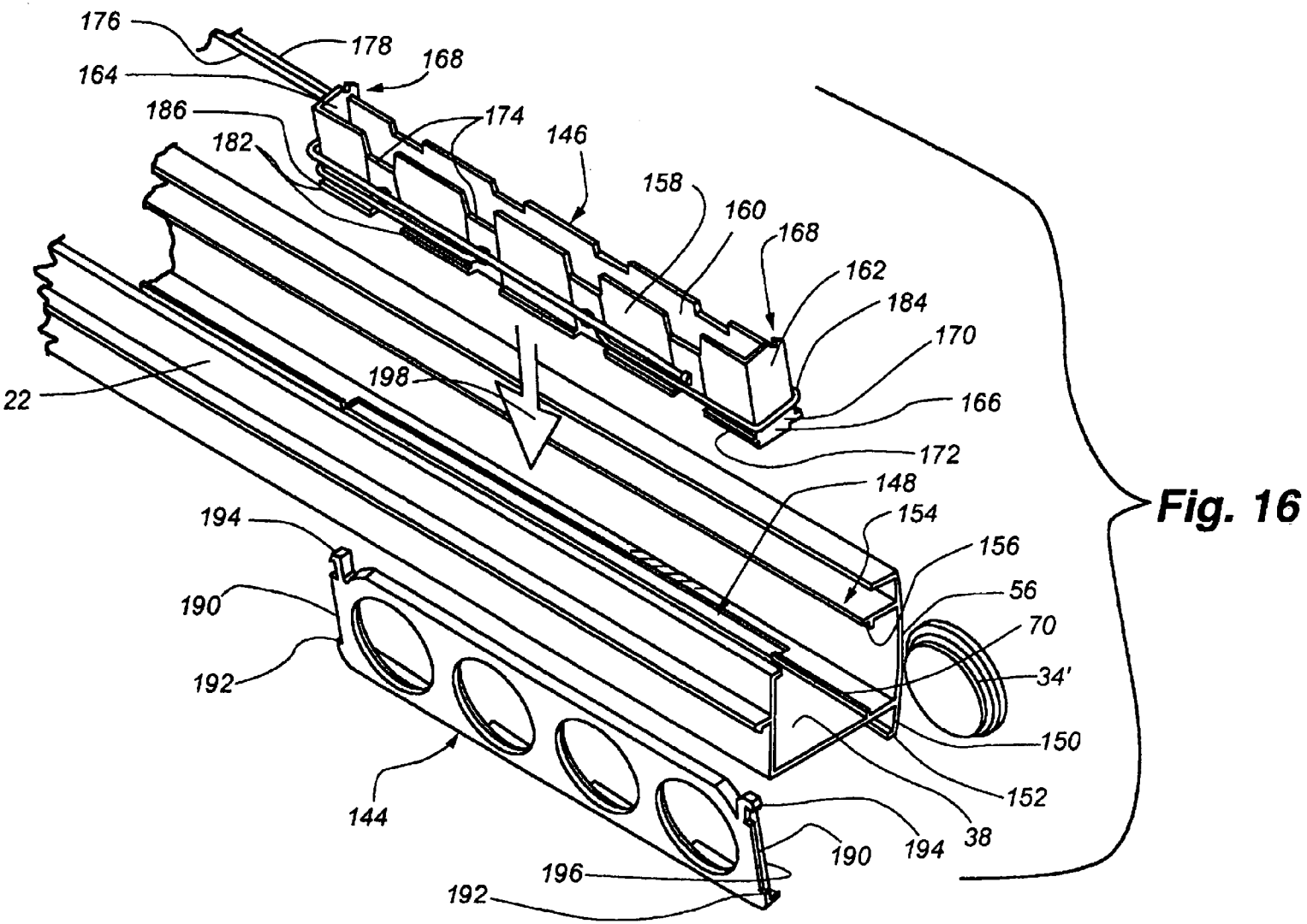
FIG. 16 is similar to FIG. 15, but depicts the back, top, and left end of the headrail housing and the system for holding batteries.

As shown clearly in FIGS. 14–16, among others, the housing 22 includes the front wall 56 and the bottom wall 38. The front wall 56 may have one of myriad cross-sectional shapes. For example, the front wall 56 depicted in FIGS. 14–17 is comprised of an arc of a circle. In the preferred embodiment, the lower edge of the front wall 56 comprises a flange 150 that extends below the bottom wall 38 of the housing 22. A ledge 152 extends rearwardly from the lowest edge of the flange 150 in the preferred embodiment. As will be described further below, this substantially horizontal ledge 152 at the lowest edge of the flange 150 helps to maintain the battery carrier 144 in position. As shown to good advantage in each of FIGS. 15 and 16, a carrier housing retainer ledge 154 extends rearwardly from the front wall 56 and into the interior of the housing 22. A ridge 156 extends longitudinally from an underside of the carrier housing retainer ledge 154. As described further below, this ridge 156 helps keep the battery carrier housing 146 in position within the headrail housing 22. As previously mentioned, the rib 70 extends upwardly from the bottom wall 38 into the interior of the headrail housing 22. This rib 70, which extends longitudinally along the interior of the headrail housing 22, is interrupted by the elongated opening 148 (FIG. 16). As described further below, the rib 70 helps position the battery carrier housing 146 above the elongated opening 148 when the battery carrier housing 146 is in position over the elongated opening 148.

Referring most particularly to FIGS. 15, 16, and 17, important features of the battery carrier housing 146 are described next. As shown to good advantage in FIGS. 15 and 16, the battery carrier housing 146 comprises a rear wall 158, a front wall 160, a left end wall 162, and a right end wall 164. The left and right end walls 162, 164 are mirror images of each other. Each of the end walls 162, 164 includes an extended portion 166 along its bottom edge. This extended portion 166 fits into the elongated opening 148 in the bottom wall 38 of the headrail housing 22 as shown to good advantage in FIG. 17. Along the top edge of each end wall 162, 164 is a retention groove 168. When the battery carrier housing 146 is in position within the headrail housing 22, the ridge 156 depending downwardly from the carrier housing retention ledge 154 snaps into the retention groove 168 in each end wall 162, 164 as shown to good advantage in FIG. 17. Each end wall 162, 164 also includes a front foot 170 (depicted to best advantage in FIG. 17) and a rear foot 172 (FIGS. 15 and 16).

As shown to good advantage in FIGS. 15 and 16, the rear wall 158 of the battery carrier housing 146 is notched along its top and bottom surfaces. In the preferred embodiment, the number of notches correspond with the number of batteries 34'. Referring most particularly to FIG. 16, a clip-on conductor 174, which may also be seen to good advantage in FIG. 17, is mounted on the rear wall 158 of the battery carrier housing 146 at each notched region. The notched areas of the rear wall 158 thus provide mounting locations for the clip-on conductors 174 to keep the clip-on conductors 174 at a desired longitudinal spacing. As shown in FIGS. 15 and 16, the front wall 160 of the battery carrier housing 146 is similarly notched. Again, there are four notched areas along the front wall 160 since the preferred embodiment uses four batteries 34'. As shown in FIG. 15, a clip-on conductor 174 is mounted to the front wall 160 at each of the notched locations. Thus, for each clip-on conductor 174 mounted to the rear wall 158 there is a corresponding clip-on conductor 174 mounted to the front wall 160. As described further below, these conductors 174 facilitate transfer of electrical energy from the batteries 34' to a first electrical lead 176 and a second electrical lead 178. As shown to good advantage in FIG. 15, at the bottom edge of each non-notched portion of the front wall 160, an elongated front foot 180 extends. Similarly, referring to FIG. 16, at the bottom edge of each non-notched portion of the rear wall 158, an elongated rear foot 182 extends. These elongated front and rear feet 180, 182 may be seen in cross-section on FIG. 17.

As briefly mentioned above, first and second electrical leads 176, 178 are secured (e.g., soldered) to selected clip-on conductors 174. For example, as shown in FIG. 15, the second electrical lead 178 is soldered to the center two clip-on conductors 174. Also, as clearly shown in FIG. 16, the first electrical lead 176 is soldered to the endmost clip-on conductors 174. Looking at FIGS. 15 and 16 together, a first series connector 184 may be seen to connect a clip-on conductor 174 on the rear wall 158 of the battery carrier housing 146 to a clip-on conductor 174 mounted on the front wall 160 of the battery carrier housing 146. Similarly, a second series connector 186 connects an inboard clip-on conductor 174 mounted on the rear wall 158 to an end clip-on conductor 174 mounted on the front wall 160. These connections comprise one method of connecting in parallel, battery pairs that are connected in series.

Referring to FIGS. 15 and 16, various features of the battery carrier 144 are described next. In the preferred embodiment, the battery carrier 144 accommodates four batteries 34'. Thus, the battery carrier 144 has four battery ports 188 (two of which are labeled in FIG. 15) formed therethrough. Since the batteries 34' accommodated by the battery carrier 144 in the preferred embodiment are circular with a stair-stepped circumferential edge (see, e.g., FIG. 17), the four battery ports 188 are circumferentially stair-stepped to keep the batteries 34' from passing through the battery carrier 144 when they are installed. The stair-stepped nature of the battery ports 188 is clearly visible in, for example, FIGS. 15 and 17. A rib 190 is formed at each end of the battery carrier 144. Each rib 190 is guided between a rear carrier guide (not shown) which extends from the rear wall 158 of the battery carrier housing 146, and a front carrier guide (not shown), which extends from the front wall 160 of the battery carrier housing 146. The front and rear carrier guides are shown and described fully in related U.S. application Ser. No. 09/480,912, filed Jan. 11, 2000, the disclosure of which has been incorporated herein by reference. At the lower end of each rib 190 is a stop 192. These stops 192, as explained further below, prevent the battery carrier 144 from being inserted too far into the battery carrier housing 146 when the batteries 34' are being loaded into their operational configuration. Also formed at an upper portion of each end of the battery carrier 144 is a hanger 194. These hangers 194 permit the battery carrier 144 to be pivoted slightly during removal and replacement of batteries 34' when it is desirable not to fully remove the battery carrier 144 from the battery carrier housing 146.

Finally, as shown to good advantage in FIG. 15, a discontinuous retention foot 196 is formed along the bottom edge of the battery carrier 144. As clearly shown in FIG. 17, for example, the discontinuous retention foot 196 interacts with the ledge 152 on the bottom of the front wall flange 150 to retain the battery carrier 144 in the battery carrier housing 146. In the preferred embodiment, the retention foot 196 is discontinuous as shown in, for example, FIG. 15. This retention foot 196, however, could also be continuous or could comprise more or fewer sections than are depicted for the preferred embodiment.

Assembly of the third type of battery holder 18" in a headrail 10 is described next. FIGS. 15 and 16 depict the battery carrier housing 146 before it is inserted into position in the headrail housing 22. Assembly is commenced by inserting the battery carrier housing 146 into the headrail housing 22 along the path indicated by the arrow 198. In particular, the battery carrier housing 146 is inserted into the headrail housing 22 so that the extended portion 166 along the bottom edge of the left and right end walls 162, 164 of the battery carrier housing 146 line up with the short edges of the elongated opening 148 in the bottom wall 38 of the headrail housing 22. The battery carrier housing 146 is then seated in the headrail housing 22 by pushing the battery carrier housing 146 into the elongated opening 148 until the front foot 170 and rear foot 172 of the end walls 162, 164, as well as the elongated front foot 180 and rear foot 182 of the front and rear walls 160, 158, respectively, rest against the inside surface of the bottom wall 38 of the headrail housing 22. When the battery carrier housing 146 is properly inserted into the elongated opening 148 in the bottom wall 38 of the housing 22, the longitudinal rib 70 extending upwardly from the bottom wall 38 rests against the outer surface of each end wall 162, 164 of the battery carrier housing 146, and the ridge 156 extending downwardly from the carrier housing retainer ledge 154 snaps into the retention grooves 168 formed along the top edges of the left and right end walls 162, 164. The battery carrier housing 146 is thereby securely, but removably, positioned within the headrail housing 22 above the elongated opening 148.

The next step toward putting the system for holding batteries 34' into its operational configuration comprises inserting the batteries 34' into the battery carrier 144. After the batteries 34' are loaded into the battery carrier 144, the battery carrier 144 is pushed upward through the elongated opening 148. As the battery carrier 144 is pushed through the elongated opening 148 and into the mounted battery carrier housing 146, the ribs 190 on each end of the battery carrier 144 are guided between the front and rear carrier guides (not shown). Initially, the hangers 194 extending outwardly from the upper edges of the battery carrier 144 must flex slightly inward to snap past the front and rear carrier guides. To prevent the battery carrier 144 from excessive insertion into the battery carrier housing 146, the stops 192 formed near the lower end of each rib 190 on the battery carrier 144 impact the bottom wall 38 of the headrail housing 22. These stops 192 thereby prevent the battery carrier 144 from being inserted too far into the battery carrier housing 146.

FIGS. 14 and 17 show the fully loaded and assembled system for holding batteries. As shown to best advantage in FIG. 17, which is a cross-sectional view taken from FIG. 14, when the batteries 34' are loaded in the battery carrier 144, and the battery carrier 144 is fully installed in the battery carrier housing 146, the clip-on conductors 174 make appropriate electrical contact with the batteries 34'. In particular, each clip-on conductor 174 includes a flexible connector 200 that is in close sliding, frictional engagement with one side of a battery 34'. Since one side of the battery 34' comprises a positive terminal and the other side of the battery 34' comprises a negative terminal, the clip-on conductors 174 mounted to the rear wall 158 make electrical connection with one set of battery terminals, while the clip-on conductors 174 attached to the front wall 160 make electrical contact with the other terminals of each battery 34'.

Removal and replacement of batteries 34' when it is desirable not to fully remove the battery carrier 144 from the battery carrier housing 146 is described next. The first step in the battery removal and replacement process is to slide the battery carrier 144 downward out of the elongated opening 148. By putting some rearward pressure on the lower portion of the battery carrier 144, adjacent the discontinuous retention foot 196 of the battery carrier 144, it is possible to slip the discontinuous retention foot 196 past the ledge 152 formed at the bottom edge of the front wall 56 (see FIG. 17). Then, the battery carrier 144 may be slid further downward until the hangers 194 stop further downward movement. At this point, the batteries 34' in the battery carrier 144 are visible. The next step is to pivot the battery carrier 144 slightly rearwardly to provide room for battery removal. Once the battery carrier 144 is pivoted slightly rearwardly, it is possible to remove dead or depleted batteries 34' from the battery carrier 144, pushing the batteries 34' from the battery carrier 144, and to replace same with fresh batteries 34'. Subsequently, the battery carrier 144 is pivoted forwardly and then pushed upwardly into the battery carrier housing 146 until the discontinuous retention foot 196 is again retained by the ledge 152 directed rearwardly from the bottom edge of the front wall 56 of the headrail housing 22.

The third type of battery holder 18" could be electrically connected to the receiver electronics 232 (FIG. 19) and motor 14 as shown in FIG. 2 and as previously discussed.

Signal-Receiving Systems

FIGS. 18–26 and 46–71 relate to signal-receiving systems 16 that may be used in conjunction with the headrail 10 of the present invention. As discussed further below, the signal-receiving systems of the present invention comprise unobtrusive means for reliably receiving the signal from a remote-control transmitter (not shown). An advantage of the instant invention over the prior art is that a relatively small component mounted to the headrail, valance, or over treatment is the only part of the signal-receiving system that remains in plain view, and the remaining components of the system are hidden within the headrail 10. The signal is thus transferred from the small exposed component to a controller for the motor 14 that actually adjusts the covering 12. U.S. application Ser. No. 09/481,746, filed Jan. 11, 2000, and U.S. provisional application Serial No. 60/126,104, the disclosures of which have been incorporated herein by reference, provide additional details about the different signal-receiving systems.

FIG. 18 is a fragmentary, cross-sectional view taken along line 18—18 of FIG. 1. As briefly mentioned above, however, the cross-sectional shape of the headrail housing 22' of FIGS. 18 and 20 is slightly different from that shown to best advantage in, for example, FIGS. 1, 3, 6, 8, 9, and 12. In FIG. 18, the signal-receiving system 16 is shown mounted to the headrail housing 22. This signal-receiving system 16 includes a receiver holder 202 positioned within the headrail housing 22', and a signal refractor 204, which is attached to a bottom of the receiver holder 202 and positioned adjacent to a lowest edge 206 of the front wall 56' of the headrail housing 22'. The receiver holder 202 includes a receiver holder base 208 having a scoop 210 (FIG. 19) extending from a bottom surface 212 thereof and a receiver holder cover 209. A portion of the receiver holder base 208 is broken away in FIG. 18 to show the relationship between a collector 214 mounted within the receiver holder base 208 and the signal refractor 204 mounted to the scoop 210 (FIG. 19) extending from the bottom surface 212 of the receiver holder base 208. The interaction between the scoop 210 and a port 224 (FIG. 20) through the bottom wall 38 also helps to position the receiver holder 202 within the headrail housing 22'.

Figure 19:
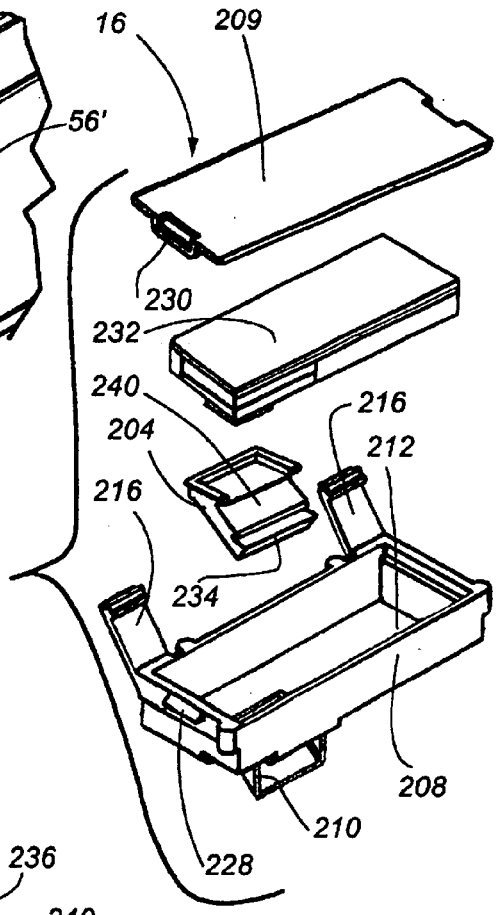
FIG. 19 is an exploded, isometric view of the two-piece signal receiver holder, the signal receiver electronics, and the signal refractor also depicted in FIG. 1.

In the preferred embodiment, the receiver holder 202 is also held in position within the headrail housing 22' by a pair of braces 216 (one of which is visible in FIG. 18, and both of which are visible in FIGS. 1, 2, and 19). The free end of each brace 216 comprises a substantially horizontal surface 218 (FIG. 18) that is bifurcated by an upstanding ridge 220. When the headrail housing 22' has the cross-sectional configuration depicted in FIGS. 18 and 20, the distal edge 222 of the rear wall 58 extends downwardly. When the receiver holder 202 is positioned within the headrail housing 22', this distal edge 222 presses downwardly on a portion of the substantially horizontal surface 218 at the free end of each brace 216.

If the headrail housing 22 has the cross-sectional configuration depicted in, for example, FIGS. 3, 6, and 12, the free ends of the braces 216 are stabilized by the rear wall 58 in a manner that is different from that just described. The distal edge 222 of a rear wall 58 of the housing 22 extends substantially horizontally into the interior of the headrail housing 22. This distal edge 222 of the rear wall 58 presses against the rear side of the upstanding ridge 220 on the free end of each brace 216 to position the receiver holder 202 within the housing 22. As will be described further below in connection with FIG. 21, the signal refractor 204 of the preferred embodiment includes a substantially horizontal channel 226 (most clearly depicted in FIG. 21). This substantially horizontal channel 226 accommodates the inwardly directed substantially horizontal ledge 152 (FIGS. 3, 6, and 12) extending from the lower edge of the front wall 56 of the headrail housing 22.

Continuing to refer to FIGS. 18 and 19, additional details about the receiver holder 202 are described next. A pair of cover anchors 228 extend from the longitudinal ends of the receiver holder base 208. Corresponding catches 230 extend downwardly from the longitudinal ends of the receiver holder cover 209. When the receiver holder cover 209 is pressed into position on the receiver holder base 208, these catches 230 snap past the cover anchors 228 and removably secure the receiver holder cover 209 to the receiver holder base 208, while protecting the receiver electronics 232 (shown schematically in FIG. 19) within the receiver holder 202.

Referring next to FIG. 20, which is a fragmentary isometric view of a portion of headrail housing 22', the port 224 is clearly shown through the bottom wall 38' of the headrail housing 22'. As shown in FIG. 19, which is an exploded isometric view of the signal-receiving system 16, the scoop 210 extends from the bottom surface 212 of the signal receiver holder base 208. When the signal receiver holder 202 is mounted within the headrail housing 22 (see, e.g., FIG. 18), the scoop 210 extends through the port 224 in the bottom wall 38'. In this manner, the signal refractor 204, which is mounted within the scoop 210, extends outside of the headrail housing 22' and is positioned for reliable reception of remote-control signals.

Figure 21:
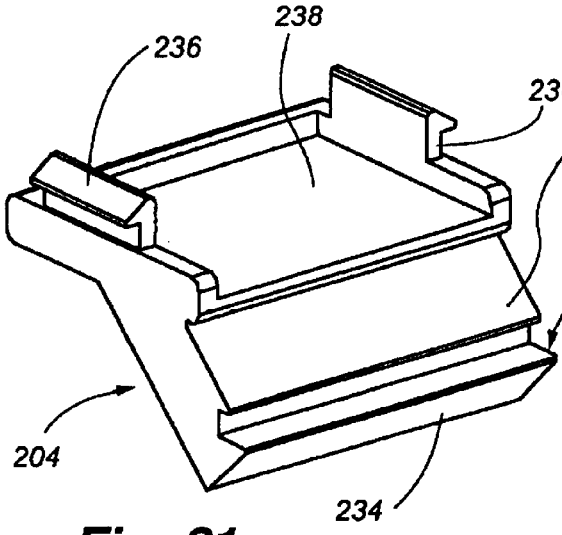
FIG. 21 is an isometric view of a preferred embodiment for the signal refractor.

In FIG. 19, the receiver holder cover 209, the signal receiver electronics 232, the signal refractor 204, and the receiver holder base 208 are shown positioned for assembly. To assemble the signal-receiving system 16, the signal refractor 204 is first placed within the receiver holder base 208 so that a sloped surface 234 (see also FIGS. 18 and 21) at a lower end of the signal refractor 204 extends through the scoop 210 mounted to the bottom surface 212 of the signal holder base 208. Referring to FIG. 21, which depicts a preferred embodiment of the signal refractor 204, positioning clips 236 formed on two of the edges of an upper surface 238 of the signal refractor 204 are clearly visible. These positioning clips 236 prevent the signal refractor 204 from passing completely through the bottom surface 212 of the receiver holder base 208. When the signal refractor 204 is fully inserted into the scoop 210, the positioning clips 236 rest on the bottom surface 212 of the receiver holder base 208 to properly position the signal refractor 204.

As just mentioned, FIG. 21 is an isometric view of one preferred embodiment for the signal refractor 208. Another possible embodiment for the signal refractor is disclosed in U.S. application Ser. No. 09/481,746, filed Jan. 11, 2000, the disclosure of which has been incorporated herein by reference. The embodiment depicted in FIG. 21 has a sloped front surface 240, which permits this signal refractor 204 to be compatible with a wide variety of cross-sectional shapes for the headrail housing. The signal refractor 204 also includes the sloped surface 234 at its lower edge. This sloped surface 234 is the point of entry for remote control signal which are then bent toward the collector 214 (FIG. 18). In the preferred embodiment, the sloped surface 234 is smooth, resulting in specular reflection from the surface 234, and forms an angle of approximately 45° with the horizontal when the signal refractor 204 is properly placed within the receiver holder base 208. In the preferred embodiment, the signal refractor 204 is made of acrylic having an index of refraction of 1.48, which causes the remote control signals to be bent toward the normal since the refraction index of air (i.e., 1.0) is less than the refraction index of the refractor 204 (i.e., 1.48). Thus, the refractor 204 effectively channels the signals impinging upon the sloped surface 234 from a wide variety of angles toward the collector 214. As a result, a person operating a remote control device (not shown) to send signals to the signal refractor 208 depicted in FIG. 21 may transmit those signals from a wide variety of positions and still expect to have the signal accurately received by the signal-receiving system 16 of the present invention.

Figure 22:
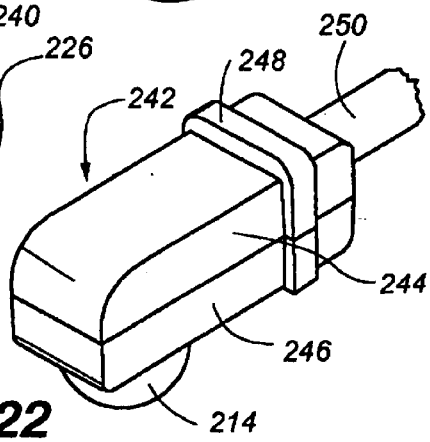
FIG. 22 is an isometric fragmentary view of a remote eye comprising the signal receiver according to an alternative embodiment for the signal-receiving system of the present invention.

Referring next to FIG. 22, a remote eye 242 comprising part of an alternative embodiment for the signal-receiving system 16 of the present invention is described next. The assembled remote eye 242 is shown in FIG. 22. In this figure, it is clear that the remote eye 242 comprises a housing having an upper half 244 and a lower half 246. Each of the halves of housing 244, 246 includes part of a rib 248. The collector 214 extends from the lower half 246 of the housing. Also shown in FIG. 22 is a portion of fiber optic cable 250 extending from the rear of the remote eye 242.

Figure 23:
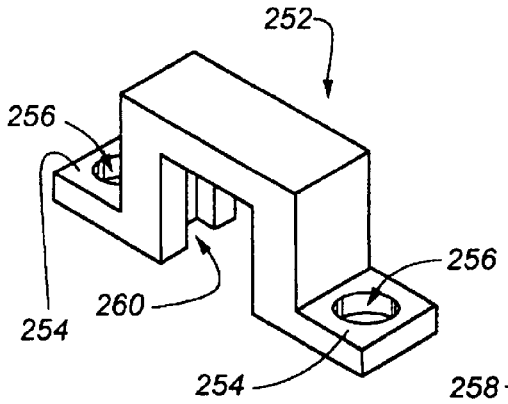
FIG. 23 is an isometric view of a clamp that may be used to attach the remote eye of FIG. 22 to a mounting surface.
Figure 24:
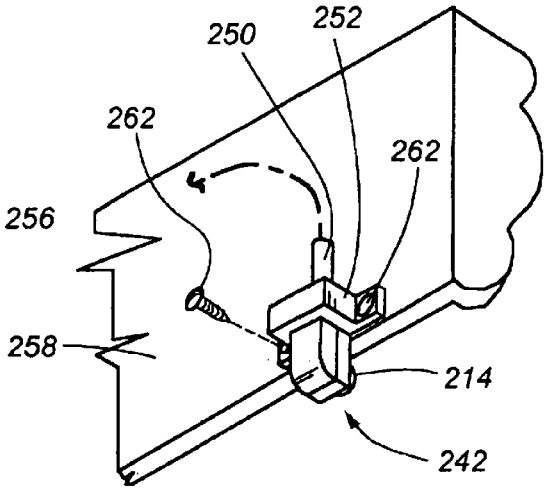
FIG. 24 is a fragmentary isometric view of the remote eye depicted in FIG. 22 attached to a wood valance by the clamp depicted in FIG. 23.

Referring next to FIG. 23, one means for connecting the remote eye 242 to its operational position is described next. FIG. 23 depicts a clamp 252. In this preferred embodiment, the clamp 252 is substantially U-shaped, with the open portion of the U pointed downwardly in FIG. 23. The clamp 252 includes two extended portions 254. In the preferred embodiment, these extended portions 254 extend substantially perpendicularly to the legs of the U-shaped clamp 252. Each of the extended portions 254 has a screw hole 256 through it. As described below in connection with FIG. 24, these screw holes 256 permit attachment of the clamp 252 to a fixation surface, for example, a wood valance 258 (FIG. 24). On an inside surface of the clamp 252, a rib channel 260 is integrally formed. In the preferred embodiment, this rib channel 260 has a configuration that substantially conforms to the rib 248 on the assembled remote eye 242.

Referring now to FIGS. 22–24, assembly of the clamp 252 with the remote eye 242 is described next. In preparation for mounting the remote eye 242 in its operational position, the clamp 252 depicted in FIG. 23 is slid onto the assembled remote eye 242 depicted in FIG. 22. When the clamp 252 is properly positioned on the remote eye 242, the rib channel 260 formed on the inner surface of the clamp 252 aligns with and accommodates the rib 248 (FIG. 22) on the outside of the remote eye 242. When properly assembly, the clamp 252 rides on the remote eye 242 as shown in FIG. 24. FIG. 24 is a fragmentary isometric view of the remote eye 242 and clamp 252 attached to the wood valance 258 by screws 262. When the remote eye 242 is properly mounted, the collector 214 extends just below the bottom edge of the wood valance 258 so that signals from a hand held or other remote-control device (not shown) can be directed toward the collector 214.

Figure 26:
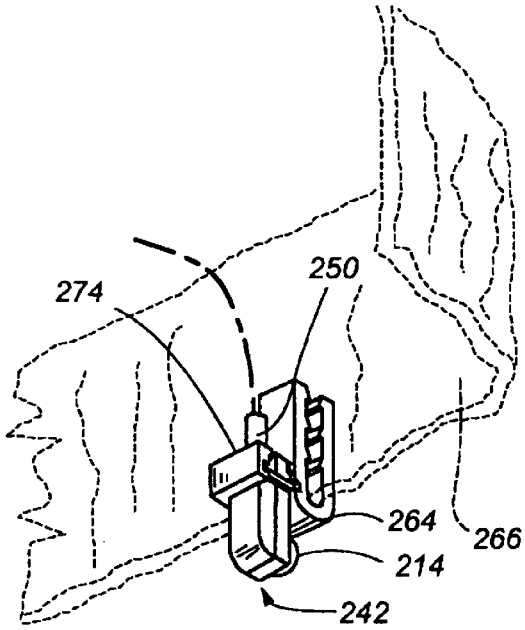
FIG. 26 depicts the clip of FIG. 25 mounting the remote eye of FIG. 22 onto an over treatment shown in phantom to position the collector for receipt of signals from a remote control.
Figure 25:
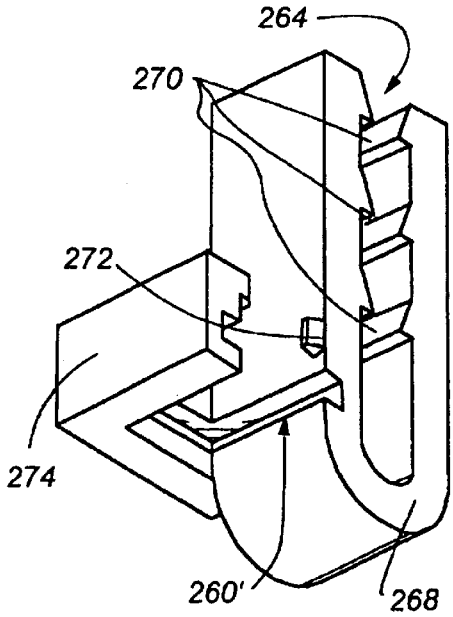
FIG. 25 is an isometric view of a clip that may be used to attach the remote eye depicted in FIG. 22 to an over treatment for a window covering.

FIG. 25 is an isometric view of a clip 264 that may be used to attach the remote eye 242 depicted to best advantage in FIG. 22 to an over treatment 266 (FIG. 26) for a window covering. The clip 264 comprises a generally U-shaped main body 268. On an inner surface of each leg of the U-shaped main body 268 are a plurality of gripping ridges 270. These gripping ridges 270, which are formed in a known manner, permit easy attachment to the over treatment 266, but resist removal. Since the gripping ridges 270 resist removal, when the clip 264 is mounted in its operational configuration, it tends to remain in a desired position. A retention nub 272 is integrally formed on an outer surface of one of the legs of the U-shaped main body 268. Also mounted on the same leg and adjacent to the retention nub 272 is a flexible brace 274. In the preferred embodiment, the flexible brace 274 includes a rib channel 260' that also extends into the same leg of the U-shaped main body 268 from which the flexible brace 274 extends. When the remote eye 242 depicted in FIG. 22 is attached to the clip 264 depicted in FIG. 25, the rib 248 on the outside of the remote eye 242 is carried within the rib channel 260' depicted in FIG. 25 When the remote eye 242 is fully seated in the rib channel 260', the retention nub 272 snaps past an edge of the remote eye 242, and the flexible brace 274 then cooperates with the retention nub 272 to hold the remote eye 242 in its assembled condition with the clip 264. As shown in FIG. 26, once the remote eye 242 and clip 264 are assembled, the clip 264 may then be slid over the over treatment 266. In this manner, the collector 214 of the remote eye 242 can again be positioned for reliable receipt of signals from a remote-control device (not shown).

Figure 48:
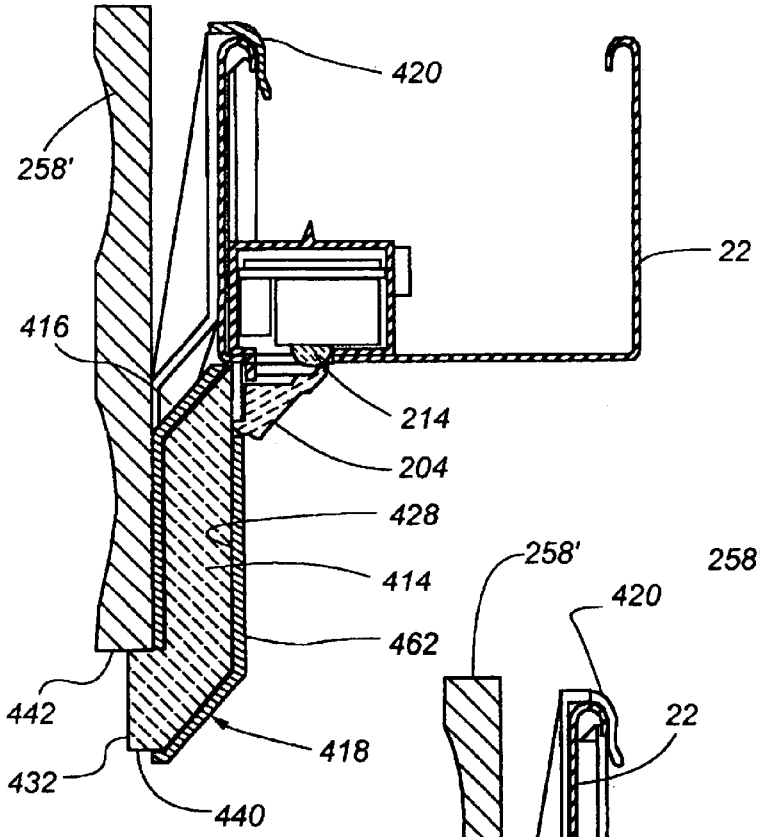
FIG. 48 is a cross-sectional view taken along line 48—48 of FIG. 47 and through the supplemental prism.
Figure 49:
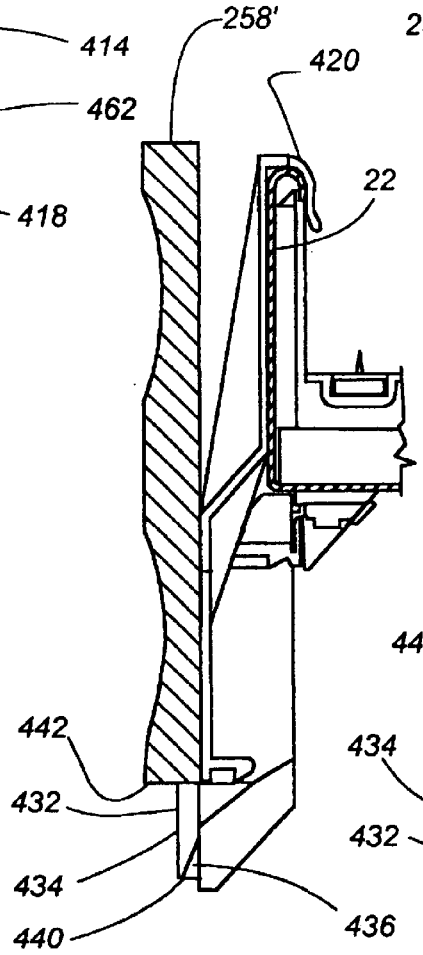
FIGS. 49 and 50 are cross-sectional views similar to FIG. 48, but not taken through the supplemental prism.

Referring next to FIGS. 46–71, a supplemental prism 414 that may be used in conjunction with a wide valance 258', thus comprising part of the signal-receiving system 16, is described next. FIGS. 46–50 show the headrail housing 22 with the wide valance 258' attached thereto, which prevents control signals from easily reaching the signal refractor 204 (FIG. 48). In order to provide a path for the control signals to reach the signal refractor 204 and the collector 214, a supplemental prism 414 is provided to direct control signals up to the signal refractor 204, which in turn reflects the control signals to the collector 214.

Figure 53:
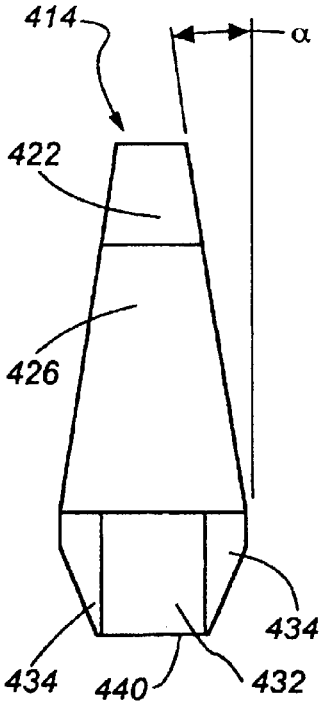
FIG. 53 is a front elevation of the supplemental prism depicted in FIGS. 51 and 52.
Figure 54:
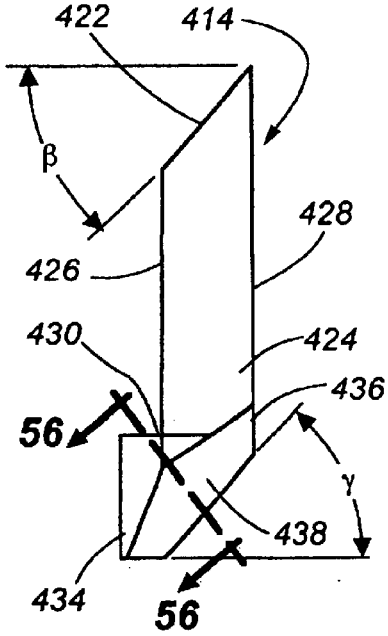
FIG. 54 is a side elevation of the supplemental prism depicted in FIGS. 51 and 52.
Figure 55:
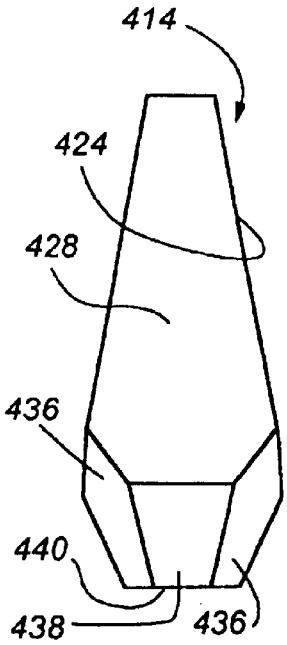
FIG. 55 is a rear elevation of the supplemental prism depicted in FIGS. 51 and 52.

FIGS. 51–56 show the supplemental prism 414 in detail. The supplemental prism 414 has thirteen primary faces or surfaces: a sloped top face 422; two sloped, upper side faces 424; an upper front face 426; an upper rear face 428; a horizontal face 430; a lower front face 432; two forward side faces 434; two sloped, rearward side faces 436; a sloped, lower rear face 438; and a bottom face 440. When the supplemental prism 414 is properly attached to the wide valance 258', the horizontal face 430 rests against a bottom edge 442 of the wide valance 258', and at least the lower front face 432 and the two forward side faces 434 extend below the bottom edge 442 to receive control signals from the remote-control transmitter (not shown). The angle $\propto$, shown in FIG. 53, is preferably from 5° to 15°. Each of the angles $\beta$ and $\gamma$, shown in FIG. 54, is preferably from 40° to 50°. Finally, the angle $\delta$, shown in FIG. 56, also is preferably from 40° to 50°.

Figure 57:
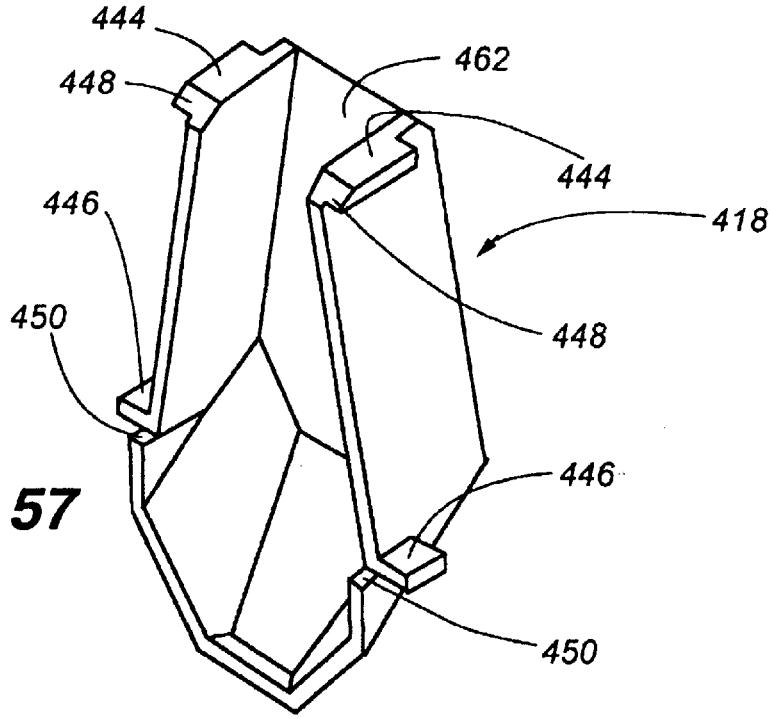
FIG. 57 is an isometric views of a rear cover for the supplemental prism of FIGS. 51–56.
Figure 58:
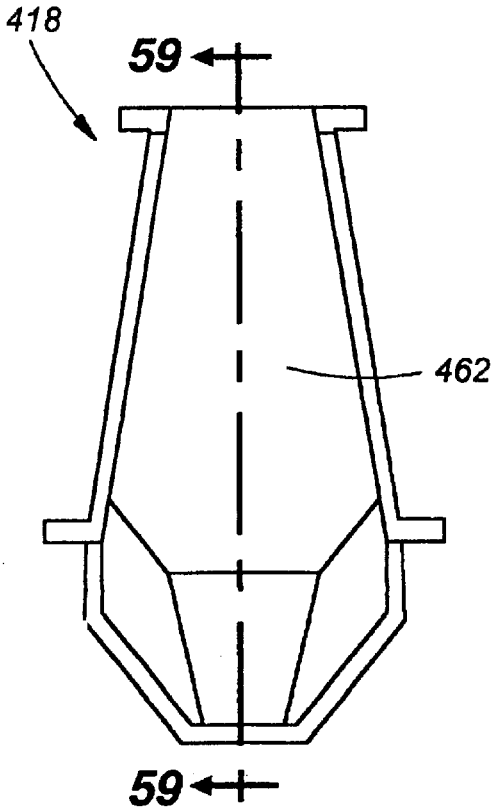
FIG. 58 is a front elevation of the rear cover depicted in FIG. 57, looking into the rear cover.
Figure 59:
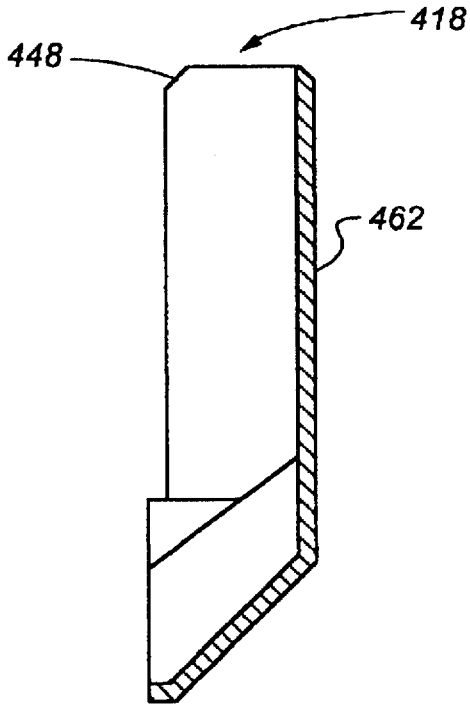
FIG. 59 is a cross-sectional view of the rear cover taken along line 59—59 of FIG. 58.
Figure 60:
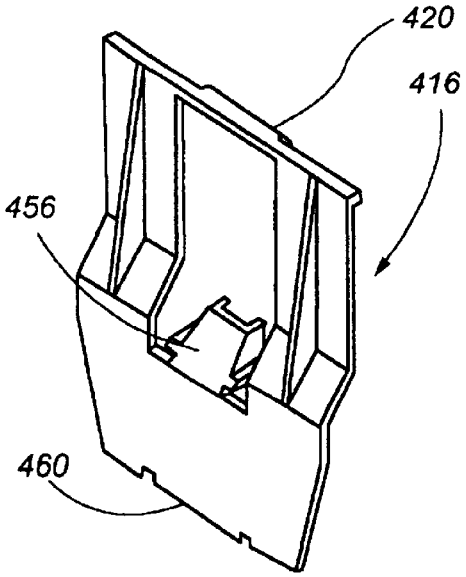
FIGS. 60 and 61 are isometric views of a front cover for the supplemental prism of FIGS. 51–56.
Figure 61:
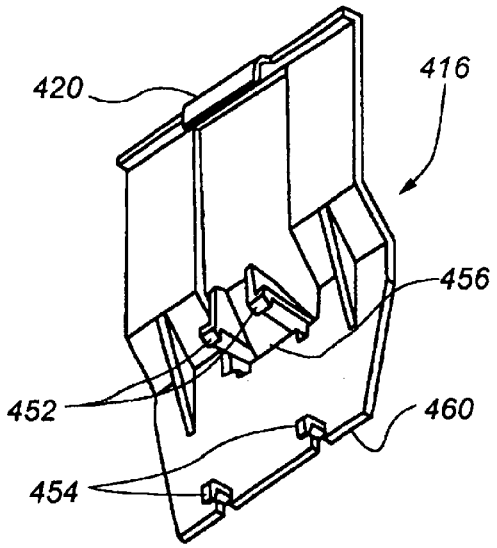
Figure 62:
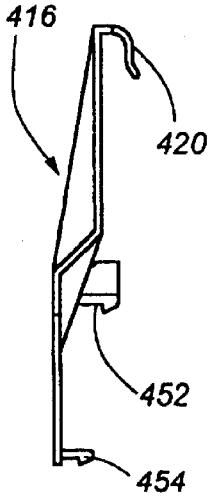
FIG. 62 is a side elevation of the front cover depicted in FIGS. 60 and 61.
Figure 63:
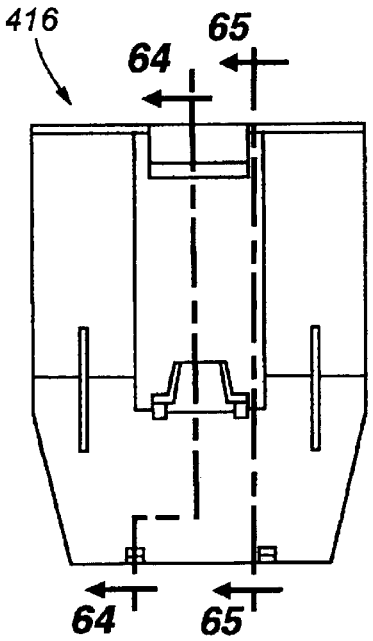
FIG. 63 is a rear elevation of the front cover depicted in FIGS. 60 and 61.
Figure 64:
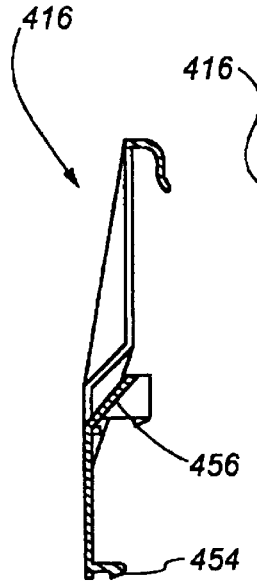
FIG. 64 is a cross-sectional view taken along line 64—64 of FIG. 63.
Figure 65:
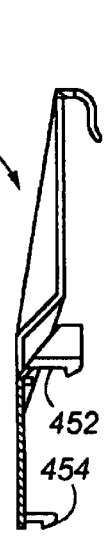
FIG. 65 is a cross-sectional view taken along line 65—65 of FIG. 63.
Figure 66:
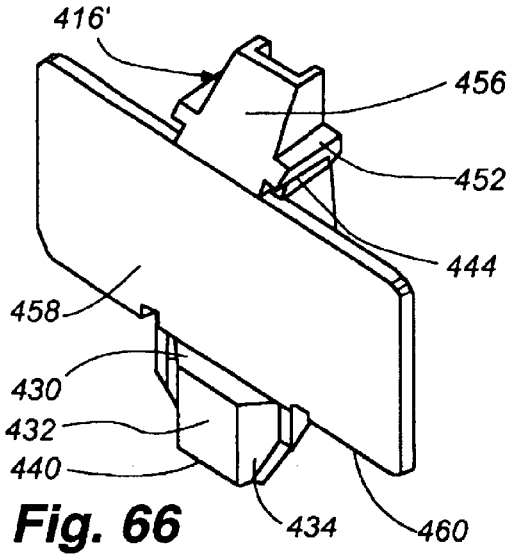
FIGS. 66 and 67 are isometric views of an alternative front cover, shown attached to the rear cover and with the supplemental prism of FIGS. 51–56 installed between the front and rear covers.
Figure 67:
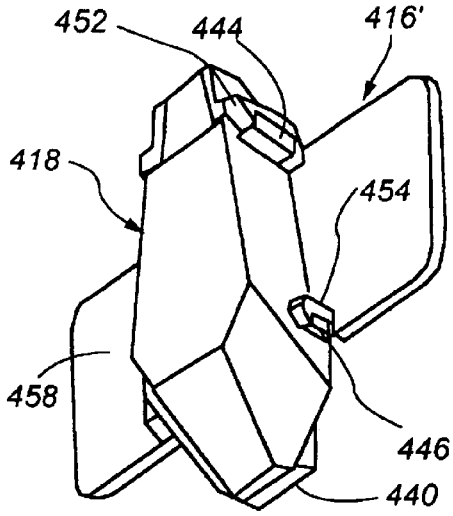
Figure 69:
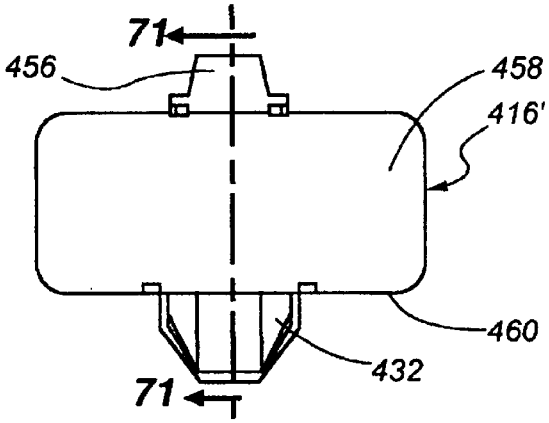
FIG. 69 is a front elevation of the assembly depicted in FIGS. 66 and 67.
Figure 68:
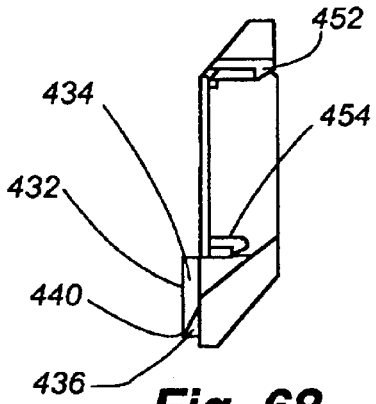
FIG. 68 is a side elevation of the assembly depicted in FIGS. 66 and 67.

The rear cover 418, shown to best advantage in FIGS. 57–59, conforms to the shape of seven of the primary faces of the supplemental prism 414: the two sloped, upper side faces 424; the upper rear face 428; the two sloped, rearward side faces 436; the sloped, lower rear face 438; and the bottom face 440. Upper and lower ears 444, 446, respectively, are formed along the sides of the rear cover 418. Beveled edges 448 are formed adjacent to the forward edges of the upper ears 444. As discussed further below, these beveled edges 448 permit the front cover (e.g., 416) to fully cover the upper front face 426 and sloped top face 422. A placement ledge 450 is formed adjacent to the forward edges of the lower ears 446.

Figure 50:
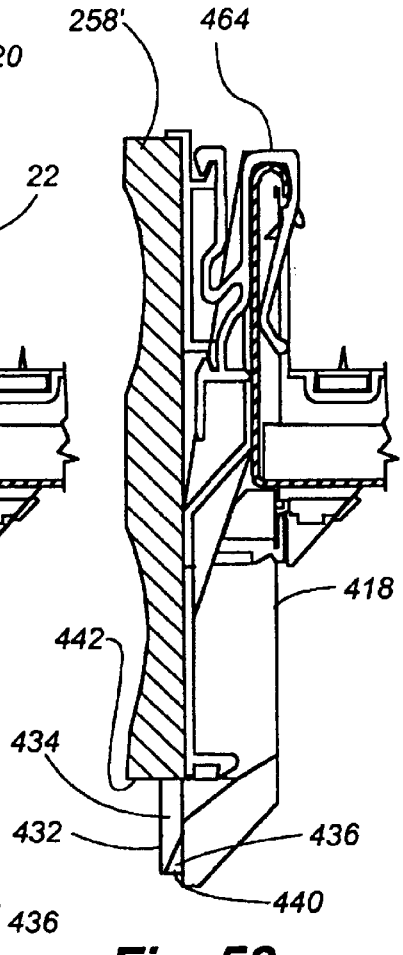
Figure 51:
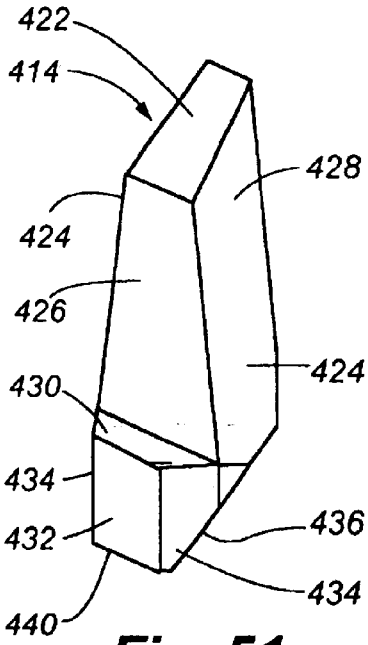
FIGS. 51 and 52 are isometric views of the supplemental prism.
Figure 52:
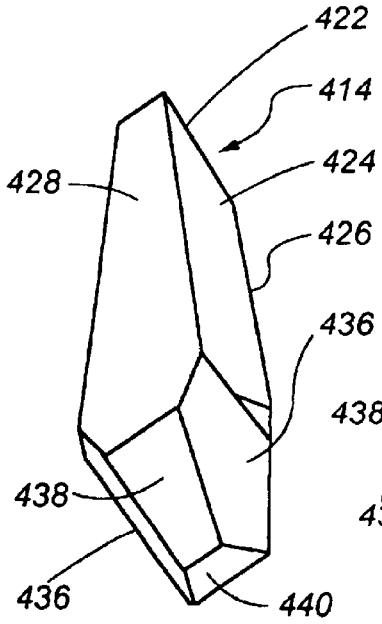
Figure 56:
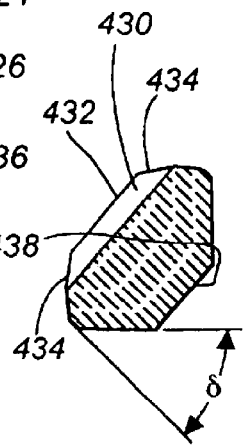
FIG. 56 is a cross-sectional view taken along line 56—56 of FIG. 54.

A first preferred embodiment of the front cover 416 is shown to best advantage in FIGS. 60–65. The front cover 416 includes a hook 420. The hook 420 hooks over the top of the headrail housing 22, so the front cover 416 hangs from the headrail housing 22 as shown in FIGS. 46–50, thereby positioning the supplemental prism 414. FIG. 50 shows a clip 464 that may be used to retain the wide valance 258' on the headrail housing 22. The hook 420 of the front cover 416 hooks over the headrail housing 22 at a longitudinal position different from that where the clip 464 hooks. Thus, the front cover 416 does not interfere with the clip 464. Upper and lower hooks 452, 454, respectively, project from the rear side of the front cover 416. The front cover 416 also includes an angled wall portion 456.

A second preferred embodiment of the front cover 416' is shown to best advantage in FIGS. 66–71. In this embodiment of the front cover 416', the hook 420 is absent. For mounting purposes, the second preferred embodiment of the front cover 416' includes a plate-like member 458. This plate-like member 458 is mounted to the inside of the wide valance 258' by gluing, stapling, or other known attachment techniques. Thus, the supplemental prism 414 is mounted to the wide valance 258' itself instead of the headrail housing 22 as is done with the first preferred embodiment of the front cover 416. Upper and lower hooks 452, 454, respectively, again project from the rear side of the front cover 416'. The front cover 416' also again includes an angled wall portion 456.

One possible method for mounding the supplemental prism 414 for operation proceeds as follows. The supplemental prism 414 is first placed into the rear cover 418, while matching the shape of the supplemental prism 414 to that of the rear cover 418. Then, a front cover 416 or 416' is selected. A lower edge 460 of the front cover 416, 416' is aligned with the placement ledge 450 of the rear cover 418, and the upper and lower hooks 452, 454 projecting from the rear side of the front cover 416, 416' are aligned with the upper and lower ears 444, 446 on the rear cover 418. The front and rear covers are then pressed together until the upper and lower hooks 452, 454 snap around the upper and lower ears 444, 446, respectively, thereby trapping the supplemental prism 414 between the covers. The angled wall portion 456 then rests against the sloped top face 422 of the supplemental prism 414 and the beveled edges 448 of the rear cover 418.

Figure 70:
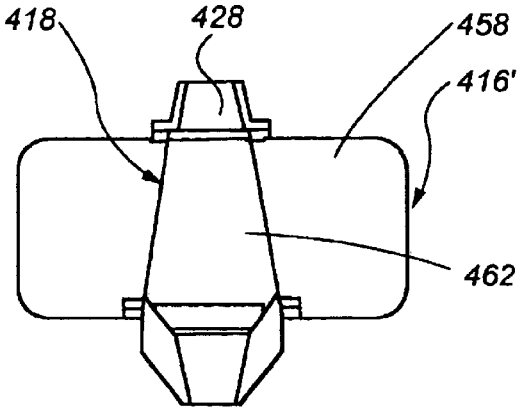
FIG. 70 is a rear elevation of the assembly depicted in FIGS. 66 and 67.
Figure 71:
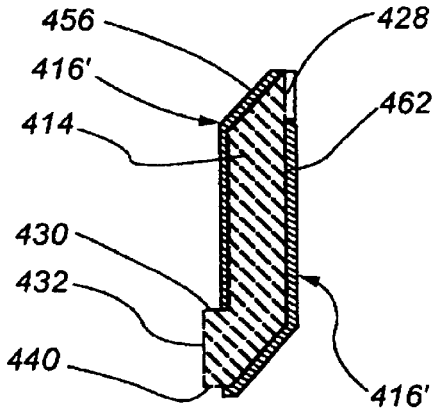
FIG. 71 is a cross-sectional view taken along line 71—71 of FIG. 69.

As shown to good advantage in FIGS. 48, 70, and 71, the rear wall 462 of the rear cover 418 only cloaks a portion of the upper rear face 428 of the supplemental prism 414. Also, as shown to good advantage in FIGS. 48–50 and 66–68, the rear cover 418 only covers a portion of the bottom face 440 and of the rearward side faces 436 when the supplemental prism 414 is mounted between the front cover 416, 416' and the rear cover 418. Thus, control signals from the remote-control transmitter are picked up by one or more of the following faces: the bottom face 440, the rearward side faces 436, the forward side faces 434, and the lower front face 432. The majority of signals are picked up by the lower front face 432 and the forward side faces 434. The supplemental prism 414 is designed to then direct the control signals to the exposed portion of the upper rear face 428 of the supplemental prism 414, which when properly mounted is adjacent to the signal refractor 204. The signal refractor 204 then directs the control signals to the collector 214 as previously discussed.

Motor Mounts

FIGS. 1, 2, and 27–31 depict different motors 14, 14' and motor mounts 276, 276', 282. The motor 14, 14' provides the required force to adjust the covering 12 (FIG. 1). The motor mounts 276, 276', 282 removably affix the selected motor 14, 14' at a desired location within a headrail housing 22, 22". The motor mounts 276, 276', 282 may also help reduce possible noise and vibration generated by the motor 14, 14' during operation. The size and shape of the motor, and the type of motor mount used to removably locate the motor within the headrail housing, vary depending upon the particular application (for example, whether the headrail housing is a low-profile housing (e.g., one inch thick) or a larger-profile housing (e.g., two inches thick), and the weight of the covering 12).

Referring first to FIGS. 1 and 2, a first type of motor 14 is depicted in a low-profile headrail housing 22. With this particular type of motor 14, a motor mount 276 in the shape of an inverted "U" (FIG. 2) is used to removably fix the position of the motor 14 within the headrail housing 22. The motor mount 276 has a substantially horizontal cross-over section 286. A leg 288 extends downwardly from each longitudinal end of the cross-over section 286. An indented shoulder 290 is formed at the point where the legs 288 join the respective longitudinal ends of the cross-over section 286. At the lower distal end of each leg 288, an inwardly directed ledge 292 is formed. When the motor mount 276 is placed on the motor 14, these inwardly-directed ledges 292 grip the motor 14. When the motor 14 and its motor mount 276 are then placed in the headrail housing 22, the distal edge 222 (e.g., FIG. 6) of the rear wall 58 of the headrail housing 22 presses downwardly upon one of the indented shoulders 290, and the free end 78 (FIG. 6) of the portion 80 extending from the front wall 56 of the housing 22 presses downwardly on the other shoulder 290, thereby securely but removably positioning the motor 14 within the headrail 22. Also shown in FIG. 2 is a bridge 278, which keeps any cords or electrical wiring from interfering with the internal components of the blind during operation, and a tilt rod adapter 280, which attaches an output shaft from the motor 14 to the tilt rod 20.

Figures 27, 28, 29, 30, 31:
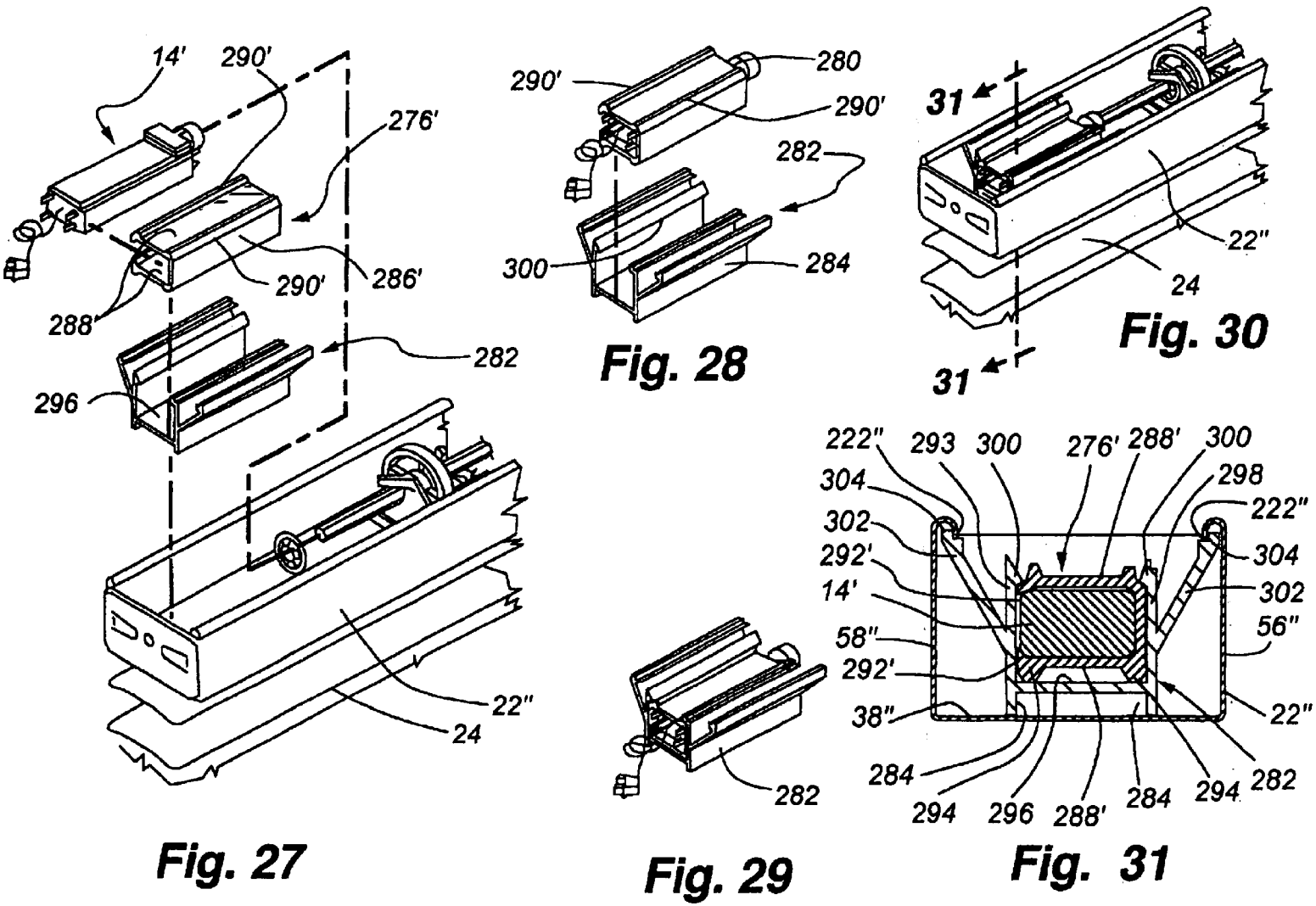
FIG. 27 is an exploded, fragmentary isometric view of the left end of a larger-profile headrail housing, depicting a motor and elements for mounting the motor in the larger-profile headrail housing.
FIG. 28 is an exploded isometric view of the assembled motor and motor mount about to be inserted into a rigid motor mount.
FIG. 29 is an isometric view of the elements of FIG. 28 in a fully-assembled configuration.
FIG. 30 is a fragmentary isometric view similar to FIG. 27, but depicting the motor mounting components fully assembled and installed within the headrail housing.
FIG. 31 is a cross-sectional view taken along line 31—31 of FIG. 30, showing the motor, motor mount, and rigid motor mount assembled within the larger-profile headrail housing.

FIGS. 27–31 show how an alternative motor 14' may be mounted in a headrail housing 22". FIG. 27 is an exploded, fragmentary isometric view of the left end of the larger-profile headrail housing 22", with the motor 14', a C-shaped or lazy-U-shaped motor mount 276', and a rigid motor mount 282 ready for insertion into the headrail housing 22". Similar to the smaller motor mount 276 depicted to best advantage in FIG. 2, the motor mount 276' depicted in FIGS. 27–31 has legs 288', and front and rear indented shoulders 290' (FIG. 27). Whereas one indented shoulder 290 (FIG. 2) was associated with each leg 288 in the smaller motor mount 276 of FIG. 2, the two indented shoulders 290' (FIG. 27) are on the lateral edges of the upper leg 288' of the larger motor mount 276' of FIGS. 27–31. A cross-over section 286' joins the legs 288'. Also, at the distal end of each leg 288', an inwardly directed ledge 292' (FIG. 31) is formed. When the motor mount 276' is placed on the motor 14', these inwardly-directed ledges 292' grip the motor 14' as shown to best advantage in FIG. 31. As also shown to best advantage in FIG. 31, the motor mount 276' includes cushioned feet 294 extending downwardly from its bottom wall. The motor mount 276' is made from a resilient, rubbery material, and helps abate possible noise or vibration generated by operation of the motor 14'.

When the motor 14' is to be mounted in a low-profile headrail housing 22 (e.g., FIGS. 1 and 2), the C-shaped motor mount 276' is slid onto the motor 14', creating the assembly depicted in the top portion of FIG. 28. That assembly is then mounted in the low-profile headrail housing 22. For example, similar to what occurs when the motor mount 276 depicted in FIG. 2 is used, the distal edge 222 (e.g., FIG. 6) of the rear wall 58 of the headrail housing 22 presses downwardly upon one of the indented shoulders 290' on the motor mount 276', and the free end 78 (FIG. 6) of the portion 80 extending from the front wall 56 of the housing 22 presses downwardly on the other shoulder 290', thereby securely but removably positioning the motor 14' and motor mount 276' within the headrail 22.

When the motor 14' is to be mounted in a larger-profile headrail housing 22" depicted in FIGS. 27, 30, and 31, the motor 14' and motor mount 276' combination is inserted into a rigid motor mount 282, which may be made of a material that is more rigid than that used for the motor mount 276'. The rigid motor mount 282 is only required when mounting the motor 14' in the larger-profile headrail housing 22". The rigid motor mount 282 includes a substantially horizontal deck 296 (FIGS. 27 and 31). Integrally formed with each lateral edge of the deck 296 is a substantially vertical inner wall 298, the lower edge of each substantially vertical inner wall 298 forming a longitudinally-extending leg 284. A longitudinally-extending and inwardly-directed retention ledge 300 is formed along the top edge of each substantially vertical inner wall 298. A sloped outer wall 302 extends outwardly and upwardly from each substantially vertical inner wall 298. Similar to what was described above in connection with the braces 216 (e.g., FIGS. 18 and 19), at the distal end of each sloped outer wall 302 is a substantially-horizontal shelf 304.

To mount the motor 14' in the larger-profile headrail housing 22", the C-shaped motor mount 276' is first placed around the motor 14', creating the assembly depicted in the top portion of FIG. 28. Then, the combined motor 14' and motor mount 276' are inserted into the rigid motor mount 282, as shown in FIG. 29. At this point, as best shown in FIG. 31, the retention ledges 300 press downwardly on the indented shoulders 290' of the motor mount 276' to removably attach the combined motor 14' and motor mount 276' to the rigid motor mount 282. The combination depicted in FIG. 29 is then inserted into the headrail housing 22" (FIGS. 30 and 31). The longitudinally-extending legs 284 support the deck 296 above the bottom wall 38" of the headrail housing 22", thereby also supporting the motor 14' and motor mount 276' assembly above the bottom wall 38" of the headrail housing 22". The distal edges 222" of the front and rear walls 56", 58", respectively, press downwardly on the substantially horizontal shelves 304 to removably hold the rigid motor mount 282, and thereby the motor 14', within the headrail housing 22".

As shown to best advantage in FIG. 31, when the motor 14' is mounted in the headrail 22", the motor 14' is wrapped and suspended. The motor 14' is wrapped by the motor mount 276' and the rigid motor mount 282. The motor 14' is suspended above the deck 296 by the cushioned feet 294 and the thickness of the bottom leg 288' of the motor mount 276', and the motor 14' is suspended above the bottom wall 38" by the longitudinally-extending legs 284 of the rigid motor mount 282. This wrapping and suspending provides the mentioned noise and vibration abatement during operation of the motor 14'.

Tilt Control System and Method

The adjustable covering 12 of the present invention further includes a novel tilt control system and method. Although the preferred embodiment of the present invention is described in relation to a Venetian blind covering 12, the present invention, including the control system that will be described in relation to FIGS. 32–45, can be utilized to control any adjustable covering 12 for an architectural opening (not shown).

Referring back to the Venetian blind 12 shown in FIGS. 1 and 2, the slats 24 of the covering 12 rest on cross-cords 320, each of which are suspended between front and rear ladder cords 322, 324, respectively. Each set of front and rear ladder cords 322, 324 and cross-cords 320 therebetween forms a ladder 326. In the exemplary embodiment shown in FIGS. 1 and 2, there are two ladders 326. Depending on the longitudinal extent of the headrail 10, however, more ladders can be employed to support the slats 24. The lower end of each ladder 326 is connected to the bottom rail 30. The upper ends of the ladder cords 322, 324 are connected to the headrail 10 in the manner described hereinafter. In general, however, the upper ends of the ladder cords 322, 324 are wrapped around the tilt rod 20 and anchored to a tilt control disk 328'. As discussed, the tilt rod 20 is connected to the electric motor 14 via a tilt rod adapter 280. The electric motor 14 acts as a driver to rotate the tilt rod 20 in either direction about its longitudinal axis.

In addition, as most clearly seen in FIG. 2, the tilt rod 20 is seated in tilt rod supports 330, which are fixedly connected to the headrail housing 22. The tilt rod supports 330 provide bearings 332 on which the tilt rod 20 rotates as well as end walls 334 that act as barriers to the axial movement of the tilt control disks 328' within the headrail housing 22. As will be discussed in greater detail, the rotation of the tilt rod 20 generally causes one of the ladder cords 322, 324 to be wrapped further onto the tilt rod 20 while the other ladder cord 332, 334 is unwrapped therefrom. This causes one end of each cross-cord 320 to move up while the other moves down, thus causing a corresponding tilt in the slats 24 being supported by the cross-cords 320. The details of the tilt control system of the present invention are described in greater detail with relation to FIGS. 32–45.

Assembly of the Tilt Control System

Figures 32, 33:
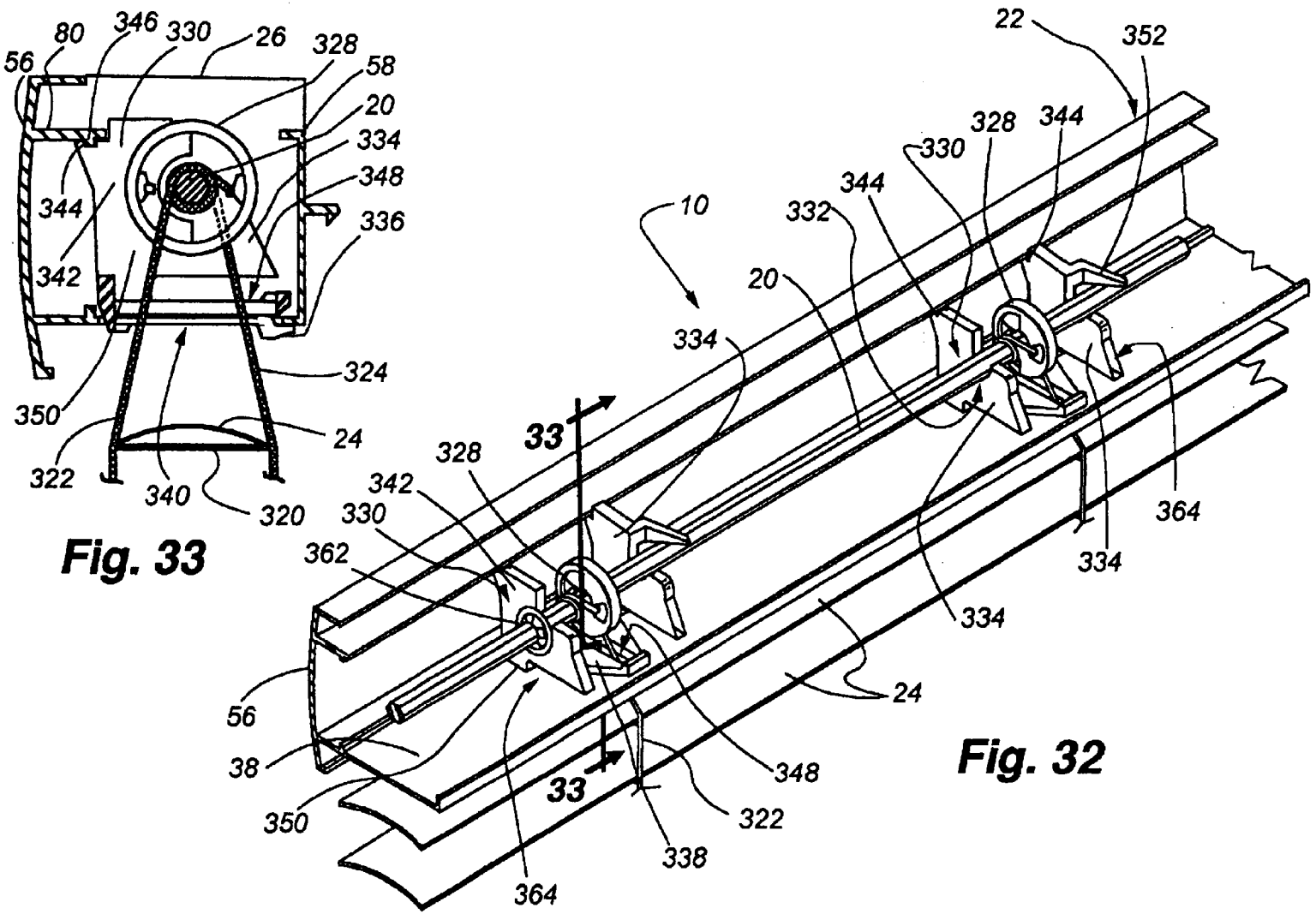
FIG. 32 is a fragmentary isometric view showing the back, right, and top of the headrail with the rear wall and other portions of the headrail housing broken away to show how the tilt rod supports, tilt rod, and a first embodiment of the tilt control disks are mounted in the headrail housing.
FIG. 33 is a cross-sectional view of the headrail taken along line 33—33 of FIG. 32 with the rear wall and left end cap of the headrail shown.

FIG. 32 is a fragmentary isometric view showing the rear, right, and top of the headrail 10 with the rear wall 58 and other portions of the headrail housing 22 broken away to show how the tilt rod supports 330, tilt rod 20, and a first embodiment of the tilt control disks 328 are mounted in the headrail housing 22. FIG. 33 is a cross-sectional view of the headrail 10 taken along line 33—33 of FIG. 32 with the rear wall 58 and left end cap 26 of the headrail shown. As shown in FIGS. 32 and 33, each of the two tilt rod supports 330 is mounted on the headrail housing 22 by first hooking a tab 336 on a base 338 of the tilt rod support 330 under the bottom wall 38 of the housing 22 through an opening 340 in the bottom wall 38. As shown most clearly in FIG. 33, the upper portion 342 of the tilt rod support 330 snaps into the headrail housing 22 via an upper hooked tab 344 that engages a lower lip 346 projecting from the portion 80 forming a horizontal, internal wall of the headrail housing 22. Other means of fixedly attaching the tilt rod supports 330 to the headrail housing 22 will be apparent to those of skill in the art.

Each tilt rod support 330 includes a slotted hole 348, preferably extending nearly the entire length of its base 338. This slotted hole 348 preferably matches the similarly shaped hole 340 in the bottom of the headrail housing 22. As shown in FIG. 32, these holes 340, 348 are used to thread the ladder cords 322, 324 through the bottom wall 38 of the headrail housing 22 and the base 338 of the tilt rod support 330 for attachment to the tilt control disks 328. The method of attachment of the ladder cords 322, 324 to the tilt control disks 328 is discussed below.

The tilt rod supports 330 each include two end walls 334 having bearings 332 (FIG. 2) in the form of recesses adapted to engage the tilt rod 20 and allow the tilt rod 20 to rotate therewithin. The bearings 332, which are seen most clearly in FIG. 2, are of generally U-shape and are preferably sized to minimize movement of the tilt rod 20 toward the front or rear walls 56, 58 of the headrail housing 22. The bearings 332 should not, however, be so tight fitting as to create substantial frictional resistance against the rotation of the tilt rod 20.

The end walls 334 are preferably not connected to the base 338 of the support except in the portion 350 (FIG. 33) near the front wall 56 of the headrail housing 22. This disconnection between the end walls 334 and the majority of the base 338 of the support 330 permits the base 338 to flex relative the end walls 334. This allows the base tab 336 to be hooked first under the bottom wall 38 of the headrail housing 22 (through the opening 340 in the bottom wall 38). The base 338 of the support then flexes easily to allow the upper hooked tabs 344 on the end walls 334 to be snapped under the lower lip 346 projecting from the horizontal, internal wall portion 80 of the headrail housing 22.

Preferably, the tilt rod supports 330 also each include an ear 352, which extends above the tilt rod 20 when the tilt rod 20 is resting in the bearings 332. The ear 352 is provided at such an angle and height so as not to interfere with the rotation of the tilt rod 20 but to impede the tilt rod 20 from becoming dislodged from the tilt rod support 330. In other words, the distance from the top of the tilt rod 20 to the bottom of the ear 352 should be less than the distance from the bottom of each bearing 332 to the top edge of each bearing 332. In addition, the entire tilt drum support 330 is preferably molded as a single piece out of a plastic material, preferably a resin with a high plastic memory. It is further preferred that, even if the ear 352 is not made integral with the rest of the support 330, the ear 352 be made of a material having memory so that it can be pushed out of the way when the tilt rod 20 is being installed into the supports 330 and returned to its original shape thereafter to prevent the tilt rod 20 from becoming dislodged.

Figure 34:
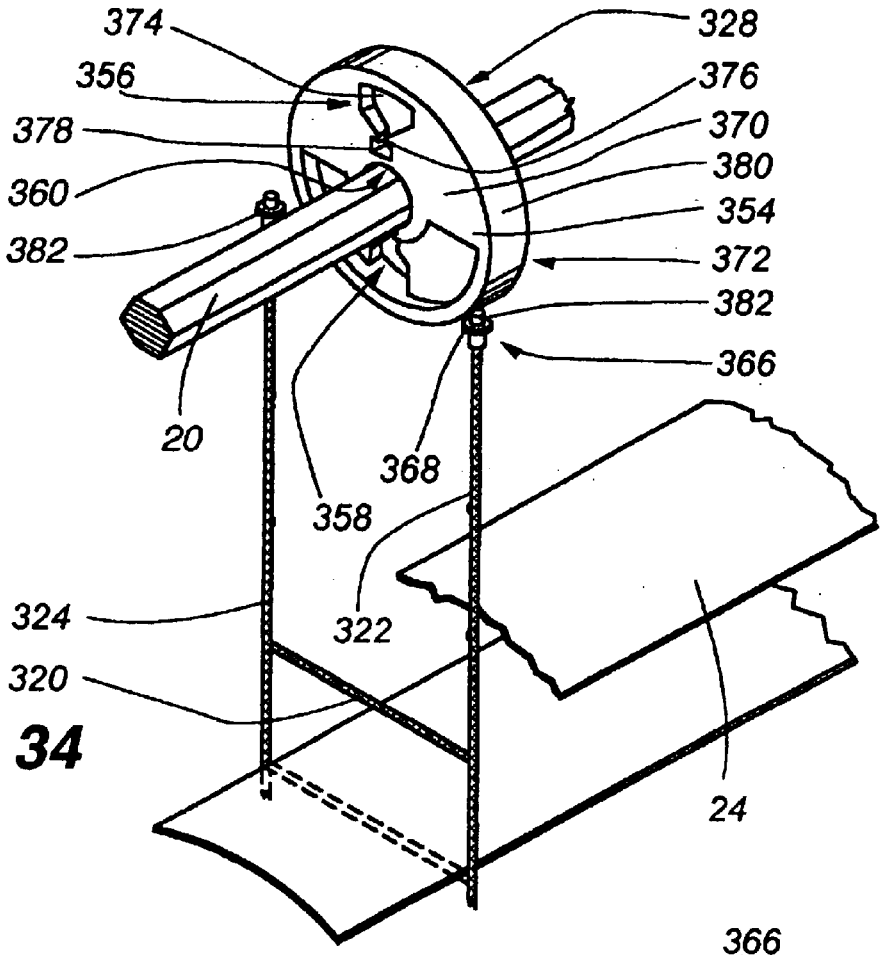
FIGS. 34–37 depict assembly of a first embodiment of a tilt control disk with the ladder cords of a covering.

Before the tilt rod 20 is snapped into place under the ears 352 and into the bearings 332 of the tilt rod supports 330, the tilt control disks 328 are mounted on the tilt rod 20. Each tilt control disk 328 generally comprises a disk-shaped body 354 in which first and second cord connectors 356, 358 are integrally formed (FIG. 34). Each tilt control disk 328 is slidably mounted onto the tilt rod 20 via an axial hole 360 in its center. Preferably the axial hole 360 is slightly larger than the diameter of the tilt rod 20 such that the tilt control disk 328 is not rotatably fixed to the tilt rod 20 and can spin freely thereon. Each tilt control disk 328 is mounted onto the tilt rod 20 in position such that when the tilt rod 20 is snapped into place in the support bearings 332, the tilt control disk 328 is located between the two end walls 334 of one of the tilt rod supports 330. The diameter of each tilt control disk 328 is such that it can rotate about the longitudinal axis of the tilt rod 20 without touching any portion of the supports 330. Once the tilt rod 20 and tilt control disks 328 are installed in the tilt rod supports 330, one or more lock washers 362, 362', which are shown most clearly in FIGS. 2 and 32, are preferably fitted over either end of the tilt rod 20 and pushed up against the outside wall 364 of each tilt rod support 330. The lock washers 362, 362' should not be pressed so tightly against the tilt rod support 330 as to create friction resisting the rotation of the tilt rod 20; however, they are useful in preventing the tilt rod 20 from shifting axially within the headrail housing 22. In general, the right lock washer 362' (FIG. 2) is unnecessary because the tilt rod 20 is prevented from shifting towards the left end cap 26 of the headrail 10 by its connection to the electric motor 14 via tilt rod adapter 280.

FIGS. 34–37 depict the preferred method of attachment of the ladder cords 322, 324 to a first embodiment of the tilt control disks 328. FIGS. 38–41 depict the preferred method of attachment of the ladder cords 322, 324 to a second embodiment of the tilt control disks 328'. For simplicity, in FIGS. 34–41 the headrail housing 22, tilt rod supports 330, slats 24, and/or various other portions of the headrail 10 and covering 12 are omitted from certain drawings. For example, it will be appreciated that, although not shown in FIGS. 34–41, the ladder cords 322, 324 must first be threaded through the bottom wall 38 of the headrail housing 22 and base 338 of the tilt rod support 330 before being attached to the tilt control disks 328 (see FIG. 32).

As shown in FIG. 34, a grommet 366 is preferably crimped onto the end of each ladder cord 322, 324 to allow for easy connection to the tilt control disk 328. The grommet 366 preferably includes a disk-shaped platform 368 of significantly larger diameter than the ladder cords 322, 324. Alternatively, beads, knots, or other means for creating an enlarged distal end of the ladder cords 322, 324 can be employed.

As discussed, the axial hole 360 via which the tilt rod disk 328 is mounted onto the tilt rod 20 is preferably slightly larger in diameter than the tilt rod 20 such that the tilt rod disk 328 can spin freely relative to the tilt rod 20. In another embodiment of the present invention, the tilt rod disk 328 is rotatably fixed to the tilt rod 20, but this is not preferred for both ease of assembly and operational reasons discussed below.

In the embodiment shown in FIGS. 34–37, the tilt rod disk 328 is formed of the generally disk-shaped body 354 and includes two integrally formed cord connectors 356, 358 that are located on opposite left and right walls 370, 372 of the tilt rod disk 328 and are spaced circumferentially approximately 180 degrees apart from one another. Each connector is integrally formed in the disk body 354 and is shaped to receive and anchor one of the ladder cords 322, 324 to the tilt rod disk 328. In particular, with reference to the cord connector 356 cut into the left wall 370 of the tilt rod disk 328 (as oriented in FIG. 34), the upper portion 374 of the connector is an opening wide enough so that the grommet 366, including its disk-shaped platform 368, can fit through the upper portion 374 without requiring the grommet 366 to be deformed. The upper portion 374 of the connector 356 narrows to a pinch point 376 that is preferably narrow enough that the disk-shaped platform 368 of the grommet 366 cannot fit therebetween and the cord 324, itself, must be deformed to be pushed through it. The cord connector 356 also includes a lower portion 378 that widens slightly but not so much that the grommet 366 can be pulled through it. Connector 358 is cut into right wall 372 in a similar manner.

The circumferential outer wall 380 of the disk body 354 is of consistent width around the circumference of the disk body 354. The thickness of each of the left and right walls 370, 372 is substantially smaller than the width of the outer wall 380. In this arrangement, the disk body 354 is essentially recessed behind each of the connectors 356, 358.

Figure 35:
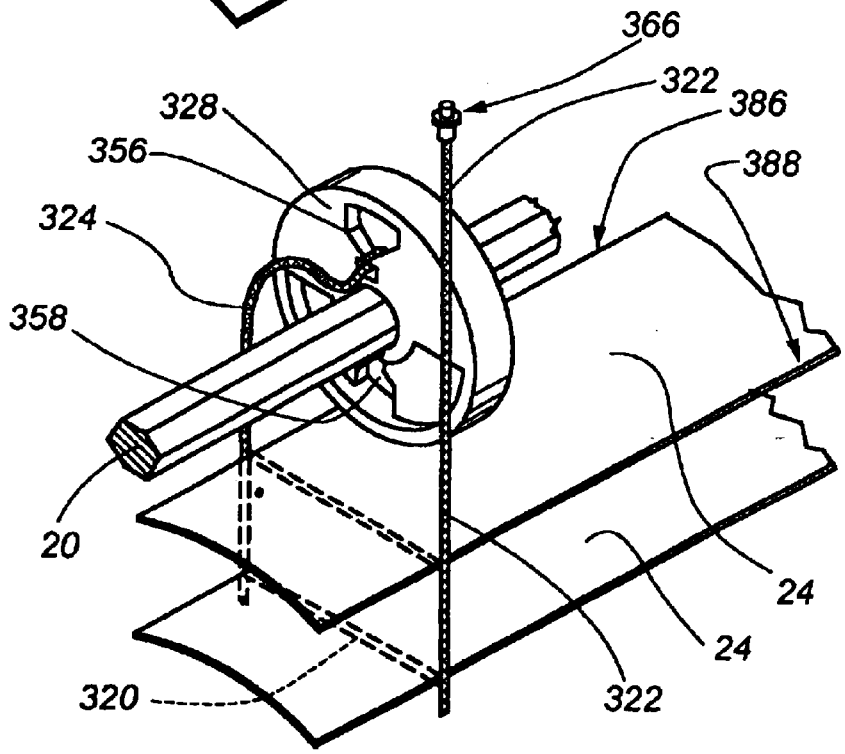
Figure 37:
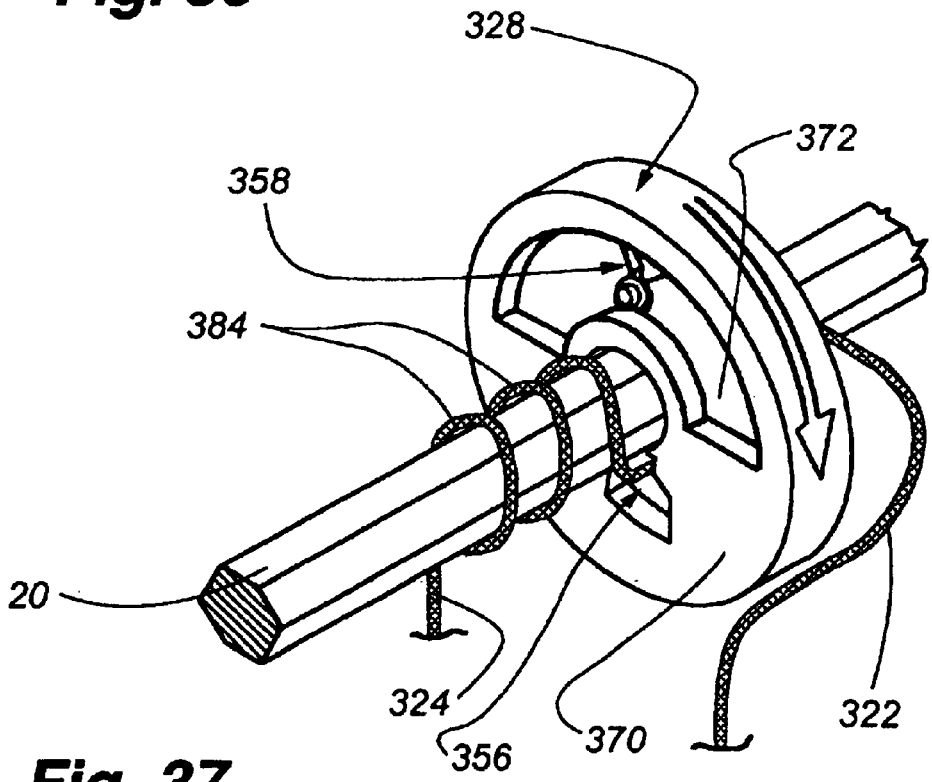

The ladder cords 322, 324 can thus be connected to the tilt control disk 328 by pushing the grommet 366 fully through the upper portion 374 of the connectors 356, 358. The portion of ladder cord directly behind the grommet 366 is then pressed through the pinch point 376 and into the lower portion 378 of the connector 356, 358. As seen in FIGS. 35 and 37, the ladder cord 322, 324 is then precluded from sliding back out of the connector 356, 358 because the grommet 366 cannot fit back through the lower portion 378 of the connector 356, 358. Preferably, the grommets 366 and the disk 328 are dimensioned so that the distal ends 382 of the grommets 366 do not extend beyond the width of the outer wall 38 when the grommets 366 are fully inserted into their respective connectors 356, 358.

Figure 36:
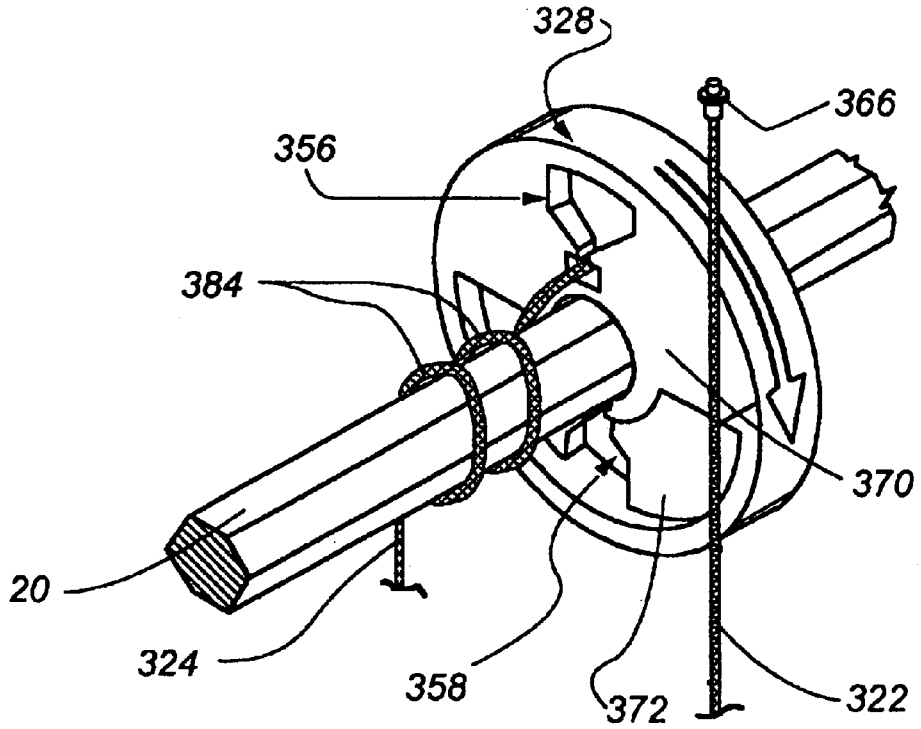

Referring now to FIGS. 35–37, a tilt control system according to the present invention is preferably assembled by first inserting the rear ladder cord 324 into the connector 356 formed in the left wall 370 of the tilt control disk 328. If, as preferred, the control disk 328 is not rotationally fixed relative to the tilt rod 20, the control disk 328 is spun around the tilt rod 20 in the direction of the arrow in FIG. 36 such that the rear ladder cord 324 is wrapped around the tilt rod 20 several times. This avoids having to thread the grommet 366 around the tilt rod 20 several times manually before inserting it into the tilt control disk 328, which can be awkward and tedious, especially when the tilt rod 20 and control disks 328 are already installed into the relatively tight spaces of the headrail housing 22. If the tilt control disk 328 is fixed relative to the tilt rod 20, the tilt rod 20 and control disk 328 can be rotated together either manually or via the electric motor 14 to wrap the rear ladder cord 324 around the tilt rod 20 in the manner shown in FIG. 36. It should be noted that the wraps 384 shown in FIG. 36 are laterally spaced from one another for clarity. In operation, the wraps 384 are normally much closer together.

Once the rear ladder cord 324 is sufficiently wrapped around the tilt rod 20, the front ladder cord 322 is attached to the tilt control disk 328 via the connector 358 formed in the right wall 372 of the tilt control disk 328. As shown in FIG. 37, the tilt control disk 328 can be spun another half turn to bring the connector 358 formed in the right wall 372 to the top of the tilt control disk 328, which makes insertion of the front cord 322 and grommet 366 into the connector 358 easier to accomplish through the top of the headrail housing 22 (shown in FIG. 1).

The appropriate number of wraps 384 of the rear ladder cord 324 during installation varies depending on a number of factors, including the circumference of the tilt rod 20, the length of the cross-cords 320, and the width of the slats 24. In the exemplary Venetian blind 12 described herein, enough of the rear ladder cord 324 should be wrapped onto the tilt rod 20 such that the slats 24 are fully tilted in one direction when first installed. Specifically, the wraps 384 of the rear ladder cord around the tilt rod 20 (and lack of such wraps of the front ladder cord 322) create a disparity in the length of the front and rear ladder cords 322, 324 hanging from the tilt control disk 328 and tilt rod 20, respectively. The disparity in those lengths should be large enough that the cross-cords 320 and slats 24 they support are fully tilted (the slats 24 being almost vertical with the rear 386 of each slat 24 being higher than the front 388 (FIG. 35)).

In fact, it is preferred that slightly more of the rear ladder cord 322 is wrapped onto the tilt rod 20 during installation than is necessary to tilt the slats 24 completely. The tilt control system of the present invention is self-correcting in this regard, and slight over-wrapping of the rear ladder cords 324 during assembly ensures the slats 24 will reach full tilting during operation. If more of the rear ladder cord 324 is wrapped onto the tilt rod 20 during installation than is necessary to tilt the slats 24 fully, the front cord 322 will actually be slightly slack between the uppermost cross-cord 320 and the tilt control disk 328 (see FIGS. 44 and 45 and related description below). When, in operation, the tilt rod 20 is first rotated in a direction opposite the arrow in FIG. 37, the tilt control disk 328 will be pulled by the unwrapping of the rear ladder cord 324 to rotate in the same direction as the tilt rod 20, and will wrap the slack in the front ladder cord 322 onto the tilt rod 20. All of the slack in the front ladder cord 322 will be wrapped onto the tilt rod 20 before the slats 24 begin to rotate from their fully tilted position. The rotation of the slats 24 and wrapping and unwrapping of the ladder cords 322, 324 onto the tilt rod 20 is discussed in greater detail in relation of the operation of the tilt control system.

Figure 38:
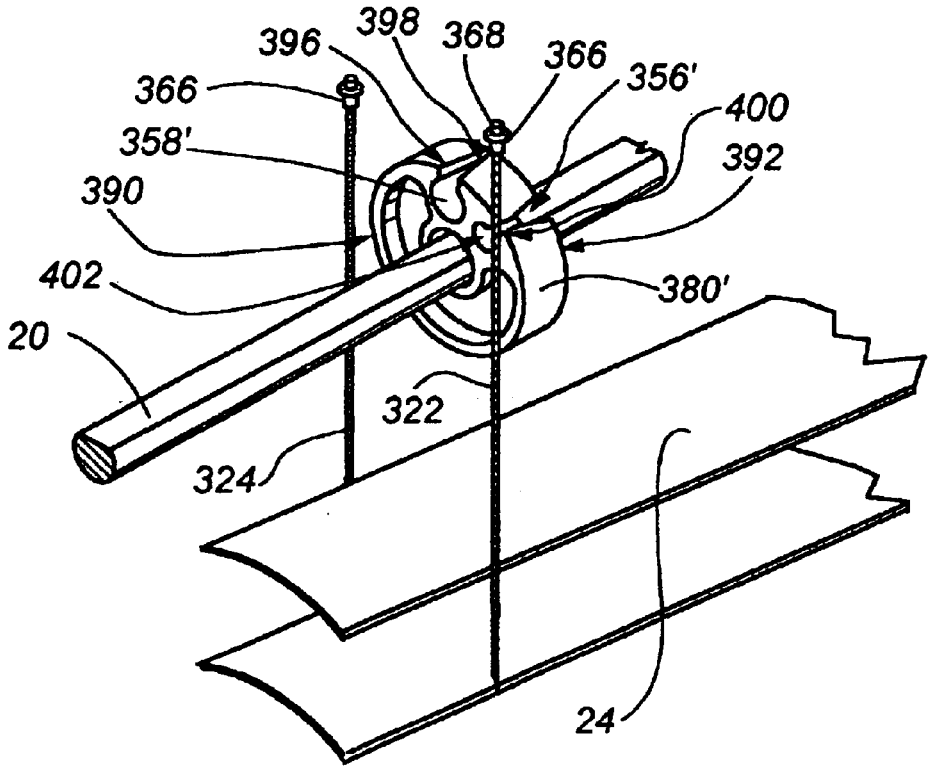
FIGS. 38–40 depict assembly of a second embodiment of a tilt control disk with the ladder cords of a covering.

FIGS. 38–41 illustrate the preferred method of assembly using a second embodiment of the tilt control disk 328'. This embodiment is illustrated using a tilt rod 20 of different cross-section to demonstrate that the cross-sectional shape of the tilt rod 20 is not critical to the present invention. The tilt control disk 328' shown in FIGS. 38–41 is constructed again of generally disk-shaped body 354', but incorporates different cord connectors 356', 358'. As shown in FIG. 38, the front and rear connectors 356', 358' comprise oppositely oriented, cone-shaped openings extending from the left face 390 to the right face 392 of the disk body 354' and creating V-shaped slots 394, 396 in the circumferential outer wall 380' of the disk 328'. Each ladder cord 322, 324 is again provided with a grommet 366 having a diameter at its widest that is greater than that of the ladder cords 322, 324.

Figure 39:
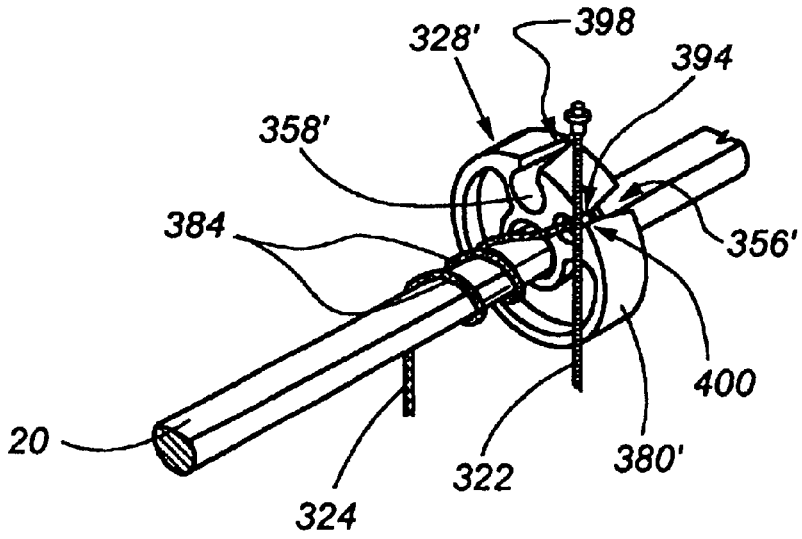
Figure 40:
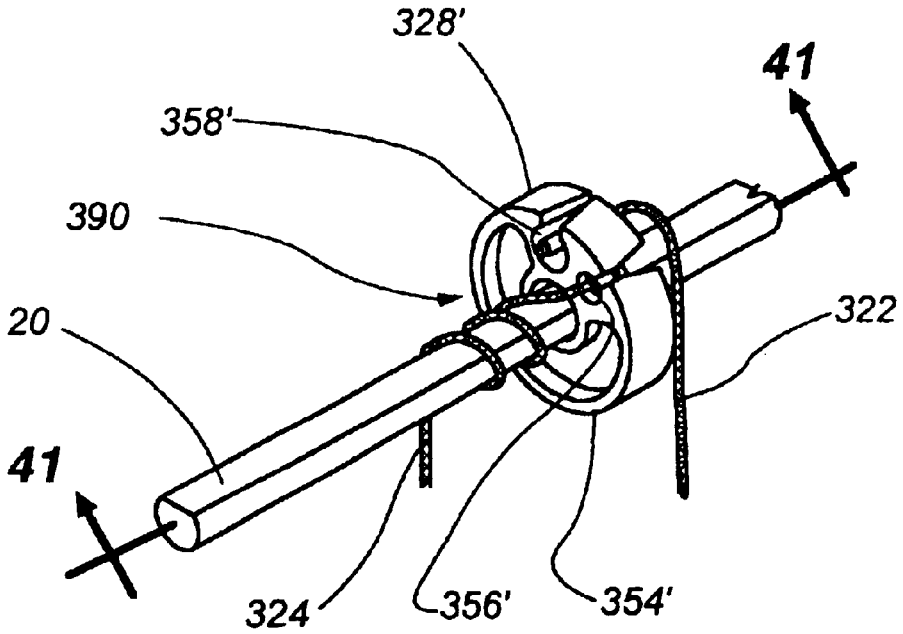
Figure 41:
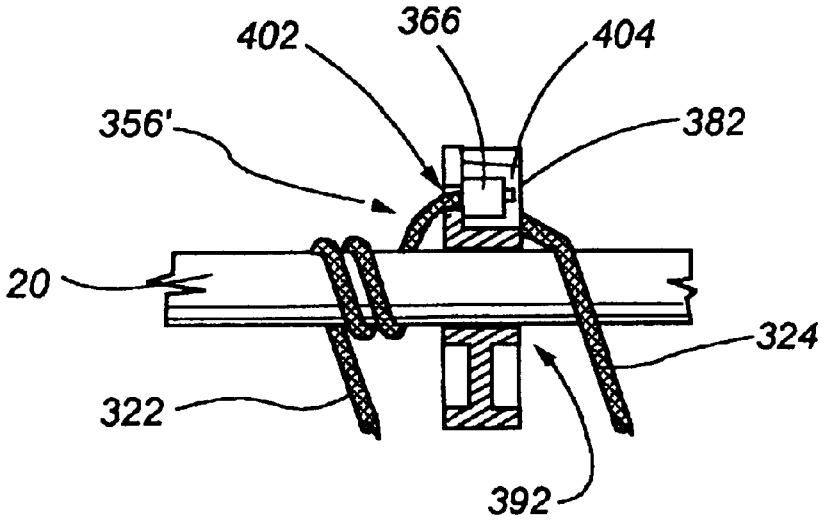
FIG. 41 is a cross-sectional view along line 41—41 of the elements shown in FIG. 40.

As shown in FIG. 39, the rear ladder cord 324 is attached to the front connector 356' by pushing the portion of the rear ladder cord 324 directly behind the grommet 366 through the narrow pinch-point 400 at the bottom of the V-shaped slot 394 in the circumferential outer wall 380'. As seen in FIGS. 40 and 41, the rear ladder cord 322 is then precluded from sliding back out of the connector 356' because the grommet 366 cannot fit back through the smaller opening 402 in the left face 390 of the disk body 354'. Preferably, the disk 328' and grommet 366 are dimensioned so that the distal end 382 of the grommet 366 does not extend past the right face 392 of the disk body 354' when fully inserted into the connector 356'. The front ladder cord 322 is connected in similar fashion.

This embodiment of the tilt control disk 328' is preferred for use with tilt rods 20 of small diameter. A smaller diameter tilt rod 20 is generally accompanied by a smaller headrail housing 22, which requires that the tilt control disks 328' must be of smaller diameter to fit therein. For example, this second embodiment of the tilt control disk 328' is typically only one inch in diameter when used in a Venetian blind 12. The connectors 356', 358' incorporated in this second embodiment of the tilt control disk 328' require less space on the body 354' of the tilt control disk 328' than the connectors 356, 358 of the first embodiment 328 (shown in FIGS. 34–37). Moreover, the cords 322, 324 can be connected by pushing the ladder cords 322, 324 through the V-shaped slots 394, 396 in the circumferential outer wall 380' of the disk 328', which is easier when dealing with relatively small parts than requiring the assembler to thread grommets 366 through connectors 356, 358 in the left or right wall 370, 372 of the disk body 354.

As shown in FIGS. 39 and 40, the ladder cords 322, 324 are wrapped around the tilt rod 20 in essentially the same manner as shown and described in relation to FIGS. 34–37. In this embodiment, however, the connectors 356', 358' are circumferentially adjacent rather than 180 degrees apart as in the first embodiment of the tilt control disk 328. This allows for the rear ladder cord 324 to be wrapped an "even" number of wraps 384 around the tilt rod 20 without requiring an extra half-wrap 384 to bring the connector 358' for the front ladder cord 322 to the top of the disk 328'. Again, the number of appropriate wraps 384 of the rear ladder cord 324 around the tilt rod 20 during assembly is dependent on the variety of factors discussed above.

FIG. 41 is a cross-section of the assembly shown in FIG. 40 taken along line 41—41, except that a different embodiment of the connector 356' is shown. Rather than an opening that narrows gradually from the right face 392 to the left face 390 of the disk body, the connector 356' shown in FIG. 41 comprises a uniform larger opening 404 in the right face 392 of the disk body 354' and a smaller opening 406 in the left face of the disk body. The slot 394 across the circumferential outer wall 380' of the disk 328' providing access to the larger and smaller openings 404, 406 is still preferably V-shaped as shown in FIG. 40.

Other configurations of suitable cord connectors 356, 358 will be apparent to those skilled in the art. For example, clips or other fasteners could be attached at various points on the disk body 354. It is preferred, however, that the connectors 356, 358 be integrally formed in the disk body 354 so as not to require any more space than is necessary. It will also be appreciated that the method described in relation to FIGS. 34–41 for attaching the ladder cords 322, 324 to the tilt control disk 328 and tilt rod 20 is exemplary. For example, the front ladder cord 322 could be wrapped onto the tilt rod 20 during assembly before the rear ladder cord 324 is attached to the tilt control disk 328. Moreover, the front ladder cord 322 can be connected to the connector 356 and the rear cord 324 to the connector 358.

Operation of the Tilt Control System

The operation of a preferred embodiment of the tilt control system will be discussed in relation to FIGS. 42–45. In this preferred embodiment, the tilt control disk 328 is not rotatably fixed to the tilt rod 20. In addition, this preferred embodiment of the tilt control system is described using the first embodiment of the tilt control disk 328 described in relation to FIGS. 34–37; however, the tilt control system of the present invention operates in essentially identical fashion when the second embodiment of the tilt control disk 328' (FIGS. 38–41) is employed.

As discussed, unlike prior systems using tilt drums, the ladder cords 322, 324 of the present system are wrapped directly onto the tilt rod 20. Although the tilt control disks 328 act as convenient assembly tools, anchors for the ends of the ladder cords 322, 324 and, as will be discussed, clutches, the ladder cords 322, 324 depend on friction with the tilt rod 20 to effectuate the tilting of the slats 24. As such, the relatively small diameter of the tilt rod 20 creates a small moment arm, which minimizes the torque acting against the electric motor 14 (or other tilter) driving the tilt rod 20.

Figure 42:
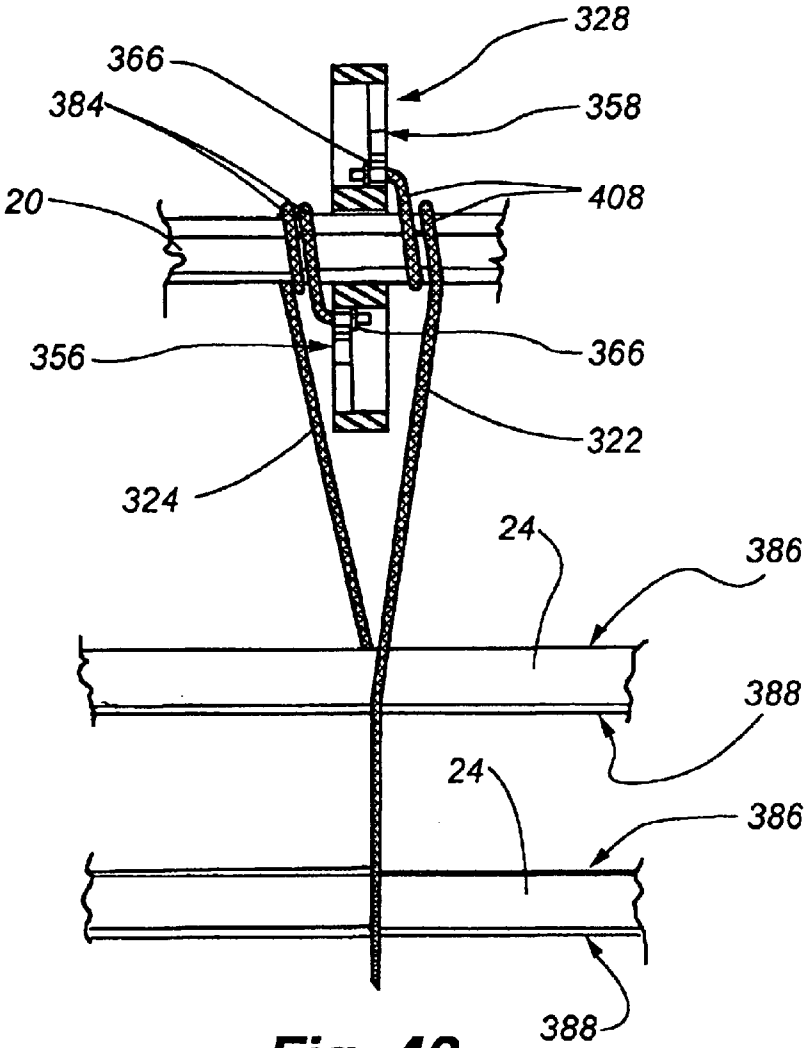
FIG. 42 is a fragmentary, isometric, schematic view showing the top, left, and front of the tilt rod, the first embodiment of the tilt control disk, and ladder cords after assembly thereof, wherein the tilt control disk is shown in cross-section.

In FIG. 42, the slats 24 are shown in as tilted slightly downward from rear 386 to front 388. When the slats 24 are in such a neutral position (i.e., not fully tilted in either direction) and the tilt rod 20 is stationary, both ladder cords 322, 324 are wrapped around the tilt rod 20, and the weight of the covering 12 (including the weight of the slats 24 pressing on the cross-cords 320, the bottom rail 30, etc.) creates tension in both ladder cords 322, 324. The tension in the ladder cords 322, 324 tightens the wraps 408, 384 of both ladder cords 322, 324 on the tilt rod 20, creating friction between the tilt rod 20 and the wraps 408, 384 of ladder cords 322, 324. In addition, because there is essentially equal tension in the ladder cords 322, 324 pulling the tilt control disk 328 to rotate in opposite directions, the tilt control disk 328 does not spin relative to the tilt rod 20. FIG. 42 also shows a cross-sectional view of the first embodiment of the tilt rod disk 328 more clearly demonstrating how the grommets 366 are secured in the connectors 356, 358.

Figure 43:
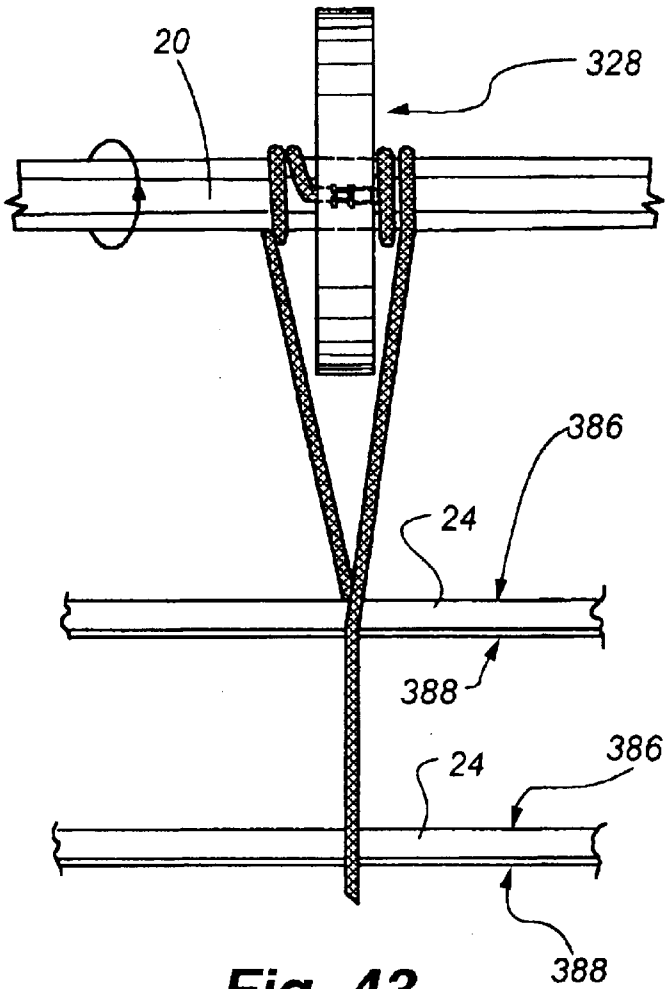
FIG. 43 is a fragmentary, isometric, schematic view showing the top, left, and front of the tilt rod, the first embodiment of the tilt control disk, and ladder cords after assembly thereof.

When the tilt rod 20 is rotated and the slats 24 are in a neutral position, the tilt control disk 328 rotates in unison with the tilt rod 20. For example, FIG. 43 shows the same tilt control system as in FIG. 42 after the tilt rod 20 has been rotated 90 degrees in the direction of the arrow. The tension in the rear ladder cord 324 and resulting friction between the rear ladder cord wraps 384 and the tilt rod 20 pulls the tilt control disk 328 to rotate also in the direction of the arrow. Unlike when the tilt rod 20 was stationary, the rotation of the tilt rod 20 creates an additional rotational tension, or pull, of the rear ladder cord wraps 384 on the tilt control disk 328 that is not opposed by an equal, opposite pull by the front ladder cord wraps 408. Rather, because of the friction between the front ladder cord wraps 408 and the tilt rod 20, the wraps 408 of the front ladder cord 322 also rotate with tilt rod 20 in the direction of the arrow, and the tension in the front ladder cord 322 remains constant (i.e., the tension created by the weight of the covering 12).

Thus, the additional tension in the rear ladder cord 324 created by the rotation of the tilt rod 20 causes the tilt control disk 328 to rotate in unison with the tilt control rod 20. The 90 degree rotation of the tilt rod 20 and tilt control disk 328 in the direction of the arrow causes the rear cord 324 to unwrap from, and the front ladder cord 322 to wrap onto, the tilt rod 20. As seen in a comparison of FIGS. 42 and 43, this causes a corresponding drop in the rear 386 of the slats 24 and rise in the front 388 of the slats 24.

Similarly, when the tilt rod 20 is rotated in the opposite direction, the front cord wraps 408 pull the tilt control disk 328 to rotate in unison with the tilt rod 20, thereby causing the front ladder cord 322 to be unwrapped from, and the rear ladder cord 324 to be wrapped onto, the tilt rod 20. This causes a corresponding drop in the front 388 of the slats 24 and rise in the rear 386 of the slats 24. The tilt control system of the present invention operates in this manner until the slats 24 reach an extreme position (i.e., fully tilted in either direction).

Figure 44:
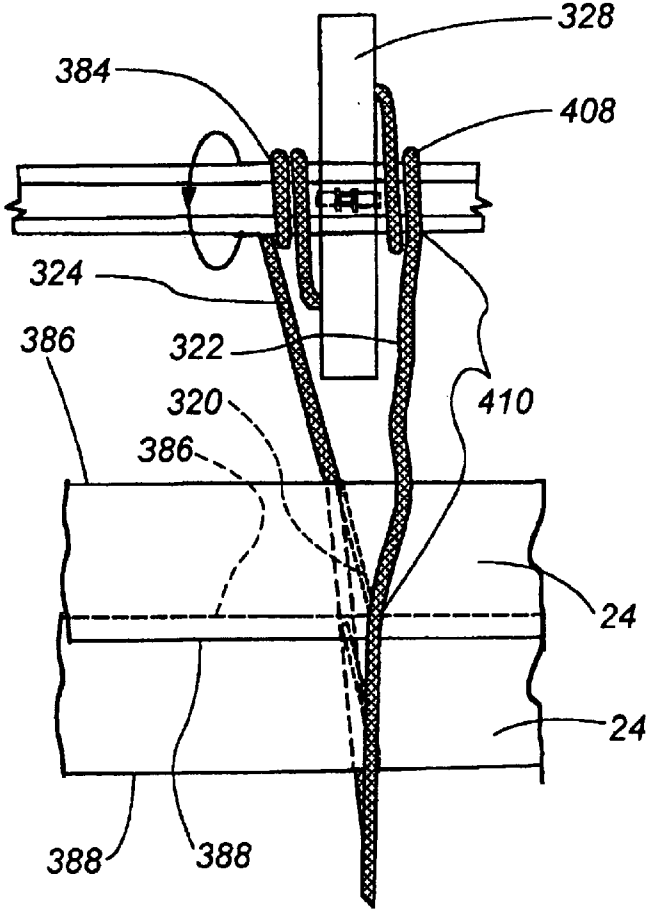
FIG. 44 is a fragmentary, isometric, schematic view showing the top, left, and front of the tilt rod, the first embodiment of the tilt control disk, and ladder cords after assembly thereof when the slats are in a first fully tilted position.
Figure 46:
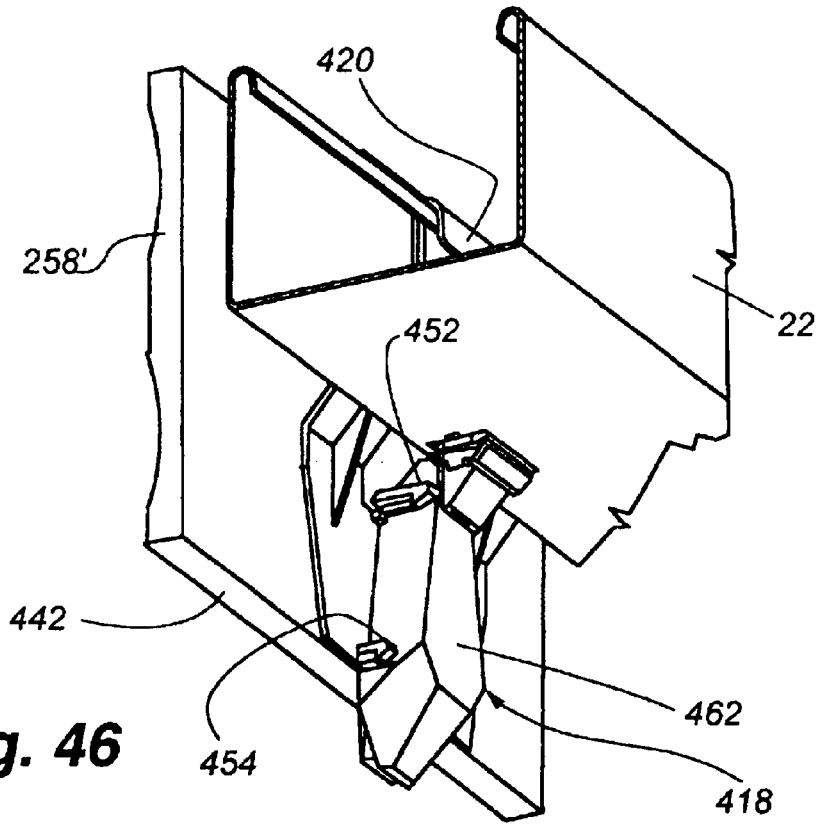
FIG. 46 is a rear isometric view of a headrail with a wide valance and a supplemental prism.
Figure 47:
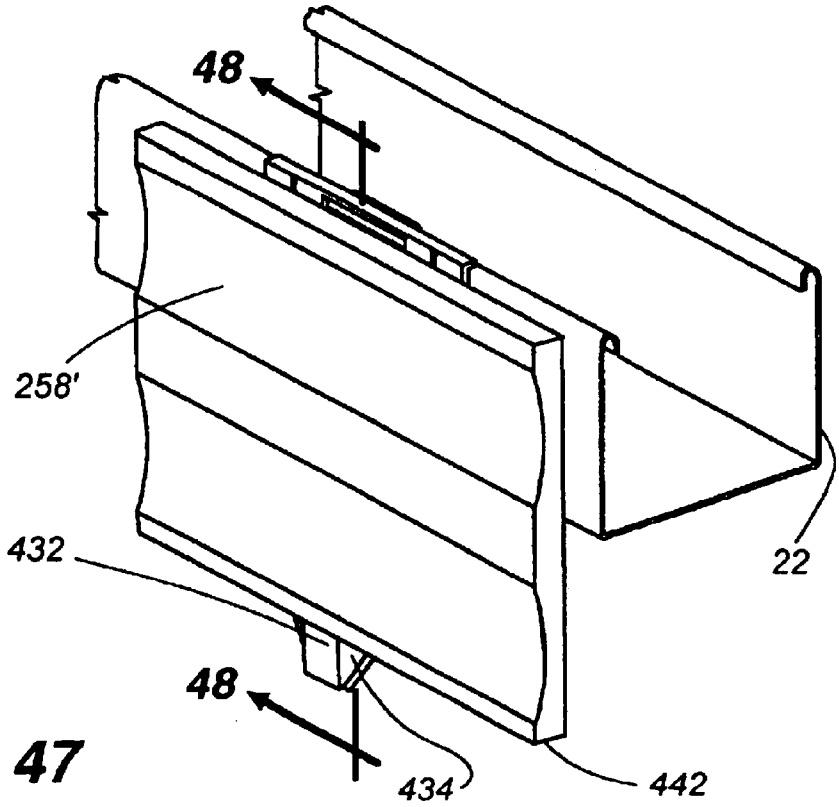
FIG. 47 is a front isometric view of the headrail, wide valance, and supplemental prism of FIG. 46.

FIG. 44 shows a tilt control system operating when the slats 24 are in a first extreme position—where the rear ladder cord 324 has been wrapped (and the front ladder cord 322 unwrapped) so far that the slats 22 can tilt no further in that direction. If the tilt rod 20 is rotated in the direction of the arrow in FIG. 44, the rear cord 324 will begin to lift the entire covering 12. That is, the front ladder cord 322 cannot drop further because it is connected to the cross-cords 320, which are now nearly flush against, and being lifted by, the rear ladder cord 324. Therefore, the rear ladder cord 324 starts to raise the front ladder cord 322 (by the front ladder cord's 322 connection to the cross-cords 320). This causes the tension to go out of a section 410 of the front ladder cord 322 between the tilt rod 20 and the uppermost cross-cord 320 (shown in phantom lines in FIG. 44). A reduction of the tension in the front ladder cord 322 correspondingly reduces the friction in between the front ladder cord wraps 408 and the tilt rod 20. The wraps 408 of the front ladder cord 322 around the tilt rod 20 then begin to slip relative to the rotation of the tilt rod 20, and there is no driving force to rotate the tilt control disk 328 along with the tilt rod 20.

In addition, because the tilt control disk 328 is not being pulled to rotate along with the tilt rod 20, the grommet-end 366 of the rear ladder cord 324 remains stationary. As the tilt rod 20 rotates in the direction of the arrow, attempting to add additional wraps 384 of the rear ladder cord 324, the wraps 384 already on the tilt rod 20 loosen and also begin to slip relative to the rotation of the tilt rod 20. As such, any further rotation of the tilt rod 20 in the direction of the arrow in FIG. 44 results in the wraps 408, 384 of both ladder cords 322, 324 and the tilt control disk 328 remaining rotationally stationary and slipping relative to the rotation of the tilt rod 20. Once the tilt rod 20 is reversed to rotate in the opposite direction, the rear ladder cord wraps 384 pulls the tilt control disk 328 to rotate in unison with the tilt rod 20, which returns the tension to the front ladder cord 322, and the tilt control system returns to operating as described in relation to FIGS. 42 and 43.

In this way, the tilt control disk 328 acts as an inexpensive and effective clutch mechanism. For example, if the tilt control system of the present invention is used in a Venetian blind having a remotely controlled motorized tilter (such as the electric motor 14 discussed herein), one can hold down the button on the remote control that drives the motorized tilter 14 (and tilt rod 20) well beyond the point where the slats 24 are fully tilted. The wraps 408, 384 of the ladder cords 322, 324 and the tilt control disk 328 simply slip relative to the tilt rod 20 once the slats 24 are fully tilted, and the over-rotation of the tilt rod 20 is of no consequence.

Figure 45:
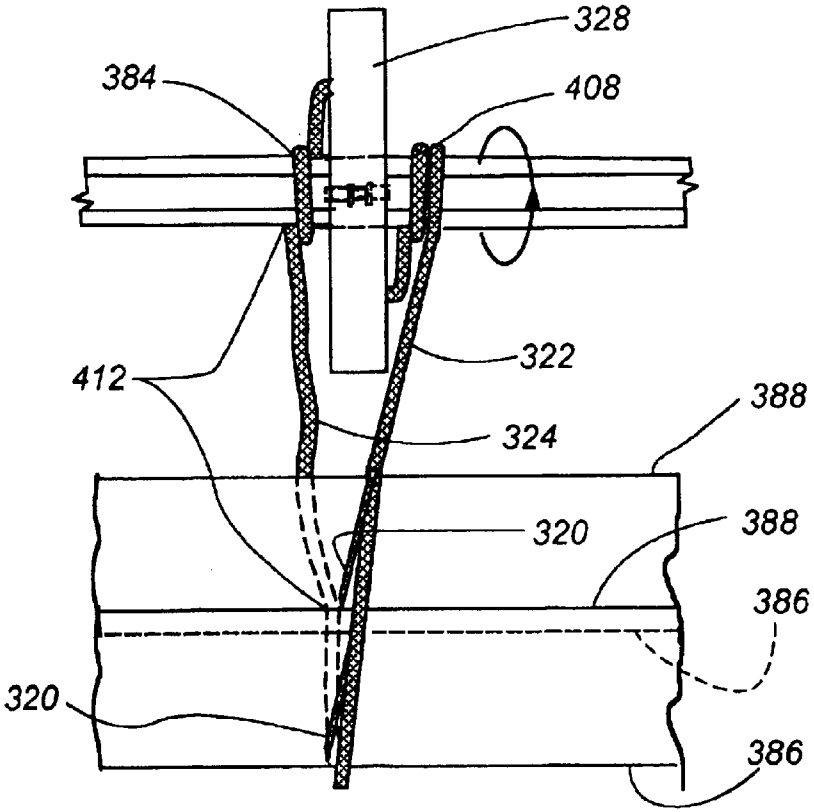
FIG. 45 is a fragmentary, isometric, schematic view showing the top, left, and front of the tilt rod, the first embodiment of the tilt control disk, and ladder cords after assembly thereof when the slats are in a second fully tilted position.

FIG. 45 shows a tilt control system operating when the slats 24 are in a second extreme position—where the front ladder cord 322 has been wrapped (the rear ladder cord 324 unwrapped) so far that the slats 24 can tilt no further in that direction. For the same reasons discussed above, if the tilt rod 20 rotates in the direction of the arrow in FIG. 45 (opposite the direction of the arrow in FIG. 44), slack is created in a section 412 of the rear ladder cord 324 the tilt control disk 328 and the wraps 408, 384 of the both ladder cords 322, 324 begin slipping again in relation to the tilt rod 20. As such, the tilt control disk 328 acts as an inexpensive and effective clutch mechanism against further winding of the front ladder cord 322 when the slats 24 are in a second extreme position.

Notably, although the tilt control system of the present invention is particularly well-suited to use with a motorized tilt-rod driver, such as electric motor 14, it can also be used with other tilt-rod drivers, such as a worm shaft/pinion combination or other manual mechanisms for causing the tilt rod 20 to rotate. In addition, the control system and control disk of the present invention are not limited to use in Venetian blinds or in controlling simply the tilting function of an adjustable covering 12. Rather those skilled in the art will recognize that the control system and control disk of the present invention have application in other adjustable coverings 12 and in controlling functions other than the tilting of those adjustable coverings 12. The control system of the present invention can be adapted to control any function of an adjustable covering 12 wherein that function of the adjustable covering is controlled by at least a first cord, wherein at least some of the first cord winds onto a control shaft when the control shaft is rotated in a first direction and unwinds from the control shaft as the control shaft rotates in a second direction. In this regard, tilt rod 20 is simply an example of a control shaft and tilt control disk 328 is simply an example of a control disk according to the present invention. Moreover, the "full tilting" of the slats 24 of a Venetian blind in a particular direction is simply an example of a first extreme position of an adjustable covering 12 and the "full tilting" of the slats 24 in the opposite direction is an example of a second extreme position of the adjustable covering.

Although preferred embodiments of this invention have been described above, those skilled in the art could make numerous alterations to the disclosed embodiments without departing from the spirit or scope of this invention. Numerous configurations for the battery magazine 32, 32' and housing 22, 22', 22" could be used. For example, the battery magazine 32, 32' may be cut any length to accommodate the required number of batteries 34 for energizing the motor that selectively configures the adjustable covering 12. The electrical connections depicted in FIGS. 15 and 16 between the batteries 34' may be altered depending upon the desired electrical characteristics. The design of the front wall 56 (e.g., FIG. 3), 56' (e.g., FIG. 18), 56" (e.g., FIG. 31) of the housing 22, 22', 22", respectively, may take on one of many different shapes depending in part upon the preference of the purchaser. Thus, myriad housing shapes and battery magazine shapes and lengths are within the scope of the present invention. Further, it is not important that the trap door 96 (e.g., FIG. 13) have precisely three protrusions 134, 136, 138, and the shape of the protrusions could be altered. For example, the protrusions could comprise semi-circular bumps formed on the trap door 96. There are also numerous possible configurations for the remote eye 242 (e.g., FIG. 22) and the clamp 252 (FIG. 23) and clip 264 (FIG. 25). Similarly, although the signal refractor 204 depicted in FIG. 21 is the most preferred configuration presently known to the inventors, a wide variety of specific configurations for the signal refractor 204 would work. The signal-receiving system 16 has been described above as being for motorized adjustable coverings 12 for architectural openings. It could, however, be used in other application (e.g., remote-controlled lighting). Finally, all directional references (e.g., upper, lower, upward, downward, left, right, leftward, rightward, top, bottom, above, below, vertical, horizontal) above are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative and not limiting.

We claim:

1. A headrail for a powered covering for an architectural opening comprising:

a housing having a plurality of walls defining an interior and a flexible retainer extending from one of said walls into said interior;

a battery magazine adapted to hold at least one battery, said battery magazine being snappingly positioned within said interior of said housing by said flexible retainer;

a motor removably mounted within said interior of said housing, wherein said motor is powered by said at least one battery; and a signal-receiving system removably connected to said housing, wherein said signal-receiving system is operably connected to said motor, said signal-receiving system comprising receiver electronics and a signal-receiver operatively connected to said receiver electronics and wherein said signal-receiver comprises a signal refractor removably mounted to said headrail housing and wherein said headrail housing has a front wall with a lowest edge, wherein a receiver holder supports said receiver electronics within said headrail housing, said receiver holder having a bottom surface and wherein said signal refractor is removably associated with said bottom surface in a position adjacent to said lowest edge of said front wall.

2. A headrail for a powered covering for an architectural opening comprising:

a housing having a plurality of walls defining an interior and a flexible retainer extending from one of said walls into said interior;

a battery magazine adapted to hold at least one battery, said battery magazine being snappingly positioned within said interior of said housing by said flexible retainer;

a motor removably mounted within said interior of said housing, wherein said motor is powered by said at least one battery; and a signal-receiving system removably connected to said housing, wherein said signal-receiving system is operably connected to said motor, said signal-receiving system comprising receiver electronics and a signal-receiver operatively connected to said receiver electronics and wherein said signal-receiver comprises a signal refractor removably mounted to said headrail housing and wherein said headrail housing has a front wall with a lowest edge, wherein a receiver holder supports said receiver electronics within said headrail housing, said receiver holder comprising a receiver holder base and a receiver holder cover, said receiver holder base having a bottom surface and wherein said signal refractor is removably fixed to said bottom surface in a position adjacent to said lowest edge of said front wall.

3. A headrail for a powered covering for an architectural opening comprising:

a housing having a plurality of walls defining an interior and a flexible retainer extending from one of said walls into said interior;

a battery magazine adapted to hold at least one battery, said batter magazine being snappingly positioned within said interior of said housing by said flexible retainer;

a motor removably mounted within said interior of said housing, wherein said motor is powered by said at least one battery, and further including a system for mounting said motor within said headrail housing, said motor mounting system comprising a motor mount having a first leg, a second leg, a cross-over section joining said first leg and said second leg, and at least one indented shoulder associated with at least one of said first and second legs, said cross-over section being substantially horizontal and having first and second longitudinal ends, said first leg being substantially vertical and extending downwardly from said first longitudinal end of said cross-over section, said second leg being substantially vertical and extending downwardly from said second longitudinal end of said cross-over section, and said at least one indented shoulder comprising a first indented shoulder formed at a point where said first leg joins said first longitudinal end of said cross-over section, and a second indented shoulder formed at a point where said second leg joins said second longitudinal end of said cross-over section.

4. A headrail for a powered covering for an architectural opening comprising;

a housing having a plurality of walls defining an interior and a flexible retainer extending from one of said walls into said interior;

a battery magazine adapted to hold at least one battery, said battery magazine being snappingly positioned within said interior of said housing by said flexible retainer;

a motor removably mounted within said interior of said housing, wherein said motor is powered by said at least one battery, and further including a system for mounting said motor within said headrail housing, said motor mounting system comprising a motor mount having a first leg, a second leg, a cross-over section joining said first leg and said second leg, and at least one indented shoulder associated with at least one of said first and second legs, said cross-over section being substantially vertical and having upper end lower lateral edges, said first leg being substantially horizontal and extending from said upper lateral edge of said cross-over section, said second leg being substantially horizontal and extending from said lower lateral edge of said cross-over section, and said at least one indented shoulder comprising a first indented shoulder formed at a first lateral edge of said first leg and a second indented shoulder formed at a second lateral edge of said first leg.

5. The headrail of claim 4, wherein a plurality of cushioned feet extend downwardly from said second leg.

6. A headrail for a powered covering for an architectural opening comprising:

a housing having a plurality of walls defining an interior and a flexible retainer extending from one of said walls into said interior;

a battery magazine adapted to hold at least one battery, said battery magazine being snappingly positioned within said interior of said housing by said flexible retainer;

a motor removably mounted within said interior of said housing, wherein said motor is powered by said at least one battery;

a signal-receiving system removably connected to said housing wherein said signal-receiving system is operatively connected to said motor; and a system for mounting said motor within said headrail housing, said motor mounting system comprising a motor mount having a first leg, a second leg, a cross-over section joining said first leg and said second leg, and at least one indented shoulder associated with at least one of said first and second legs, and said motor mounting system further including a rigid motor mount, said motor mount being mounted within said rigid motor mount.

7. The headrail of claim 6, wherein said rigid motor mount further comprises:

a substantially horizontal deck having first and second lateral edges;

a first substantially vertical inner wall integrally joined with said first lateral edge of said deck;

a second substantially vertical inner wall integrally joined with said second lateral edge of said deck;

a first sloped outer wall integrally joined with said first substantially vertical inner wall, and extending outwardly and upwardly therefrom; and a second sloped outer wall integrally joined with said second substantially vertical inner wall, and extending outwardly and upwardly therefrom.

8. The headrail of claim 7, wherein said rigid motor mount further comprises a substantially-horizontal shelf at a distal end of each of said first and second sloped outer walls.

9. The headrail of claim 8, wherein said rigid motor mount further comprises a longitudinally-extending and inwardly-directed retention ledge formed along a top edge of each of said fist and second substantially vertical inner wall.

10. The headrail of claim 9, wherein a lower edge of each substantially vertical inner wall forms a longitudinally-extending leg.

11. A headrail for a powered covering for an architectural opening comprising:

a housing having a plurality of walls defining an interior and a flexible retainer extending from one of said walls into said interior;

a battery magazine adapted to hold at least one battery, said battery magazine being snappingly positioned within said interior of said housing by said flexible retainer;

a motor removably mounted within said interior of said housing, wherein said motor is powered by said at least one battery;

a signal-receiving system removably connected to said housing, wherein said signal-receiving system is operatively connected to said motor; and a motor mount for mounting said motor within said housing, said motor mount comprising a substantially horizontal cross-over section having first and second longitudinal ends, a first leg extending downwardly from said first longitudinal end of said cross-over section, a second leg extending downwardly from said second longitudinal end of said cross-over section, a first indented shoulder formed at a point where said first leg joins said first longitudinal end of said cross-over section, and a second indented shoulder formed at a point where said second leg joins said second longitudinal end of said cross-over section.

* * * * *